US010811830B2

(12) United States Patent
Tsai

(10) Patent No.: US 10,811,830 B2
(45) Date of Patent: Oct. 20, 2020

(54) LOW-HEIGHT CONNECTOR COMBINATION OF DUPLEX ELECTRICAL CONNECTION SOCKET AND DUPLEX ELECTRICAL CONNECTION PLUG

(71) Applicant: Chou Hsien Tsai, New Taipei (TW)

(72) Inventor: Chou Hsien Tsai, New Taipei (TW)

( * ) Notice: Subject to any disclaimer, the term of this patent is extended or adjusted under 35 U.S.C. 154(b) by 0 days.

(21) Appl. No.: 16/177,404

(22) Filed: Oct. 31, 2018

(65) Prior Publication Data

US 2019/0334299 A1 Oct. 31, 2019

Related U.S. Application Data

(62) Division of application No. 15/962,810, filed on Apr. 25, 2018.

(51) Int. Cl.

| | |
|---|---|
| ***H01R 24/00*** | (2011.01) |
| ***H01R 33/00*** | (2006.01) |
| ***H01R 24/64*** | (2011.01) |
| ***H01R 13/642*** | (2006.01) |
| ***H01R 24/60*** | (2011.01) |
| *H01R 13/658* | (2011.01) |

(Continued)

(52) U.S. Cl.

CPC ..... *H01R 24/64* (2013.01); *H01R 13/642* (2013.01); *H01R 24/60* (2013.01); *H01R 13/658* (2013.01); *H01R 13/6582* (2013.01); *H01R 2107/00* (2013.01)

(58) Field of Classification Search

CPC ..... H01R 24/64; H01R 24/62; H01R 24/60; H01R 24/54; H01R 33/94; H01R 23/02; H01R 13/642

USPC ..... 439/676, 660

See application file for complete search history.

(56) References Cited

U.S. PATENT DOCUMENTS 8,870,601 B2 * 10/2014 Lee ..... H01R 31/06 439/131

2004/0023559 A1 * 2/2004 Wu ..... H01R 13/516 439/638

(Continued)

FOREIGN PATENT DOCUMENTS

CN 201181784 Y 1/2009

CN 201812968 U 4/2011

(Continued)

*Primary Examiner* — Hae Moon Hyeon

(74) *Attorney, Agent, or Firm* — Pro-TECHTOR International Services; Ian Oglesby

(57) ABSTRACT

In a low-height connector combination, a duplex electrical connection socket includes: an insulation base having a tongue, and a metal housing formed with a connection slot. Heights of spaces of the connection surfaces are smaller than a large space of a standard socket having a minimum height and greater than a small space of the standard socket. A duplex electrical connection plug includes an insulation base, a metal housing and a fitting portion having two contact interface substrates and a fitting space. Heights of the contact interface substrates are smaller than a contact interface substrate of a standard plug having a minimum height and greater than the small space. The fitting portion can be bidirectionally inserted into the connection slot. Each of two fitting gaps of the fitting portion between the contact interface substrates and the connection surfaces of the tongue is smaller than 0.15 mm to form tight fitting.

29 Claims, 23 Drawing Sheets

(51) Int. Cl.
*H01R 13/6582* (2011.01)
*H01R 107/00* (2006.01)

(56) References Cited

U.S. PATENT DOCUMENTS

| | | | | |
|---|---|---|---|---|
| 2009/0113093 | A1* | 4/2009 | Chen | H01R 13/7175 710/74 |
| 2012/0015561 | A1* | 1/2012 | Tsai | H01R 24/60 439/660 |
| 2013/0005193 | A1* | 1/2013 | Tsai | H01R 13/6315 439/676 |
| 2013/0157517 | A1 | 6/2013 | Liang | |
| 2013/0179610 | A1* | 7/2013 | Smurthwaite | H01R 13/665 710/63 |
| 2016/0156145 | A1* | 6/2016 | Kao | H01R 24/60 439/676 |
| 2017/0040761 | A1* | 2/2017 | Tsai | H01R 13/642 |
| 2017/0294749 | A1* | 10/2017 | Tsai | H01R 24/60 |

FOREIGN PATENT DOCUMENTS

| | | | |
|---|---|---|---|
| CN | 201956490 | U | 8/2011 |
| CN | 202094344 | U | 12/2011 |
| CN | 202111346 | U | 1/2012 |
| CN | 102340069 | A | 2/2012 |
| CN | 202405449 | U | 8/2012 |
| TW | 201039516 | A | 11/2010 |
| TW | M419244 | | 12/2011 |
| TW | M443311 | | 12/2012 |
| TW | M448831 | | 3/2013 |
| TW | 201401672 | | 1/2014 |

* cited by examiner 12
19
125
126
17
1208
141
1207
12
1
12
1

12
122
125
126
84
175
1205
121
17
129
19
1208
1207
84
141
14
132
131
16
13
1

14
143
143
125
12
192
191
19
126
132
141
129
131
17
13
16
c
d
c

LOW-HEIGHT CONNECTOR COMBINATION OF DUPLEX ELECTRICAL CONNECTION SOCKET AND DUPLEX ELECTRICAL CONNECTION PLUG

CROSS-REFERENCE TO RELATED APPLICATIONS

This application is a Divisional Application of pending U.S. patent application Ser. No. 15/962,810, filed on Apr. 25, 2018, which is also a Divisional Application of U.S. patent application Ser. No. 15/304,774, now issued as U.S. Pat. No. 9,960,551 B2, the content of which is incorporated herein by reference.

BACKGROUND OF THE INVENTION

(1) Field of the Invention

The invention relates to an electrical connector, and more particularly to an electrical connection socket and an electrical connection plug capable of providing bidirectional electrical connections.

(2) Description of the Related Art

Today's most popular signal transmission specification in the computer apparatus is the universal serial bus (USB). A connector socket and a transmission cable manufactured according to this specification enable a peripheral apparatus, such as a mouse, a keyboard or the like, which is externally connected to the computer to be detected and used by the computer immediately.

At present, the USB electrical connection socket and the USB electrical connection plug have the unidirectional electrical connections. In order to ensure that the USB electrical connection plug can be electrically connected to the USB electrical connection socket when being inserted into the USB electrical connection socket, the socket and the plug have the mistake-proof designs. That is, the USB electrical connection plug cannot be reversely inserted, and the user switches to the other direction to insert the plug. The correct direction allows the insertion, so that the electrical connection can be ensured after the insertion.

At present, there are two specifications including USB 2.0 and USB 3.0, as shown in FIG. 1 and FIG. 2, an A-type standard USB 2.0 electrical connection socket 10 specified by USB Association has an insulating base 12 and a metal housing 13, the upper portion of the front end of the insulating base 12 has a horizontally frontwardly projecting tongue 121. The metal housing 13 covers the insulating base 12 and is formed with a connection slot 16 covering the tongue 121. The connection slot 16 is formed with a small space 161 and a large space 162 on top and bottom sides of the tongue 121, respectively. The insulating base 12 is provided with one row of four first terminals 14. The first terminal 14 has a vertically elastically movable contact 141 projecting beyond the bottom side of the tongue 121. In addition, the top and bottom sides of the metal housing 13 projecting toward the connection slot 16 are provided with two resilient fasteners 131.

The connection slot 16 of the A-type standard USB 2.0 electrical connection socket 10 has the height of 5.12 mm, the tongue 121 has the height of 1.84 mm, the large space 162 has the height of 2.56 mm, and the small space 161 has the height of 0.72 mm. That is, (the height of the large space 162)=(the height of the small space 161)+(the height of the tongue 121).

FIG. 3 shows an A-type standard USB 2.0 electrical connection plug 20 and an A-type standard USB 2.0 electrical connection socket 10 specified by USB Association. The A-type standard USB 2.0 electrical connection plug 20 has an insulating base 21, a metal housing 22 and one row of four terminals 23. The metal housing 22 covers the insulating base 21. The connection portion of the A-type standard electrical connection plug has a fitting slot 24 fitting with the tongue 121, and a contact interface substrate 25 fitting with the large space 162. The outside layer of the contact interface substrate 25 is the metal housing, and the inside layer of the contact interface substrate 25 is the insulating base. The one row of four terminals 23 have contacts 231 in flat surface contact with the inner surface of the contact interface substrate 25 and facing the fitting slot 24.

The connection portion of the A-type standard USB 2.0 electrical connection plug 20, specified by USB Association, has the height of 4.5 mm, the fitting slot 24 has the height of 1.95 mm, the metal housing has the thickness of 0.3 mm, and the contact interface substrate 25 has the height of 2.25 mm.

As shown in FIG. 3, the contact interface substrate 25 of the A-type standard USB 2.0 electrical connection plug 20 needs to be aligned with the large space 162 so that it can be inserted into the connection slot 16 of the A-type standard USB 2.0 electrical connection socket 10. The opposite insertion will fail because the contact interface substrate 25 having the height of 2.25 mm cannot be fit into the small space 161 having the height of 0.72 mm. So, the inconvenient use is caused.

However, in order to facilitate the convenient use, the bidirectional electrical connection can satisfy the requirement. So, the applicant previously developed an electrical connection socket, which has the duplex electrical connection function, and into which the A-type standard USB 2.0 electrical connection plug can be bidirectionally inserted for electrical connection, and then planed to develop a duplex electrical connection plug, which has the design adopting two contact interface substrates 25, each having the height of 2.25 mm shown in FIG. 3, in conjunction with the fitting slot 24 having the height of 1.95 m. However, this type of duplex electrical connection plug only can be electrically connected to the electrical connection socket having the duplex electrical connection function to achieve the doubled transmission speed. In addition, the two contact interface substrates of this type of duplex electrical connection plug cannot be fit for connection with the small space of the A-type standard USB 2.0 electrical connection socket. The above-mentioned duplex electrical connection socket, developed by the applicant, needs to be bidirectional inserted by the A-type standard USB 2.0 electrical connection plug for electrical connection. So, the overall height is higher than the A-type standard USB 2.0 electrical connection socket and is not advantageous to the slim and light electronic product. In addition, the further developed duplex electrical connection plug cannot work in conjunction with and cannot be bidirectionally inserted and connected to the A-type standard USB 2.0 electrical connection socket, is significantly larger than the A-type standard USB 2.0 electrical connection plug, and cannot satisfy the actual requirement.

The applicant has continuously paid efforts to the research and development, and thus finally developed the invention, which is slim and light and can satisfy the bidirectional electrical connection to the standard electrical connection socket specified by USB Association.

BRIEF SUMMARY OF THE INVENTION

A main object of the invention is to provide a low-height connector combination of a duplex electrical connection socket and a duplex electrical connection plug, both of which can be bidirectionally docked with each other to achieve the convenient use and have two contact interfaces electrically connected together to achieve the doubled transmission effect.

Another main object of the invention is to provide a low-height connector combination of a duplex electrical connection socket and a duplex electrical connection plug, both of which have low-height designs and are tightly fit with each other to achieve the slim and light advantages.

Still another main object of the invention is to provide a low-height connector combination of a duplex electrical connection socket and a duplex electrical connection plug. Each of the two rows of contacts of the duplex electrical connection socket are provided with two pairs of signal contacts RX+, RX− and TX+, TX−, and the four pairs of signal contacts are individually electrically connected to individually signal transmission circuits; and each of the two rows of contacts of the duplex electrical connection plug are provided with two pairs of signal contacts RX+, RX− and TX+, TX−, and the four pairs of signal contacts are individually electrically connected to individually signal transmission circuits.

Yet still another main object of the invention is to provide a low-height connector combination of a duplex electrical connection socket and a duplex electrical connection plug. Two connection surfaces of the duplex electrical connection socket perpendicularly corresponding to top and bottom surfaces of the metal housing are hole-free structures, and the top and bottom surfaces of the metal housing perpendicularly corresponding to the two contact interface substrates of the duplex electrical connection plug are hole-free structures to achieve the better electrical effect.

Yet still another main object of the invention is to provide a low-height connector combination of a duplex electrical connection socket and a duplex electrical connection plug. Each of left and right sides of the connection slot of the duplex electrical connection socket is provided with a metallic engaging structure, each of left and right sides of the fitting space of the duplex electrical connection plug is provided with a metallic engaging structure, and the engaging structure of the duplex electrical connection plug engages with the engaging structure of the duplex electrical connection socket to prevent the duplex electrical connection plug and the duplex electrical connection socket from separating from each other in a direction opposite to a docking direction.

Yet still another main object of the invention is to provide a low-height connector combination of a duplex electrical connection socket and a duplex electrical connection plug, wherein the circuit board of the duplex electrical connection socket and/or the circuit board of the duplex electrical connection plug is provided with a circuit safety protection device, the circuit safety protection device is provided with at least one of a signal circuit processing control element, an anti-backflow or anti-short-circuit or circuit safety protection element and a safety circuit configuration means, the circuit safety protection device is electrically connected to the two contact interfaces, and the circuit safety protection device ensures appropriate circuit safety protection when the duplex electrical connection socket and the duplex electrical connection plug are bidirectionally electrically connected together.

Yet still another main object of the invention is to provide a low-height connector combination of a duplex electrical connection socket and a duplex electrical connection plug. Each of the two contact interfaces of the duplex electrical connection socket includes one pair of D+, D− signal contacts, the two D+ signal contacts of the two contact interfaces are electrically connected together and the two D− signal contacts electrically connected together to achieve the convenient in use.

Yet still another main object of the invention is to provide a bidirectional electrical connection plug having an insulation base provided with an upper base and a lower base stacked vertically, wherein the upper and lower bases can be respectively embedded and injection molded with two rows of terminals, a middle between the upper and lower bases is provided with a transversally extending metal partition plate and the metal partition plate separates the two rows of terminals from each other to achieve the convenience in manufacturing.

Yet still another main object of the invention is to provide a bidirectional electrical connection socket having an insulation base provided with an upper base and a lower base stacked vertically, wherein the upper and lower bases can be respectively embedded and injection molded with two rows of terminals to achieve the convenience in manufacturing.

A secondary object of the invention is to provide a low-height connector combination of a duplex electrical connection socket and a duplex electrical connection plug, wherein the circuit board of the duplex electrical connection socket and/or the circuit board of the duplex electrical connection plug is provided with a connection point switching device, the connection point switching device is electrically connected to the two contact interfaces, and the connection point switching device can switch corresponding circuit connection point transmission when the two contact interfaces are bidirectionally electrically connected together.

To achieve the above-identified object, the invention provides a low-height connector combination, including: a duplex electrical connection socket, which is electrically connected to a circuit board and includes: an insulation base having one end projectingly provided with a tongue, wherein the tongue is provided with upper and lower connection surfaces, each of the two connection surfaces is provided with a contact interface, each of the two contact interfaces is provided with multiple contacts arranged in a front-low and rear-high manner, the multiple contacts includes elastically non-movable one row of contacts in flat surface contact with the tongue, the two rows of contacts are formed on two rows of terminals, the terminal is provided with a pin, a fixing portion and an extension, the fixing portion is fixed to the insulation base, the extension is connected to one end of the fixing portion, extends to the tongue and is provided with the contact, the pin is connected to the other end of the fixing portion and electrically connected to the circuit board, at least one pair of the contacts of the two contact interfaces with the same circuit are arranged reversely, and at least one pair of the contacts of the two contact interfaces with the same circuit are electrically connected together; and a metal housing, which covers the tongue and is formed with a connection slot, wherein the tongue is disposed at a middle height of the connection slot, the two connection surfaces of the tongue form symmetrical two spaces, and heights of the two spaces of the two connection surfaces are smaller than a large space of a connection slot of a standard electrical connection socket having a minimum height specification specified by USB Association and greater than a small space of the connection slot of the standard electrical connection socket; and a duplex electrical connection plug including: a circuit board; an insulation base; a metal housing covering the insulation base; and a fitting portion provided on one end of the insulation base, wherein the fitting portion is provided with two contact interface substrates, which have the same height and face each other, and a fitting space, each of the two contact interface substrates is provided with an insulating layer, an interval between the two contact interface substrates is the fitting space, the two contact interface substrates have two inside layers being the insulating layers and two outside layers pertaining to the metal housing, each of the two contact interface substrates is provided with a contact interface, each of the two contact interfaces is provided with two rows of contacts arranged in a front-low and rear-high manner, the two rows of contacts project beyond the contact interface substrate and are vertically elastically movable, the two rear rows of contacts are formed on two rows of terminals, the terminal is provided with a pin, a fixing portion and an extension, the fixing portion is fixed to the insulation base, the extension is connected to one end of the fixing portion, extend to the contact interface substrate and is provided with the contact, the pin is connected to the other end of the fixing portion and electrically connected to the circuit board, at least one pair of the contacts of the two contact interfaces with the same circuit are arranged reversely, and at least one pair of the contacts of the two contact interfaces with the same circuit are electrically connected together; wherein the insulation base is provided with vertically stacked upper and lower bases, the upper and lower bases are respectively embedded with, injection molded with and fixed to the two rows of terminals, a middle between the upper and lower bases is provided with a transversally extending metal partition plate, the metal partition plate separates the two rows of terminals from each other, the two contact interface substrates have the same height, which is smaller than a contact interface substrate of a standard electrical connection plug having a minimum height specification specified by USB Association and greater than the small space; wherein the fitting portion can be bidirectionally inserted into the connection slot of the duplex electrical connection socket, the heights of the two contact interface substrates of the duplex electrical connection plug can be fit with the two spaces of the two connection surfaces of the tongue, each of two fitting gaps between the two contact interface substrates and the two connection surfaces of the tongue is smaller than 0.15 mm to form tight fitting, the fitting space is fit with the tongue, and the two contact interfaces of the duplex electrical connection plug are respectively electrically connected to the two contact interfaces of the duplex electrical connection socket.

The invention further provides a low-height connector combination, including: a duplex electrical connection socket, which is electrically connected to a circuit board and includes: an insulation base having one end projectingly provided with a tongue, wherein the tongue is provided with upper and lower connection surfaces, each of the two connection surfaces is provided with a contact interface, each of the two contact interfaces includes elastically non-movable one row of contacts in flat surface contact with the tongue, the two rows of contacts are formed on two rows of terminals, the terminal is provided with a pin, a fixing portion and an extension, the fixing portion is fixed to the insulation base, the extension is connected to one end of the fixing portion, extends to the tongue and is provided with the contact, the pin is connected to the other end of the fixing portion and electrically connected to the circuit board, at least one pair of the contacts of the two contact interfaces with the same circuit are arranged reversely, each of the two rows of contacts are provided with two pairs of signal contacts RX+, RX− and TX+, TX−, and the four pairs of signal contacts are individually electrically connected to individually signal transmission circuits; and a metal housing, which covers the tongue and is formed with a connection slot, wherein the tongue is disposed at a middle height of the connection slot, the two connection surfaces of the tongue form symmetrical two spaces, and heights of the two spaces of the two connection surfaces are smaller than a large space of a connection slot of a standard electrical connection socket having a minimum height specification specified by USB Association and greater than a small space of the connection slot of the standard electrical connection socket; and a duplex electrical connection plug including: a circuit board; an insulation base; a metal housing covering the insulation base; and a fitting portion provided on one end of the insulation base, wherein the fitting portion is provided with two contact interface substrates, which have the same height and face each other, and a fitting space, each of the two contact interface substrates is provided with an insulating layer, an interval between the two contact interface substrates is the fitting space, the two contact interface substrates have two inside layers being the insulating layers and two outside layers pertaining to the metal housing, each of the two contact interface substrates is provided with a contact interface, each of the two contact interfaces includes one row of elastically movable contacts, the two rows of elastically movable contacts are formed on two rows of terminals, the terminal is provided with a pin, a fixing portion and an extension, the fixing portion is fixed to the insulation base, the extension is connected to one end of the fixing portion, extend to the contact interface substrate and is provided with the contact, the pin is connected to the other end of the fixing portion and electrically connected to the circuit board, at least one pair of the contacts of the two contact interfaces with the same circuit are arranged reversely, each of the two rows of contacts are provided with two pairs of signal contacts RX+, RX− and TX+, TX−, and the four pairs of signal contacts are individually electrically connected to individually signal transmission circuits; wherein the insulation base is provided with vertically stacked upper and lower bases, the upper and lower bases are respectively embedded with, injection molded with and fixed to the two rows of terminals, a middle between the upper and lower bases is provided with a transversally extending metal partition plate, the metal partition plate separates the two rows of terminals from each other, and the two contact interface substrates have the same height, which is smaller than a contact interface substrate of a standard electrical connection plug having a minimum height specification specified by USB Association and greater than the small space; wherein the fitting portion can be bidirectionally inserted into the connection slot of the duplex electrical connection socket, the heights of the two contact interface substrates of the duplex electrical connection plug can be fit with the two spaces of the two connection surfaces of the tongue, each of two fitting gaps between the two contact interface substrates and the two connection surfaces of the tongue is smaller than 0.15 mm to form tight fitting, the fitting space is fit with the tongue, and the two contact interfaces of the duplex electrical connection plug are respectively electrically connected to the two contact interfaces of the duplex electrical connection socket.

The invention further provides a low-height connector combination, including: a duplex electrical connection socket, which is electrically connected to a circuit board and includes: an insulation base having one end projectingly provided with a tongue, wherein the tongue is provided with upper and lower connection surfaces, each of the two connection surfaces is provided with a contact interface, each of the two contact interfaces includes one row of contacts, the two rows of contacts are formed on two rows of terminals, the terminal is provided with a pin, a fixing portion and an extension, the fixing portion is fixed to the insulation base, the extension is connected to one end of the fixing portion, extends to the tongue and is provided with the contact, the pin is connected to the other end of the fixing portion and electrically connected to the circuit board, at least one pair of the contacts of the two contact interfaces with the same circuit are arranged reversely, and at least one pair of the contacts of the two contact interfaces with the same circuit are electrically connected together; and a metal housing, which covers the tongue and is formed with a connection slot, wherein the two connection surfaces perpendicularly corresponding to top and bottom surfaces of the metal shell are hole-free structures, each of left and right sides of the connection slot is provided with a metallic engaging structure, the tongue is disposed at a middle height of the connection slot, the two connection surfaces of the tongue form symmetrical two spaces, and heights of the two spaces of the two connection surfaces are smaller than a large space of a connection slot of a standard electrical connection socket having a minimum height specification specified by USB Association and greater than a small space of the connection slot of the standard electrical connection socket; and a duplex electrical connection plug including: a circuit board; an insulation base; a metal housing covering the insulation base; and a fitting portion provided on one end of the insulation base, wherein the fitting portion is provided with two contact interface substrates, which have the same height and face each other, and a fitting space, each of the two contact interface substrates is provided with an insulating layer, an interval between the two contact interface substrates is the fitting space, the two contact interface substrates have two inside layers being the insulating layers and two outside layers pertaining to the metal housing, each of the two contact interface substrates is provided with a contact interface, each of the two contact interfaces includes one row of contacts, the two rows of contacts are formed on two rows of terminals, the terminal is provided with a pin, a fixing portion and an extension, the fixing portion is fixed to the insulation base, the extension is connected to one end of the fixing portion, extend to the contact interface substrate and is provided with the contact, the pin is connected to the other end of the fixing portion and electrically connected to the circuit board, at least one pair of the contacts of the two contact interfaces with the same circuit are arranged reversely, and at least one pair of the contacts of the two contact interfaces with the same circuit are electrically connected together; wherein the two contact interface substrates perpendicularly corresponding to top and bottom surfaces of the metal shell are hole-free structures, each of left and right sides of the fitting space is provided with a metallic engaging structure, and the two contact interface substrates have the same height, which is smaller than a contact interface substrate of a standard electrical connection plug having a minimum height specification specified by USB Association and greater than the small space; wherein the fitting portion can be bidirectionally inserted into the connection slot of the duplex electrical connection socket, the heights of the two contact interface substrates of the duplex electrical connection plug can be fit with the two spaces of the two connection surfaces of the tongue, each of two fitting gaps between the two contact interface substrates and the two connection surfaces of the tongue is smaller than 0.15 mm to form tight fitting, the fitting space is fit with the tongue, the two contact interfaces of the duplex electrical connection plug are respectively electrically connected to the two contact interfaces of the duplex electrical connection socket, and the engaging structure of the duplex electrical connection plug engages with the engaging structure of the duplex electrical connection socket to prevent the duplex electrical connection plug and the duplex electrical connection socket from separating from each other in a direction opposite to a docking direction.

The invention further provides a low-height connector combination, including: a duplex electrical connection socket, which is electrically connected to a circuit board and includes: an insulation base having one end projectingly provided with a tongue, wherein the tongue is provided with upper and lower connection surfaces, each of the two connection surfaces is provided with a contact interface, each of the two contact interfaces includes one row of at least seven contacts and is provided with only one pair of D+, D− signal contacts, the two rows of contacts are formed on two rows of terminals, the terminal is provided with a pin, a fixing portion and an extension, the fixing portion is fixed to the insulation base, the extension is connected to one end of the fixing portion, extends to the tongue and is provided with the contact, the pin is connected to the other end of the fixing portion and electrically connected to the circuit board, at least one pair of the contacts of the two contact interfaces with the same circuit are arranged reversely, wherein the two D+ signal contacts are electrically connected together, the two D− signal contacts are electrically connected together, and the circuit board is provided with a circuit safety protection device, wherein the circuit safety protection device is provided with at least one of a signal circuit processing control element, an anti-backflow or anti-short-circuit or circuit safety protection element and a safety circuit configuration means, the circuit safety protection device is electrically connected to the two contact interfaces, and the circuit safety protection device ensures appropriate circuit safety protection when the duplex electrical connection socket and the duplex electrical connection plug are bidirectionally electrically connected together; and a metal housing, which covers the tongue and is formed with a connection slot, wherein the tongue is disposed at a middle height of the connection slot, the two connection surfaces of the tongue form symmetrical two spaces, and heights of the two spaces of the two connection surfaces are smaller than a large space of a connection slot of a standard electrical connection socket having a minimum height specification specified by USB Association and greater than a small space of the connection slot of the standard electrical connection socket; and a duplex electrical connection plug including: a circuit board; an insulation base; a metal housing covering the insulation base; and a fitting portion provided on one end of the insulation base, wherein the fitting portion is provided with two contact interface substrates, which have the same height and face each other, and a fitting space, each of the two contact interface substrates is provided with an insulating layer, an interval between the two contact interface substrates is the fitting space, the two contact interface substrates have two inside layers being the insulating layers and two outside layers pertaining to the metal housing, each of the two contact interface substrates is provided with a contact interface, each of the two contact interfaces includes one row of at least five contacts, the two rows of contacts respectively project beyond the two contact interface substrates, the two rows of contacts are formed on two rows of terminals, the terminal is provided with a pin, a fixing portion and an extension, the fixing portion is fixed to the insulation base, the extension is connected to one end of the fixing portion, extend to the contact interface substrate and is provided with the contact, the pin is connected to the other end of the fixing portion and electrically connected to the circuit board, at least one pair of the contacts of the two contact interfaces with the same circuit are arranged reversely, and at least one pair of the contacts of the two contact interfaces with the same circuit are electrically connected together; and the two contact interface substrates have the same height, which is smaller than a contact interface substrate of a standard electrical connection plug having a minimum height specification specified by USB Association and greater than the small space; wherein the fitting portion can be bidirectionally inserted into the connection slot of the duplex electrical connection socket, the heights of the two contact interface substrates of the duplex electrical connection plug can be fit with the two spaces of the two connection surfaces of the tongue, each of two fitting gaps between the two contact interface substrates and the two connection surfaces of the tongue is smaller than 0.15 mm to form tight fitting, the fitting space is fit with the tongue, and the two contact interfaces of the duplex electrical connection plug are respectively electrically connected to the two contact interfaces of the duplex electrical connection socket.

In the A low-height connector combination, the circuit board of the duplex electrical connection socket and/or the circuit board of the duplex electrical connection plug is provided with a connection point switching device, the connection point switching device is electrically connected to the two contact interfaces, and the connection point switching device can switch corresponding circuit connection point transmission when the two contact interfaces are bidirectionally electrically connected together.

With the above-mentioned structure, the invention has the following advantages.

1. In the low-height connector combination of the duplex electrical connection socket and the duplex electrical connection plug, both of duplex electrical connection socket and the duplex electrical connection plug can be bidirectionally docked with each other to achieve the convenient use and have two contact interfaces electrically connected together to achieve the doubled transmission effect.

2. In the low-height connector combination of the duplex electrical connection socket and the duplex electrical connection plug, both of duplex electrical connection socket and the duplex electrical connection plug have low-height designs and are tightly fit with each other to achieve the slim and light advantages.

3. Each of the two rows of contacts of the duplex electrical connection socket are provided with two pairs of signal contacts RX+, RX− and TX+, TX−, and the four pairs of signal contacts are individually electrically connected to individually signal transmission circuits; and each of the two rows of contacts of the duplex electrical connection plug are provided with two pairs of signal contacts RX+, RX− and TX+, TX−, and the four pairs of signal contacts are individually electrically connected to individually signal transmission circuits.

4. Two connection surfaces of the duplex electrical connection socket perpendicularly corresponding to top and bottom surfaces of the metal housing are hole-free structures, and the top and bottom surfaces of the metal housing perpendicularly corresponding to the two contact interface substrates of the duplex electrical connection plug are hole-free structures to achieve the better electrical effect.

5. Each of left and right sides of the connection slot of the duplex electrical connection socket is provided with a metallic engaging structure, each of left and right sides of the fitting space of the duplex electrical connection plug is provided with a metallic engaging structure, and the engaging structure of the duplex electrical connection plug engages with the engaging structure of the duplex electrical connection socket to prevent the duplex electrical connection plug and the duplex electrical connection socket from separating from each other in a direction opposite to a docking direction.

6. The circuit board of the duplex electrical connection socket and/or the circuit board of the duplex electrical connection plug is provided with a circuit safety protection device, the circuit safety protection device is provided with at least one of a signal circuit processing control element, an anti-backflow or anti-short-circuit or circuit safety protection element and a safety circuit configuration means, the circuit safety protection device is electrically connected to the two contact interfaces, and the circuit safety protection device ensures appropriate circuit safety protection when the duplex electrical connection socket and the duplex electrical connection plug are bidirectionally electrically connected together.

7. Each of the two contact interfaces of the duplex electrical connection socket includes one pair of D+, D− signal contacts, the two D+ signal contacts of the two contact interfaces are electrically connected together and the two D− signal contacts electrically connected together to achieve the convenient in use.

8. In the electrical connection socket of the invention, the insulation base thereof is provided with an upper base and a lower base stacked vertically, the upper and lower bases can be respectively embedded and injection molded with two rows of terminals to achieve the convenience in manufacturing.

9. In the bidirectional electrical connection plug of the invention, the insulation base thereof is provided with an upper base and a lower base stacked vertically, wherein the upper and lower bases can be respectively embedded and injection molded with two rows of terminals, a middle between the upper and lower bases is provided with a transversally extending metal partition plate, and the metal partition plate separates the two rows of terminals from each other to achieve the convenience in manufacturing.

10. The circuit board of the duplex electrical connection socket and/or the circuit board of the duplex electrical connection plug is provided with a connection point switching device, the connection point switching device is electrically connected to the two contact interfaces, and the connection point switching device can switch corresponding circuit connection point transmission when the two contact interfaces are bidirectionally electrically connected together.

The above-mentioned and other objects, advantages and features of the invention will become more fully understood from the detailed description of the preferred embodiments given hereinbelow and the accompanying drawings.

DETAILED DESCRIPTION OF THE INVENTION

In order to facilitate the examination, the embodiments corresponding to the amended independent claims are described in the following. Claims 1 to 29 may be implemented in FIGS. 14, 17 to 33, and 61 to 76, and the last second paragraph describes that a socket is connected to a circuit board.

Referring to FIGS. 4 to 16, the first embodiment of the invention provides a bidirectional USB 2.0 electrical connection plug and a bidirectional USB 2.0 electrical connection socket.

Figure 4:
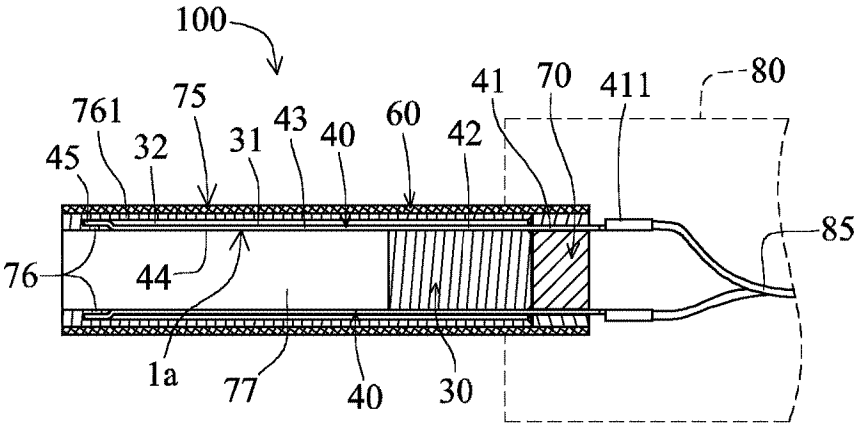
FIG. 4 is a side cross-sectional view showing a duplex plug according to a first embodiment of the invention.
Figure 6:
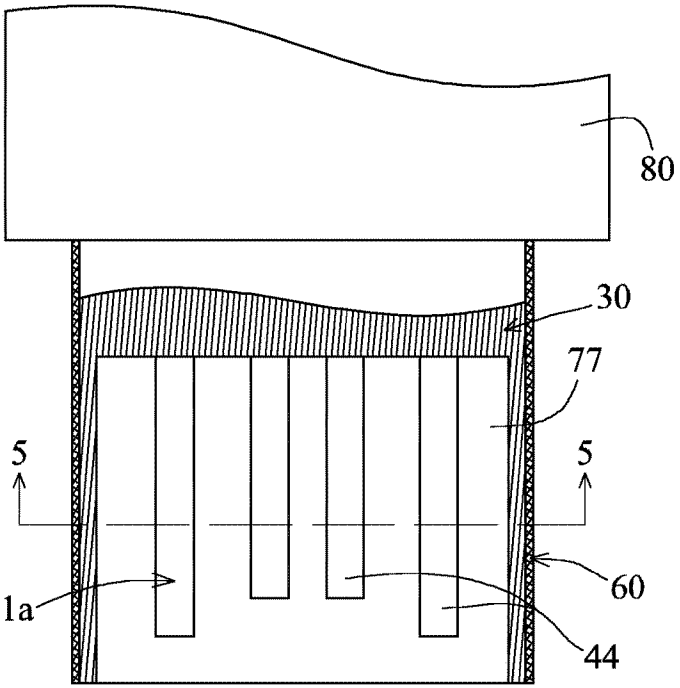
FIG. 6 is a top cross-sectional view showing the duplex plug according to the first embodiment of the invention.
Figure 5:
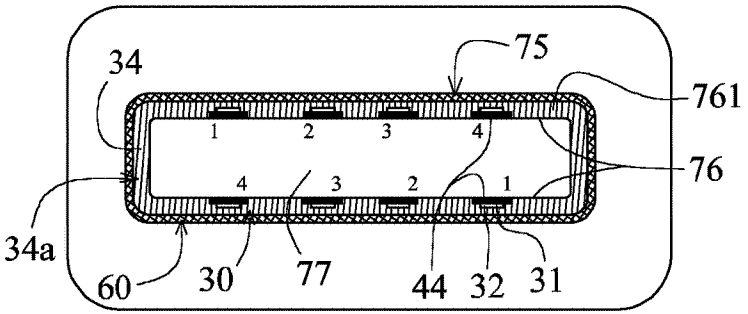
FIG. 5 is a front cross-sectional view showing the duplex plug according to the first embodiment of the invention.

Referring to FIGS. 4 to 6, a bidirectional duplex USB 2.0 electrical connection plug 100 of this embodiment comprises an insulating base 30, two rows of first terminals 40, a metal housing 60, a fitting portion 75, a positioning structure 34*a* and a rear plug 70.

The insulating base 30 is plastically injection molded and has a front segment formed with a fitting space 77. The insulating base 30 forms top, bottom, left and right sides of the fitting space 77. The cross-section of the front segment of the insulating base 30 is a hollow rectangular frame structure. The insertion port of the fitting space 77 faces frontwards. The insulating base 30 has two rows of first terminal slots 31, wherein a middle of the first terminal slot 31 has a concave portion 32.

Figure 2:
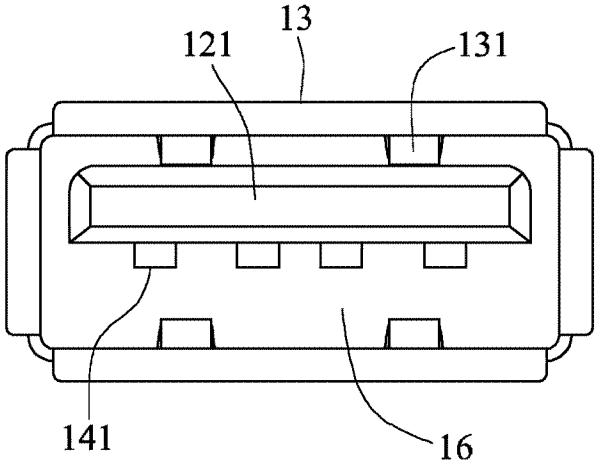
FIG. 2 (Prior art)
FIG. 2 is a front view showing the conventional standard USB 2.0 electrical connection socket specified by USB Association.
Figure 1:
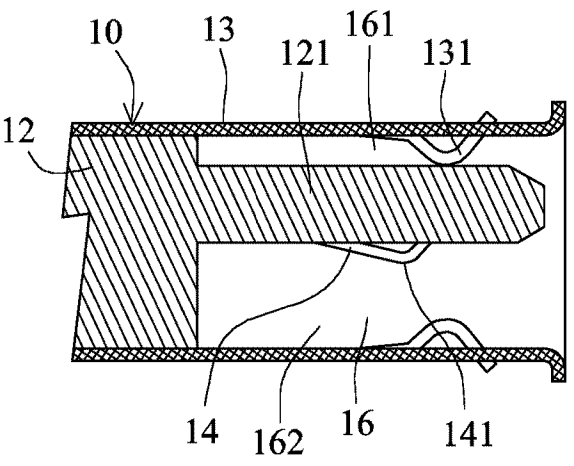
FIG. 1 (Prior art)
FIG. 1 is a side cross-sectional view showing a conventional standard USB 2.0 electrical connection socket specified by USB Association.
Figure 3:
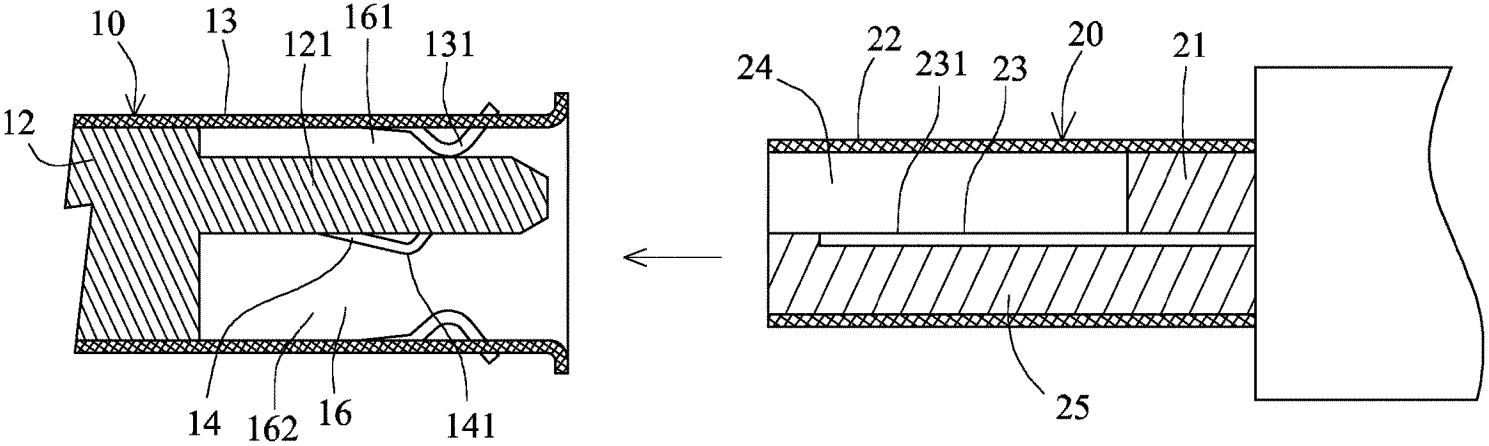
FIG. 3 (Prior art)
FIG. 3 is a side cross-sectional view showing a conventional standard USB 2.0 electrical connection socket and a conventional standard USB 2.0 electrical connection plug specified by USB Association.
Figure 7:
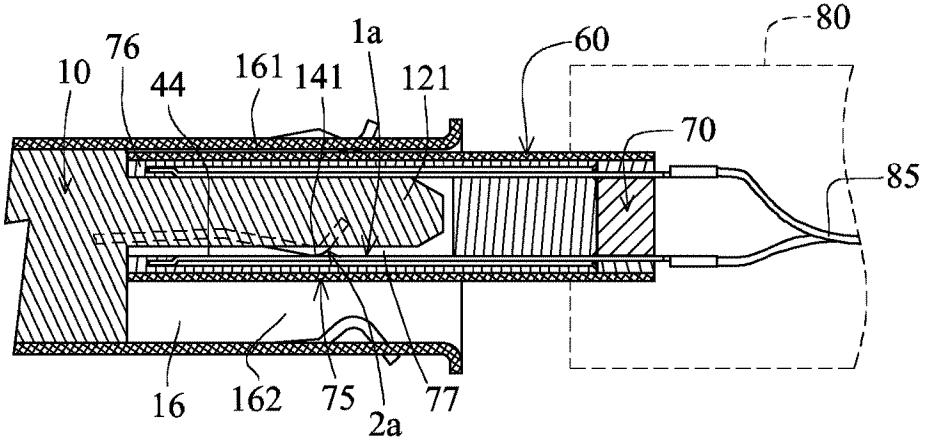
FIG. 7 is a side cross-sectional view showing a used state of the duplex plug according to the first embodiment of the invention.

The metal housing 60 covers the insulating base 30. The front-view shape of the metal housing 60 is rectangular, top-bottom symmetrical and left-right symmetrical. As shown in FIG. 7, the metal housing 60 has an open back end and has no projecting upright plate sheet.

The fitting portion 75 is disposed at the front end of the insulating base 30. The fitting portion 75 has two opposite contact interface substrates 76 and a fitting space 77. The two contact interface substrates 76 each having an insulating layer 761 are separated by the fitting space 77. The insulating layers 761 of the inside layers of the two contact interface substrates 76 are integrally formed jointly with the insulating base 30, and the outside layers of the contact interface substrates 76 pertain to the metal housing 60. The fitting space 77 is the same as the fitting space 77 of the insulating base 30. The insulating layers 761 of the inside layers of the two contact interface substrates 76 are the top and bottom sides of the fitting space 77. Each of the two contact interface substrates 76 has a USB 2.0 contact interface 1*a* to be electrically connected to an A-type standard USB 2.0 electrical connection socket. The two USB 2.0 contact interfaces 1*a* are formed by the two rows of first terminals 40. The two USB 2.0 contact interfaces 1*a* are electrically connected to the rear end of the insulating base 30, and the two USB 2.0 contact interfaces 1*a* have the same contact interface and the connection points with the circuit serial numbers arranged reversely. The fitting portion 75 has the rectangular external shape in a top-bottom symmetrical and left-right symmetrical manner. The fitting portion 75 can be bidirectionally inserted into the connection slot of the A-type standard USB 2.0 electrical connection socket. The two contact interface substrates 76 can be fit into the small space.

The positioning structure 34*a* is integrally formed jointly with front segments of two sidewalls 34 of the insulating base 30. The two sidewalls 34 are integrally connected to two sides of the insulating layers of the two contact interface substrates 76 to position the insulating layers 761 of the two contact interface substrates 76. The insulating layers 761 of the two contact interface substrates 76 are the top and bottom sides of the fitting space 77. The two sidewalls 34 are the left and right sides of the fitting space 77.

The two rows of first terminals 40 each having four first terminals are assembled and fixed to the two rows of first terminal slots 31 of the insulating base 30, the first terminal 40 sequentially has, from one end to the other end, a pin 41, a fixing portion 42 and an extension 43. The fixing portion 42 is fixed to the first terminal slot 31. The extension 43 is connected to the front end of the fixing portion 42, extends to the contact interface substrate 76 and has a contact 44. The contact 44 is not elastically movable and is flush with the inner surface of the contact interface substrate 76. The front end of the extension 43 has an engagement portion 45 engaged into the engagement hole formed at the front end of the concave portion 32. The pin 41, which is connected to the other end of the fixing portion 42 and projects beyond the rear end of the insulating base 30, has a distal segment formed with a wiring portion 411. The contacts 44 of the two rows of first terminals 40 respectively form the USB 2.0 contact interfaces 1*a* of the two contact interface substrates 76. The two USB 2.0 contact interfaces 1*a* are the same contact interface and have the connection points with the circuit serial numbers arranged reversely, as shown in FIG. 5. The upper USB 2.0 contact interface 1*a* has the connection points with the circuit serial numbers of 1, 2, 3, 4 from left to right, and the lower USB 2.0 contact interface 1*a* has the connection points with the circuit serial numbers of 4, 3, 2, 1 from left to right. According to the USB 2.0 contact interface specified by USB Association, the connection point with the circuit serial number 1 is the ground contact, the connection point with the circuit serial number 4 is the power contact, and the connection points with the circuit serial numbers 3 and 2 are one pair of signal contacts represented by D+ and D−, respectively.

The rear plug 70 is tightly fit within the rear segment of the metal housing and at the rear end of the insulating base. The rear plug 70 is a three-piece combination so that the pins 41 of the two rows of first terminals 40 can pass through and closely fit with the rear plug 70. The rear plug 70 mainly plugs the voids communicating the two rows of first terminal slots 31 with the rear end of the insulating base 30.

This embodiment functions as a connector of a connection cable. An insulating housing 80 covering the rear segment of the metal housing 60 is formed by way of glue pouring. The provision of the rear plug 70 can prevent the glue liquid from flowing into the first terminal slot 31 in the glue pouring process. Regarding the wiring portions 411 of the pins of the two rows of first terminals 40, the connection points with the same circuit serial number is connected to the same wire 85.

Referring to FIG. 7, with the above-mentioned structure, the heights of the two contact interface substrates 76 of the fitting portion 75 can be fit into the small space 161 of the connection slot 16 of the A-type standard USB 2.0 electrical connection socket 10. So, the fitting portion 75 can be bidirectionally inserted into the connection slot 16 of the A-type standard USB 2.0 electrical connection socket 10, and the USB 2.0 contact interface 1*a* (contacts 44) of one of the two contact interface substrates 76 is electrically connected to the USB 2.0 contact interface 2*a* (contacts 141) below the tongue 121 of the A-type standard USB 2.0 electrical connection socket 10.

The two contact interface substrates 76 of the fitting portion 75 of this embodiment have the same height of about 0.65 mm, and the fitting space 77 is about 1.95 mm, so the height of the fitting portion 75 is about 3.25 mm, which is significantly lower than the height (4.5 mm) of the connection portion of the A-type standard USB 2.0 electrical connection plug 20, and higher than the large space 162 (2.65 mm) of the connection slot 16 of the A-type standard USB 2.0 electrical connection socket 10. Thus, the fitting portion 75 cannot be incorrectly inserted into the large space 162 when being used. Upon designing, however, the height of the contact interface substrate 76 may range between 0.5 mm and 0.85 mm, and the height of the fitting portion 75 may range between 3 mm and 4 mm.

According to the above-mentioned descriptions, the plug of this embodiment has the following advantages.

1. The fitting portion 75 can be bidirectionally inserted into the connection slot 16 of the A-type standard USB 2.0 electrical connection socket 10 for electrical connection, and can be used in a very convenient manner.

2. The height of the fitting portion 75 is about 3.25 mm significantly lower than the height (4.5 mm) of the connection portion of the A-type standard USB 2.0 electrical connection plug 20, and has the slim and light advantages.

3. The structure is simplified and can be easily manufactured.

Figure 9:
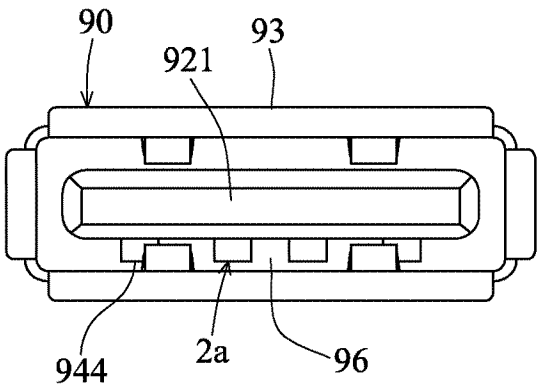
FIG. 9 shows a front view according to a first embodiment of the invention.
Figure 8:
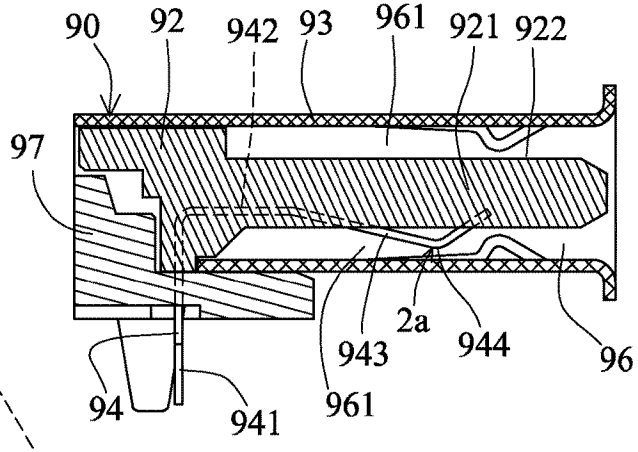
FIG. 8 is a side cross-sectional view showing a simplex socket according to the first embodiment of the invention.

Referring to FIGS. 8 and 9, a bidirectional simplex USB 2.0 electrical connection socket 90 of this embodiment comprises an insulating base 92, a metal housing 93, one row of first terminals 94 and a rear cover 97.

The insulating base 92 is plastically injection molded and has a front end with a middle projectingly formed with a horizontally extending tongue 921, wherein the bottom side of the tongue 921 has a USB 2.0 contact interface 2*a*. The USB 2.0 contact interface 2*a* is formed by the one row of first terminals 94. The contact interface is electrically connected to the rear end of the insulating base 30.

The metal housing 93 covers the insulating base 92 and the tongue 921 to form a connection slot 96 at the front end of the insulating base 92. The tongue 921 is disposed at a middle height of the connection slot 96. Two symmetrical spaces 961 are formed on the upper and lower connection surfaces 922 of the tongue 921. The external shape of the connection slot 96 is rectangular, top-bottom symmetrical and left-right symmetrical.

The one row of first terminals 94 are assembled or embedded into the insulating base 92. Each terminal has a pin 941, a fixing portion 942 and an extension 943. The fixing portion 942 is fixed to the insulating base 92. The extension 943 connected to the front end of the fixing portion 942 extends to the tongue 921 and has a contact 944. The contact 944 projecting beyond the bottom side of the tongue 921 is vertically elastically movable or is elastically movable up and down. The pin 941 connected to the rear end of the fixing portion 942 projects beyond the insulating base. The contacts 944 of the one row of first terminals 94 form the USB 2.0 contact interface 2*a*.

The rear cover 97 covers the rear and bottom of the insulating base 92 to position the pins 941 of the one row of first terminals 94.

This embodiment is characterized in that the spaces of the connection slot 96 on the upper and lower connection surfaces of the tongue 921 have the same height of about 0.72 mm, which is smaller than the large space 162 of the A-type standard USB 2.0 electrical connection socket and is substantially equal to the small space. The height of the tongue 921 is still 1.84 mm. The height of the connection slot 96 is about 3.3 mm, which is significantly lower than the A-type standard USB 2.0 electrical connection socket 10. A fitting portion of an electrical connection plug can be bidirectionally inserted into the connection slot 96.

Figure 10:
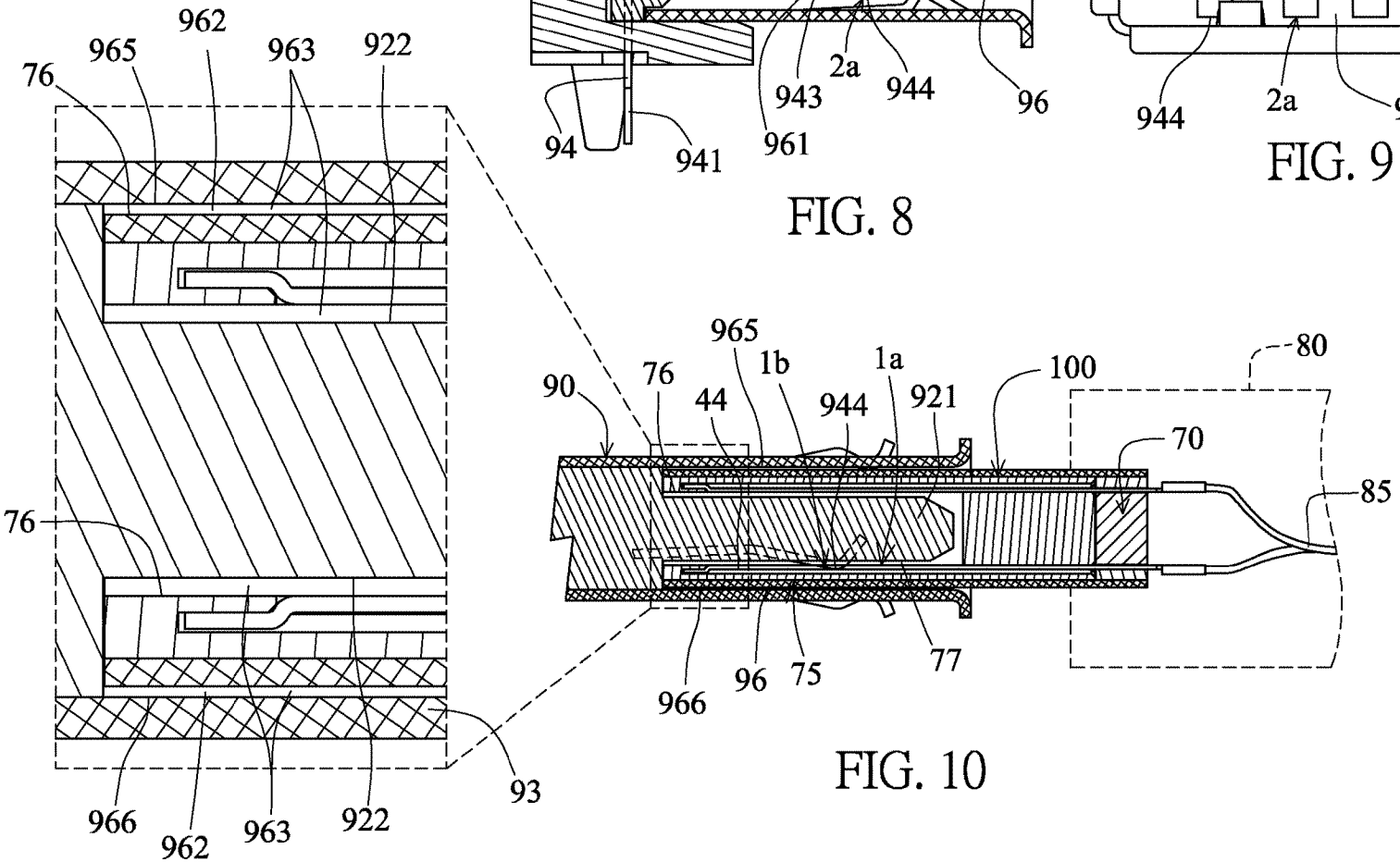
FIG. 10 is a side cross-sectional view showing a combination of the simplex socket and the duplex plug according to the first embodiment of the invention.

Referring to FIG. 10, with the above-mentioned structure, the heights of the two contact interface substrates 76 of the fitting portion 75 of the bidirectional duplex USB 2.0 electrical connection plug 100 can be fit into the two spaces 961 on the upper and lower connection surfaces 922 of the tongue 921 of the connection slot 96. So, the fitting portion 75 can be bidirectionally inserted into the connection slot 96 of the bidirectional simplex USB 2.0 electrical connection socket 90, and the USB 2.0 contact interface 1*a* (contacts 44) of one of the two contact interface substrates 76 is electrically connected to the USB 2.0 contact interface 2*a* (contacts 944) of the bottom side of the tongue 921 of the bidirectional simplex USB 2.0 electrical connection socket 90. In addition, both of the fitting portion 75 of the bidirectional duplex USB 2.0 electrical connection plug and the connection slot 96 of the bidirectional simplex USB 2.0 electrical connection socket 90 can achieve the better fitting. That is, the two contact interface substrates 76 and the two spaces 961 on the upper and lower connection surfaces 922 of the tongue 921 of the connection slot 96 are tightly fit, each of two first fitting gaps 962 respectively between the two contact interface substrates 76 and an upper surface 965 and a lower surface 966 of the connection slot 96 is smaller than 0.15 mm, and each of the fitting gaps 963 left after the two spaces 961 are respectively fit with the contact interface substrates 76 is smaller than 0.15 mm. So, this is different from FIG. 7, in which a too large space is still left when the contact interface substrate 76 is in the large space 162.

Regarding the design of this embodiment, the spaces of the connection slot 96 on the upper and lower connection surfaces of the tongue 921 may have the same height or different heights, wherein the height may range between 0.55 mm and 2.1 mm. The height of the connection slot 96 may be designed to range between 3 mm and 6 mm. Thus, the height of the contact interface substrate matching with the inserted bidirectional USB 2.0 electrical connection plug ranges between 0.5 mm and 2.0 mm, and the height of the fitting portion ranges between 3 mm and 6 mm.

Figure 11:
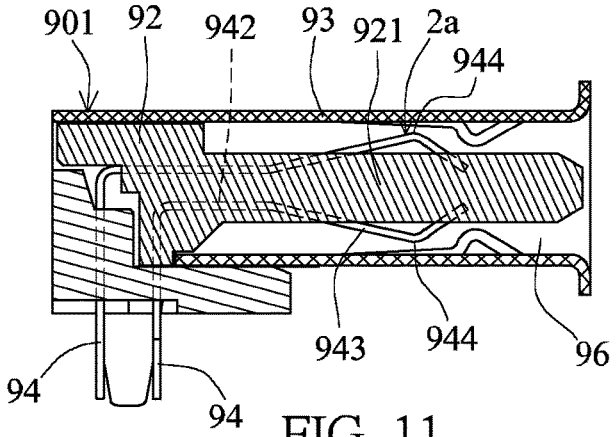
FIG. 11 is a side cross-sectional view showing a duplex socket according to the first embodiment of the invention.
Figure 12:
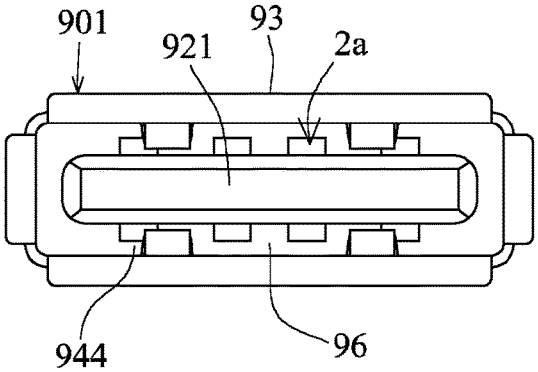
FIG. 12 is a front view showing the duplex socket according to the first embodiment of the invention.

Referring to FIGS. 11 and 12, a USB 2.0 bidirectional duplex electrical connection socket 901 of this embodiment is almost the same as the bidirectional simplex USB 2.0 electrical connection socket 90 except for the differences that there is additionally provided with one row of first terminals 94, and that the top side of the tongue 921 is also formed with a USB 2.0 contact interface 2*a*. The USB 2.0 contact interfaces 2*a* on the top and bottom sides of the tongue 921 have the same contact interface, and the connection points with the circuit serial numbers arranged reversely.

Figure 13:
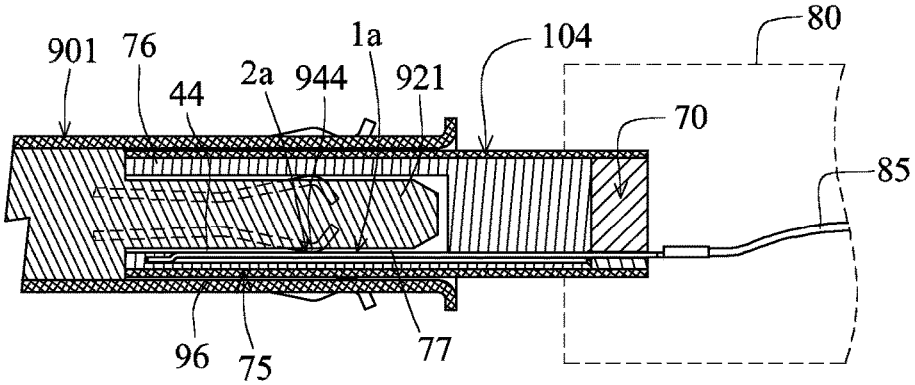
FIG. 13 is a side cross-sectional view showing a combination of the duplex socket and the simplex plug according to the first embodiment of the invention.

Referring to FIG. 13, a bidirectional simplex USB 2.0 electrical connection plug 104 is almost the same as the bidirectional duplex USB 2.0 electrical connection plug 100 except for the difference that only one of the two contact interface substrates 76 of the fitting portion 75 has the USB 2.0 contact interface 1*a*. So, the fitting portion 75 can be bidirectionally inserted into the connection slot 96 of the bidirectional duplex USB 2.0 electrical connection socket 901, and the USB 2.0 contact interface 1*a* (contacts 44) of the contact interface substrate 76 is inevitably electrically connected to one of the USB 2.0 contact interfaces 2*a* (contacts 944) on the top and bottom sides of the tongue 921 of the bidirectional duplex USB 2.0 electrical connection socket 901.

Figure 14:
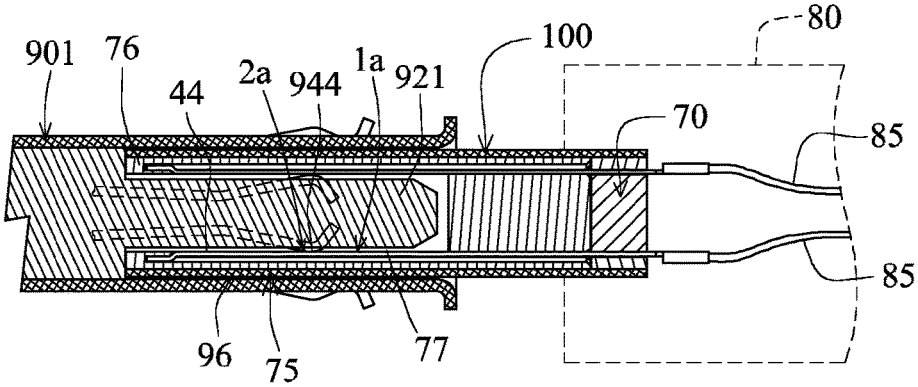
FIG. 14 is a side cross-sectional view showing a combination of the duplex socket and the duplex plug according to the first embodiment of the invention.

Referring to FIG. 14, the fitting portion 75 of the bidirectional duplex USB 2.0 electrical connection plug 100 can be bidirectionally inserted into the connection slot 96 of the bidirectional duplex USB 2.0 electrical connection socket 901, so that the two USB 2.0 contact interfaces 1*a* and 2*a* of the plug and the socket can be bidirectionally connected to achieve the convenient use and the doubled transmission speed. However, the plug and the socket of this embodiment are slimmer and lighter than those of the prior art.

As shown in FIGS. 14 and 13, the two contact interface substrates 76 of the plug and the spaces on the upper and lower connection surfaces of the tongue 921 of the connection slot 96 of the socket are tightly fit, wherein the fitting gap is smaller than 0.15 mm.

The socket of this embodiment has two contact interfaces, so the socket is electrically connected to a circuit board. The circuit board may have cascaded circuits to electrically connect the connection points of the two contact interfaces of the socket with the same circuit serial number to the same circuit to form one set of circuits. Thus, it can work in conjunction with a bidirectional simplex electrical connection plug to perform the bidirectional corresponding connection.

Figure 15:
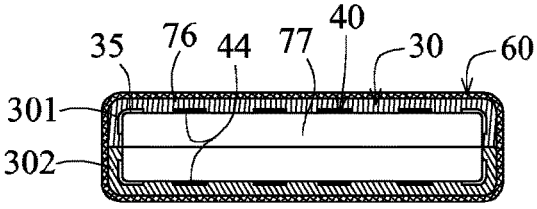
FIG. 15 is a front cross-sectional view showing another duplex plug according to the first embodiment of the invention.

Referring to FIG. 15, another modification of the bidirectional duplex USB 2.0 electrical connection plug of this embodiment is provided with the difference that the insulating base 30 is formed by stacking an upper base 301 and a lower base 302, wherein the cross-section of the front segment of the upper base 301 is inversely U-shaped, and the cross-section of the front segment of the lower base 302 is U-shaped. Each of the upper and lower bases 301 and 302 is embedded into and injection molded with one row of first terminals 40. Each of the upper and lower bases 301 and 302 forms the insulating layer of the contact interface substrate 76. An L-shaped reinforcing sheet 35 is assembled with or embedded into each of the left and right sides of the insulating layers of the two contact interface substrates 76.

In addition, each of the upper and lower bases 301 and 302 may be formed with one row of terminal slots, into which one row of first terminals are assembled.

Figure 16:
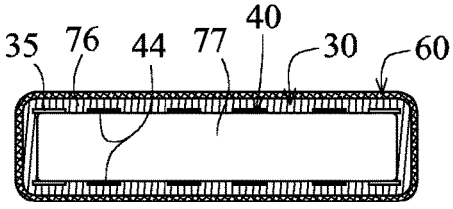
FIG. 16 is a front cross-sectional view showing another duplex plug according to the first embodiment of the invention.

Referring to FIG. 16, another modification of the bidirectional duplex USB 2.0 electrical connection plug of this embodiment is provided with the differences that the reinforcing sheet 35 is horizontal I shaped, and that the insulating base 30 is integrally embedded into and injection molded with the two rows of first terminals.

Referring to FIGS. 17 to 33, the second embodiment of the invention provides a bidirectional USB 3.0 electrical connection plug and a bidirectional USB 3.0 electrical connection socket.

Referring to FIGS. 17 to 20, a bidirectional duplex USB 3.0 electrical connection plug 103 of this embodiment is almost the same as the first embodiment except for the differences that two rows of five second terminals 50 are further provided, that the insulating base 30 has the upper and lower bases 301 and 302 stacked vertically, and that each of the upper and lower bases 301 and 302 has one row of five second terminal slots 33. Each of the rows of second terminal slots 33 extend to a contact interface substrate 76 and form one row of elastic movement spaces 762 separately arranged and depressed into the insulating layer 761. The insulating layer 761 has a bottom surface 763 on the one row of depressed elastic movement spaces 762 and is separated from the metal housing 60. The two rows of second terminals 50 are assembled into the two rows of second terminal slots 33, respectively. The two rows of first terminals 40 are embedded into, injected molded with and fixed to the upper and lower bases 301 and 302. In addition, a transversally extending metal partition plate 87, for separating the two rows of second terminals 50 to reduce the mutual electric interference and facilitate the high-speed transmission, is provided between the upper and lower bases 301 and 302.

Figure 20:
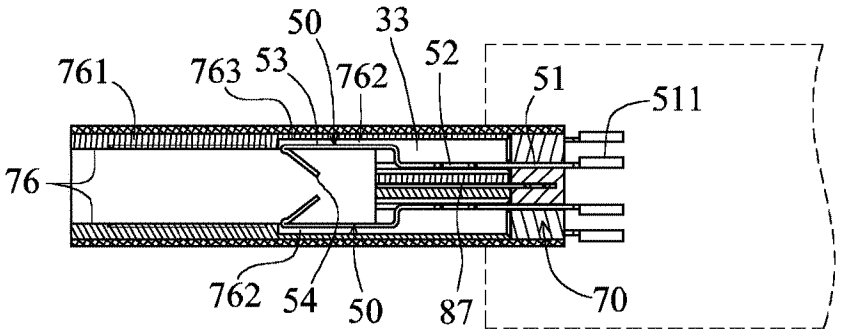
FIG. 20 is a side cross-sectional view (taken at the position of the second terminal 50) showing the duplex plug according to the second embodiment of the invention.
Figure 17:
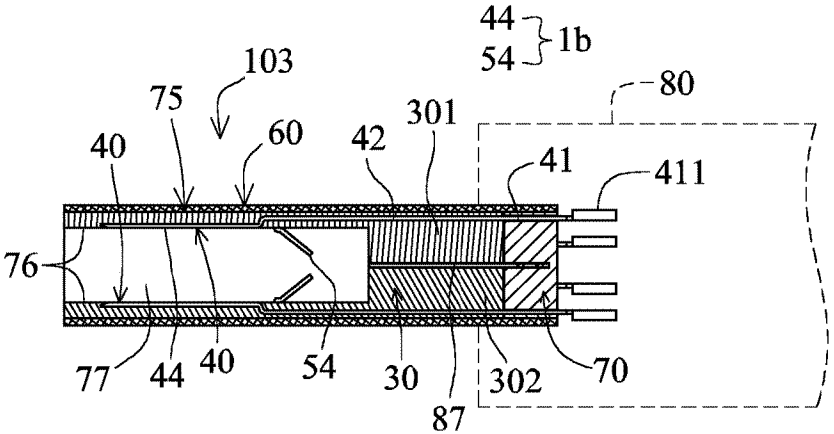
FIG. 17 is a side cross-sectional view (taken at the position of the first terminal 40) showing a duplex plug according to a second embodiment of the invention.
Figure 18:
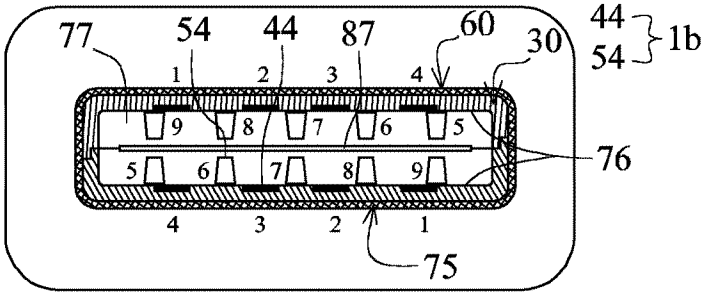
FIG. 18 is a front cross-sectional view showing the duplex plug according to the second embodiment of the invention.

Referring to FIG. 20, the second terminal 50 sequentially has, from one end to the other end, a pin 51, a fixing portion (also referred to as a first fixing portion) 52 and an extension 53. The fixing portion 52 is fixed to the second terminal slot 33. The extension 53 connected to the front end of the fixing portion 52 extends to the contact interface substrate 76 and has a distal segment bent inversely to form a contact 54. The contact 54 is the cut section of the distal end of the extension 53. The extension 53 is vertically elastically movable in the elastic movement spaces 762. The contact 54 is vertically elastically movable and projects beyond the inner surface of the contact interface substrate 76. The pin 51 is connected to the other end of the fixing portion 52, projects beyond the rear end of the insulating base 30 and has a distal segment formed with a wiring portion 511. The contacts 44 of the two rows of first terminals 40 and the contacts 54 of the two rows of second terminals 50 respectively form the USB 3.0 contact interfaces 1*b* of the two contact interface substrates 76, respectively. The two USB 3.0 contact interfaces 1*b* have the same contact interface and the connection points with the circuit serial numbers arranged reversely. As shown in FIG. 18, the contacts 44 of the upper one row of first terminals have the connection points with the circuit serial numbers of 1, 2, 3, 4 arranged from left to right, the contacts 54 of one row of second terminals have the connection points with the circuit serial numbers of 9, 8, 7, 6, 5 arranged from left to right, the contacts 44 of the lower one row of first terminals have the connection points with the circuit serial numbers of 4, 3, 2, 1 arranged from left to right, and the contacts 54 of one row of second terminals have the connection points with the circuit serial numbers of 5, 6, 7, 8, 9 arranged from left to right.

Referring to FIGS. 17 to 20, the two contact interface substrates 76 are formed with the contacts 44 of the front row of the first terminals 40 and the contacts 54 of the rear row of the second terminals 50, wherein the width of each of the front row of contacts 44 is wider than the width of each of the rear row of contacts 54, the number of the front row of contacts 44 is equal to 4, which is smaller than the number the rear row of contacts 54, which is equal to 5. The arrangement width of the front row of contacts 44 is narrower than the arrangement width of the rear row of contacts 54. The insulating layers 761 of the two contact interface substrates have the transversal front-rear isolating regions 764 for separating the front and rear rows of contacts 44 and 54 from each other.

The two contact interface substrates 76 have separating structures corresponding to the rear row of contacts, so that the rear row of contacts 54 cannot touch the metal housing 60 when being vertically elastically moved. The separating structures are the elastic movement space 762 and the bottom surface 763.

The front row of contacts 44 is connected to a fixing portion (also referred to as a second fixing portion) 42 extending to and being positioned at the contact interface substrate 76. The fixing portions 52 of the second terminals 50 of the rear row of contacts 54 extend to and are positioned at the insulating base 30.

The rear row of contacts 54 of the two contact interface substrates are closer to the middle height of the fitting space 77 than the front row of contacts 44, so that the two rows of contacts 44 and 54 are in the front-low and rear-high manner.

According to the USB 3.0 contact interface specified by USB Association, the front row of contacts 44 have the connection point with the circuit serial number 1 being the ground contact, the connection point with the circuit serial number 4 being the power contact, and the connection points with the circuit serial numbers 3 and 2 being one pair of signal contacts represented by D+ and D−, respectively; and the rear row of contacts 54 have the connection point with the circuit serial number 7 being the ground contact, and the connection points with the circuit serial numbers 6 and 5, and 9 and 8 being two pairs of signal contacts represented by RX+ and RX−, and TX+ and TX−, respectively.

The front row of contacts 44 are connected to a fixing portion 42 extending to and being positioned at the contact interface substrate 76. The fixing portions 52 of the second terminals 50 of the rear row of contacts 54 extend to and are positioned at the insulating base 30.

Figure 21:
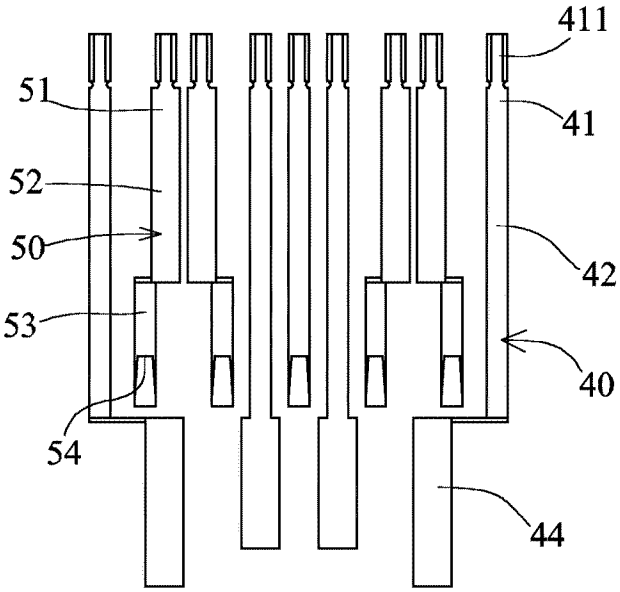
FIG. 21 is an arranged top view showing two rows of terminals of the duplex plug according to the second embodiment of the invention.

Referring to FIG. 21, the middle terminal of each row of second terminals 50 is the ground terminal, and one pair of signal terminals are disposed on two sides of the middle terminal. Each pair of signal terminals can be designed to be close to each other, and this is advantageous to the high-speed transmission, so the fixing portions 52 and the pins 51 of the two second terminals 50 on the two sides are close to each other.

Figure 22:
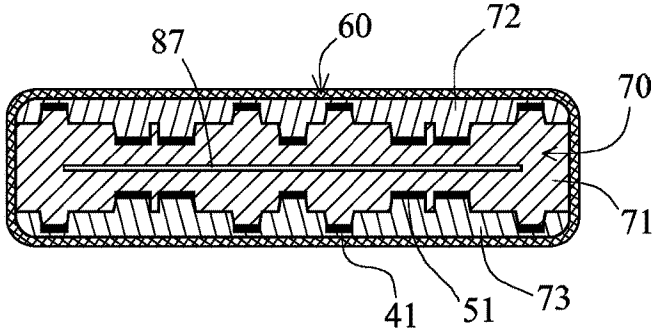
FIG. 22 is a back cross-sectional view showing the duplex plug according to the second embodiment of the invention.

Referring to FIG. 22, the rear plug 70 is a three-piece combination comprising an upper portion 72, a middle portion 71 and a lower portion 73, so that the pins 41 of the two rows of first terminals 40 and the pins 51 of the two rows of second terminals 50 pass through and closely fit with the rear plug 70. The rear plug 70 mainly plugs into the voids communicating the two rows of second terminal slots 33 with the rear end of the insulating base 30.

Figure 23:
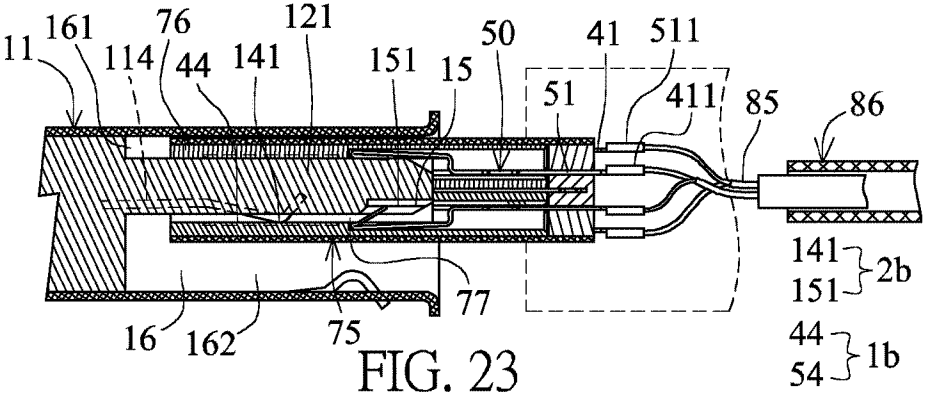
FIG. 23 is a side cross-sectional view showing a used state of the duplex plug according to the second embodiment of the invention.

Referring to FIG. 23, with the above-mentioned structure, the heights of the two contact interface substrates 76 of the fitting portion 75 can be fit into the small space 161 of the connection slot 16 of the A-type standard USB 3.0 electrical connection socket 11. So, the A-type standard USB 3.0 electrical connection socket 11 and the A-type standard USB 2.0 electrical connection socket 10 have substantially the same structure except that only one row of five second terminals 15 are added. The second terminal 15 has an elastically non-movable contact 151 disposed in front of the contact 141 of the first terminal 14. So, the fitting portion 75 can be bidirectionally inserted into the connection slot 16 of the A-type standard USB 3.0 electrical connection socket 11, and one of the USB 3.0 contact interfaces 1*b* (contacts 44 and 54) of the two contact interface substrates 76 is electrically connected to the USB 3.0 contact interface 2*b* (contacts 141 and 151) below the tongue 121 of the A-type standard USB 3.0 electrical connection socket 11.

Regarding the wiring portions 411 of the pins of the two rows of first terminals 40 of this embodiment, the connection points with the same circuit serial number are connected to the same wire 85. Regarding the wiring portions 511 of the pins of the two rows of second terminals 50, the connection points with the same circuit serial number are connected to the same wire 85. So, the connection cable 86 has one set of nine wires 85 thereinside.

Figure 24:
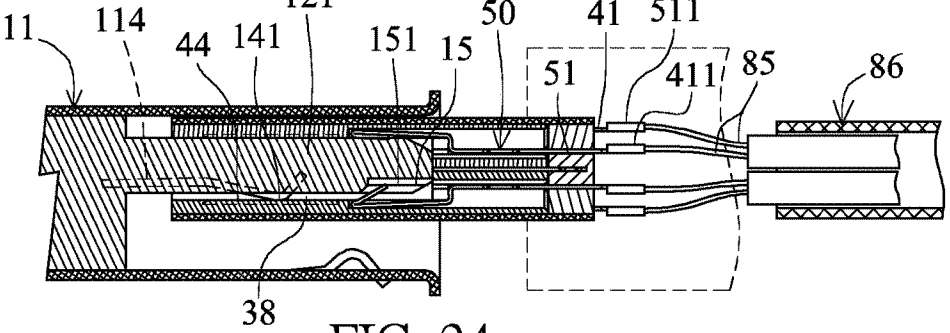
FIG. 24 is a side cross-sectional view showing the used state of the duplex plug according to the second embodiment of the invention.

Referring to FIG. 24 of this embodiment, each of the wiring portions 411 of the pins of the two rows of first terminals 40 and the wiring portions 511 of the pins of the two rows of second terminals 50 is connected to a wire 85. So, the connection cable 86 has two set of nine wires 85 (18 wires 85 in total).

Figure 25:
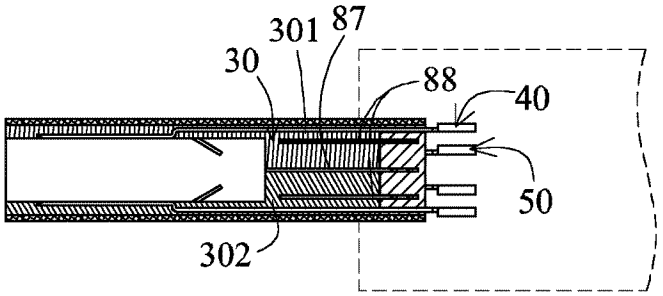
FIG. 25 is a side cross-sectional view (taken at the position of the first terminal 40) showing another duplex plug according to the second embodiment of the invention.

Referring to FIG. 25, another modification of the bidirectional duplex USB 3.0 electrical connection plug of this embodiment is provided with the difference that a transversally extending metal partition plate 88 is added to each of the upper and lower bases 301 and 302 of the insulating base 30, so that the mutual electric interference of one row of first and second terminals 40 and 50 is reduced, and this is more advantageous to the high-speed transmission.

Figure 27:
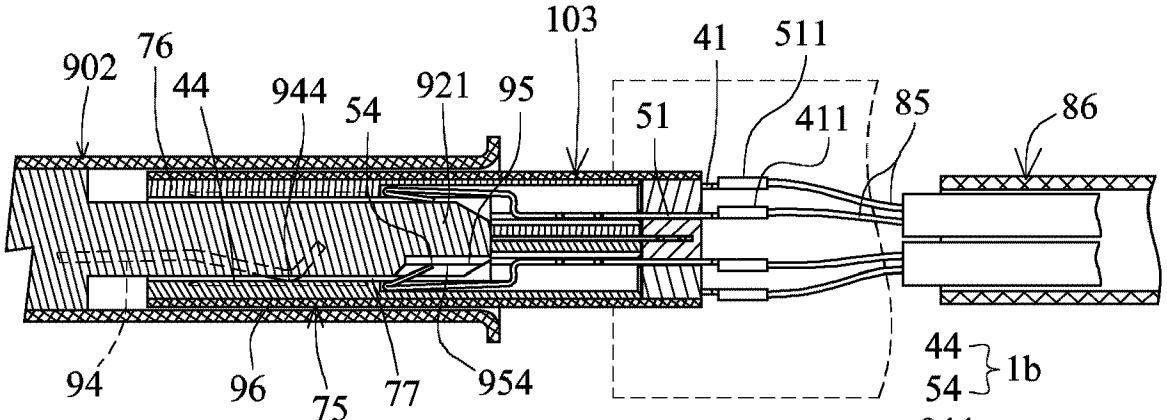
FIG. 27 is a side cross-sectional view showing the combination of the simplex socket and the duplex plug according to the second embodiment of the invention.
Figure 26:
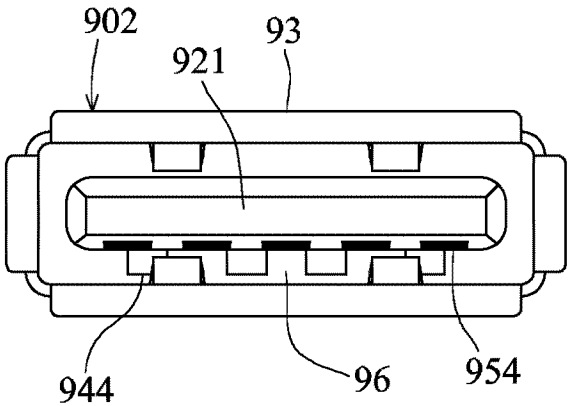
FIG. 26 is a front view showing a simplex socket according to the second embodiment of the invention.

Referring to FIGS. 26 and 27, a bidirectional simplex USB 3.0 electrical connection socket 902 of this embodiment is almost the same as the USB 2.0 bidirectional duplex electrical connection socket 901 of the first embodiment except for the difference that one row of five second terminals 95 are further provided. The second terminal 95 has an elastically non-movable contact 954 disposed in front of the contact 944 of the first terminal 94. The contact 954 is slightly depressed into the bottom side of the tongue 921. The one row of contacts 944 and the one row of contacts 954 form the USB 3.0 contact interface 2*b*.

The heights of the two contact interface substrates 76 of the fitting portion 75 of the bidirectional duplex USB 3.0 electrical connection plug 103 can be fit into the spaces on the upper and lower connection surfaces of the tongue 921 of the connection slot 96. So, the fitting portion 75 can be bidirectionally inserted into the connection slot 96 of the bidirectional simplex USB 3.0 electrical connection socket 902, and one of the USB 3.0 contact interfaces 1*b* (contacts 44 and 54) of the two contact interface substrates 76 is electrically connected to the USB 3.0 contact interface 2*b* (contacts 944 and 954) of the bottom side of the tongue 921 of the bidirectional simplex USB 3.0 electrical connection socket 902. In addition, the fitting portion 75 of the bidirectional duplex USB 3.0 electrical connection plug 103 and the connection slot 96 of the bidirectional simplex USB 3.0 electrical connection socket 902 can achieve the better fitting. So, this is different from FIG. 23, in which a too large space is still left when the contact interface substrate 76 is in the large space 162.

Figure 19:
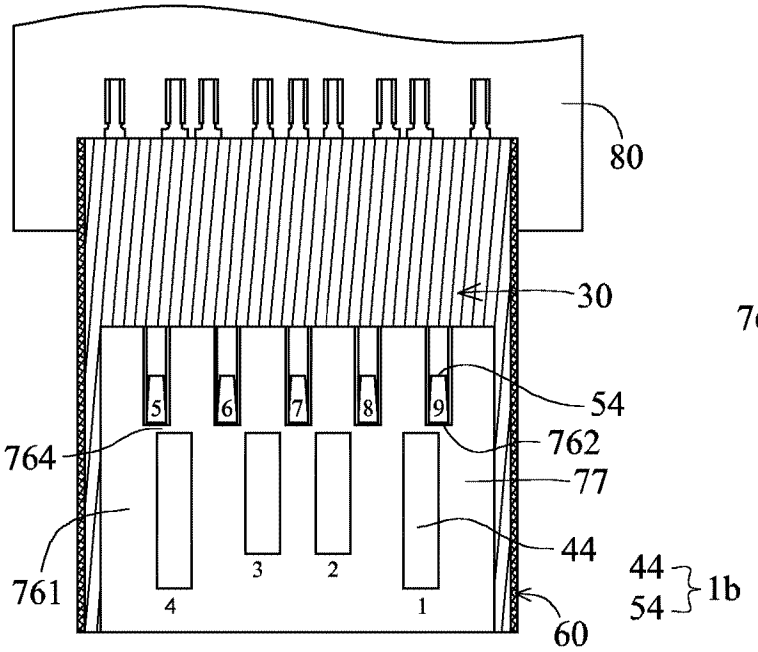
FIG. 19 is a top cross-sectional view showing the duplex plug according to the second embodiment of the invention.

The USB 3.0 contact interface 2*b* of the bidirectional simplex USB 3.0 electrical connection socket 902 is electrically connected to the USB 3.0 contact interface 1*b* of the bidirectional duplex USB 3.0 electrical connection plug 103 shown in FIG. 19. So, the front row of elastically non-movable contacts 954 of the socket also comprise two pairs of USB 3.0 signal contacts of RX+, RX−; and TX+, TX−, respectively, and the rear row of elastically movable contacts 944 also comprise one pair of USB 3.0 signal contacts of D+, D−.

The contact interface of at least one connection surface of the two connection surfaces of the tongue 921 has the five elastically non-movable contacts 954 in flat surface contact with the tongue. Only two pairs of elastically non-movable USB 3.0 signal contacts 954 in flat surface contact with the tongue of only one connection surface of the two connection surfaces are electrically connected to only two pairs of USB 3.0 signal contacts 54 of one side of the bidirectional electrical connection plug. The only two pairs of USB 3.0 signal contacts are shown in FIG. 19 as RX+, RX−; and TX+, TX−, respectively.

The contact interface of at least one connection surface of the two connection surfaces of the tongue 921 has at least nine contacts having connection points with the circuit serial numbers arranged in order. Only three pairs of USB 3.0 signal contacts of only one connection surface of the two connection surfaces are electrically connected to only three pairs of USB 3.0 signal contacts of one side of the bidirectional electrical connection plug. The only three pairs of USB 3.0 signal contacts as shown in FIG. 19 as D+, D−; RX+, RX−; and TX+, TX−, respectively.

Figure 29:
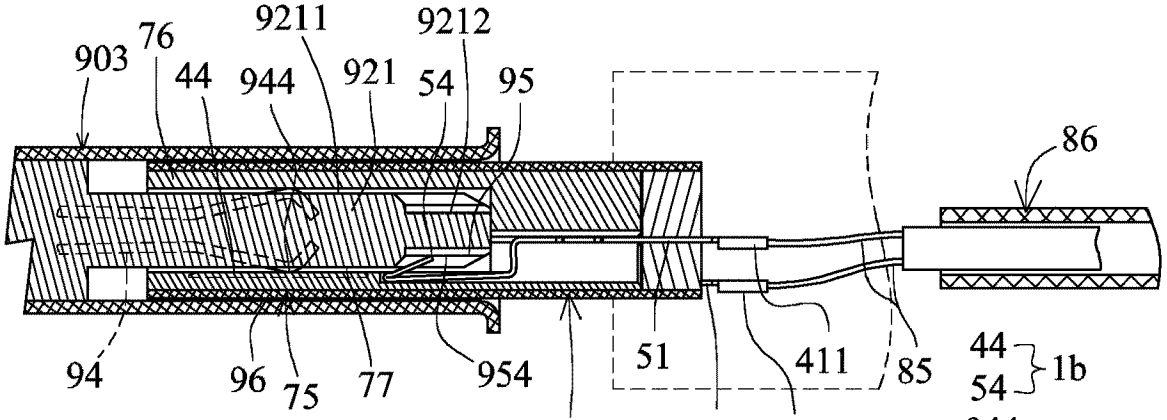
FIG. 29 is a side cross-sectional view showing a combination of the duplex socket and the simplex plug according to the second embodiment of the invention.
Figure 28:
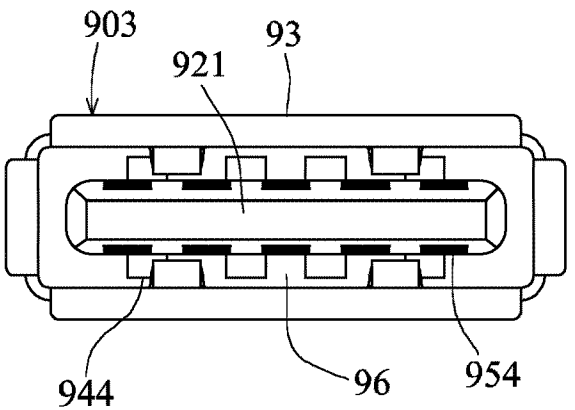
FIG. 28 is a front view showing a duplex socket according to the second embodiment of the invention.

Referring to FIGS. 28 and 29, a bidirectional duplex USB 3.0 electrical connection socket 903 and a bidirectional simplex USB 3.0 electrical connection plug 107 of this embodiment are correspondingly connected to each other, wherein the bidirectional duplex USB 3.0 electrical connection socket 903 is almost the same as the above-mentioned bidirectional simplex USB 3.0 electrical connection socket 902 except for the differences that the socket 903 further additionally comprises one row of first terminals 94 and one row of second terminals 95, that the top side of the tongue 921 is also formed with a USB 3.0 contact interface 2*b*, that the two connection surfaces of the tongue 921 have inner segments and outer segments lower than the inner segments to have an inverse T shape, that each of the upper and lower connection surfaces of the tongue has an inner section formed with a high surface 9211 and an outer section formed with a low surface 9212, that the two sides of the tongue 921 are formed with connection surfaces with steps, and that the contacts 954 of the one row of second terminals 95 of the two USB 3.0 contact interfaces 2*b* are in flat surface contact with and positioned at the low surfaces 9212 of the outer segments of the two connection surfaces of the tongue 921, and are not vertically elastically movable. The contacts 944 of the one row of first terminals 94 of the two USB 3.0 contact interfaces 2*b* respectively project beyond the high surface 9211 of the inner sections of the two connection surfaces of the tongue 921. The USB 3.0 contact interfaces 2*b* of the top and bottom sides of the tongue 921 have the same contact interface, and the connection points with the circuit serial numbers arranged reversely. The bidirectional simplex USB 3.0 electrical connection plug 107 is almost the same as the above-mentioned bidirectional duplex USB 3.0 electrical connection plug 103 except for the differences that only one of the two contact interface substrates 76 of the fitting portion 75 has the USB 3.0 contact interface 1*b*. So, the fitting portion 75 can be bidirectionally inserted into the connection slot 96 of the USB 3.0 bidirectional duplex electrical connection socket 903, and the USB 3.0 contact interface 1*b* (contacts 44 and 54) of the contact interface substrate 76 is inevitably electrically connected to the USB 3.0 contact interface 2*b* (contacts 944 and 954) of one of the top and bottom sides of the tongue 921 of the bidirectional duplex USB 3.0 electrical connection socket 903.

Only one of the two contact interface substrates 76 of the fitting portion 75 of the bidirectional simplex USB 3.0 electrical connection plug 107 has the USB 3.0 contact interface, and similarly has only three pairs of signal contacts D+, D−; RX+, RX−; and TX+, TX−, as shown in FIG. 19. The rear row of elastically movable contacts have only two pairs of signal contacts RX+, RX−; and TX+, TX−, and each of the front and rear rows of contacts 44, 54 has a ground contact, and represent two rows of horizontal pins 41, 51, which do not flush with each other.

The USB 3.0 contact interface of the two connection surfaces of the tongue 921 of the bidirectional duplex USB 3.0 electrical connection socket 903 is correspondingly electrically connected to the USB 3.0 contact interface of the bidirectional simplex USB 3.0 electrical connection plug 107. So, the USB 3.0 contact interface of the two connection surfaces of the tongue 921 similarly has three pairs of signal contacts represented as D+, D−; RX+, RX−; and TX+, TX−, respectively. Each of the front and rear rows of contacts 944, 954 has a ground contact. So, the two connection surfaces of the tongue 921 form high and low contacts and high and low ground contacts.

Figure 30:
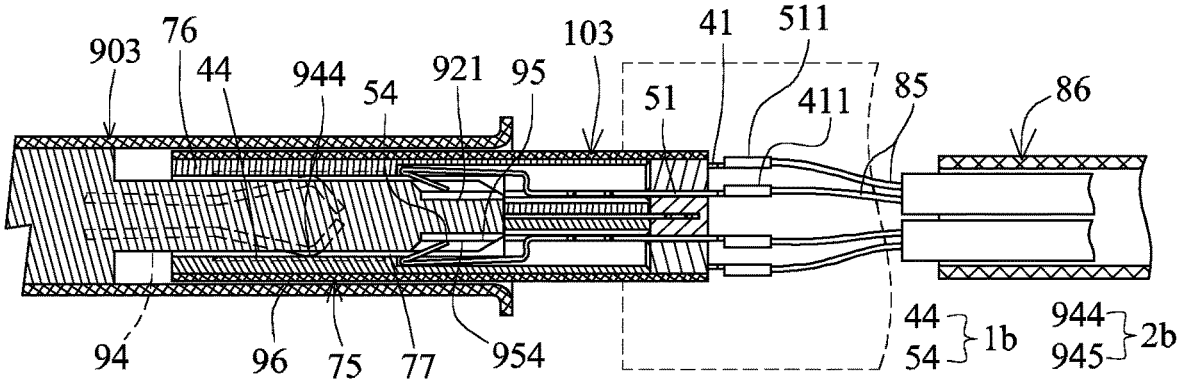
FIG. 30 is a side cross-sectional view showing the combination of the duplex socket and the duplex plug according to the second embodiment of the invention.

Referring to FIG. 30, the bidirectional duplex USB 3.0 electrical connection socket 903 and the bidirectional duplex USB 3.0 electrical connection plug 103 are correspondingly connected together, so that the two USB 3.0 contact interfaces 1*b* and 2*b* of the plug and the socket can be bidirectionally connected together to achieve the effect of the convenient use and the doubled transmission speed.

The socket of this embodiment may be designed such that the spaces of the connection slot 96 on the upper and lower connection surfaces of the tongue 921 may have the same height or different heights, wherein the height may range between 0.55 mm and 1.5 mm, and the height of the connection slot 96 may be designed to range between 3 mm and 4.9 mm. Thus, the height of the contact interface substrate matching with the inserted bidirectional USB 2.0 electrical connection plug ranges between 0.5 mm and 1.45 mm, and the height of the fitting portion ranges between 3 mm and 4.85 mm.

Figure 31:
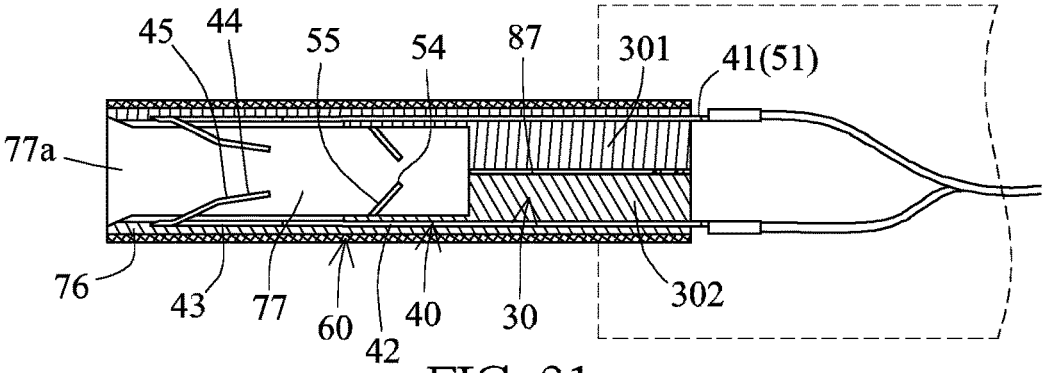
FIG. 31 is a side cross-sectional view (taken at the position of the first terminal 40) showing another duplex plug according to the second embodiment of the invention.
Figure 32:
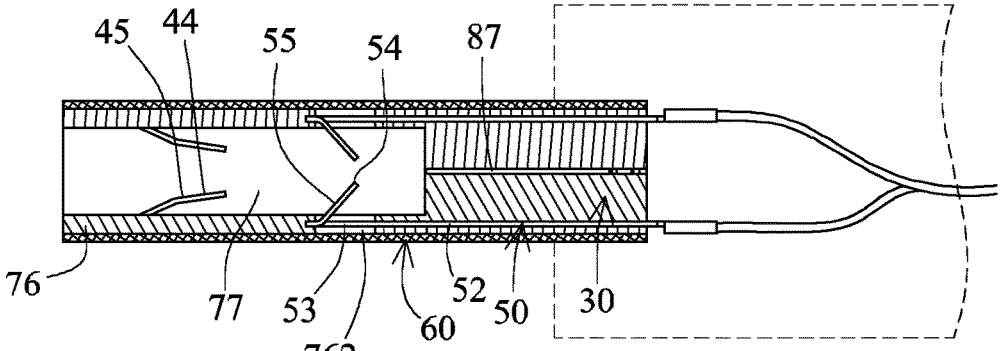
FIG. 32 is a side cross-sectional view (taken at the position of the second terminal 50) showing another duplex plug according to the second embodiment of the invention.
Figure 33:
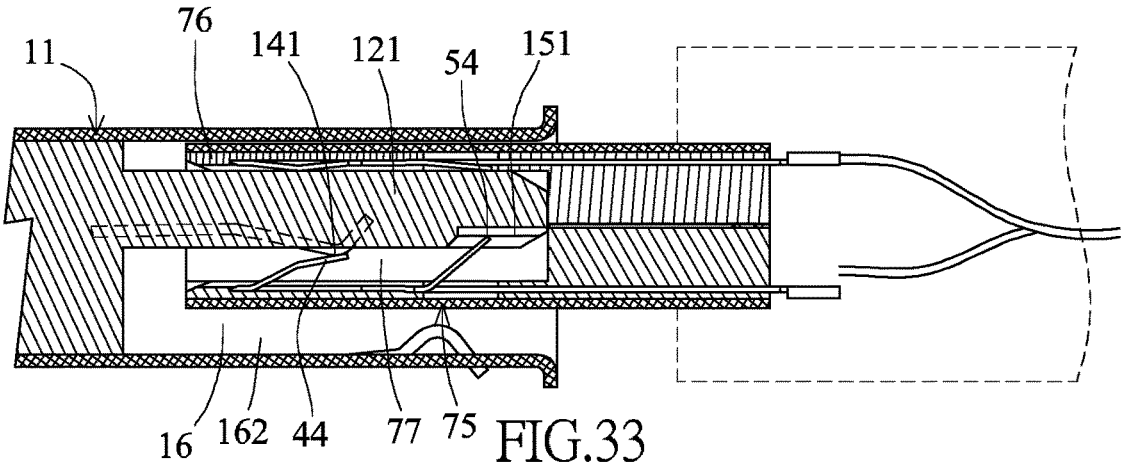
FIG. 33 is a side cross-sectional view showing a used state of another duplex plug according to the second embodiment of the invention.

Referring to FIGS. 31 and 32, another modification of the bidirectional duplex USB 3.0 electrical connection plug of this embodiment is provided, wherein the insulating base 30 thereof similarly has the vertically stacked upper and lower bases 301, 302, except for the difference that the inner surfaces of the two contact interface substrates 76 are projectingly formed with two rows of vertically elastically movable contacts. That is, the two rows of first terminals 40 are prodded from the plate surface of the extension 43 to the fitting space 77 to form a projecting reverse extending sheet 45. The reverse extending sheet 45 is vertically elastically movable and has the contact 44. The two rows of second terminals 50 are prodded from the plate surface of the extension 53 to the fitting space 77 to form a projecting reverse extending sheet 55. The reverse extending sheet 55 is vertically elastically movable and has a cut section of a distal end formed with the contact 54. The contacts 44 and 54 are elastically movable and much more projecting beyond the contact interface substrate than the contact of the A-type standard electrical connection plug by about 0.4 mm to 0.7 mm. So, the height of the fitting space 77 may be designed to be larger and range between about 2.35 mm and 2.7 mm, which is larger than the height (1.95 mm) of the fitting slot 24 of the conventional A-type standard USB 2.0 electrical connection plug 20. In this embodiment, the projecting distance of 0.6 mm is designed, the height of the fitting space 77 is 2.6 mm, and the height of the fitting portion 75 can reach 4.0 mm. Referring to FIG. 33, when the fitting portion 75 is fit into the connection slot 16 of the A-type standard USB 3.0 electrical connection socket 11, the contacts 44 and 54 still can be electrically connected to the contacts 141 and 151 by way of elastic movement. However, the remaining space of the large space of the contact interface substrate 76 in the connection slot 16 can be reduced to be about 1.12 mm. Thus, the space provided when the plug is improperly forced to rotate downwards can be shortened to prevent the tongue 121 of the socket from being broken. The front row of contacts 44 are one row of elastically movable contacts bent from an insertion port 77*a* of the fitting space 77 inversely to extend forwardly.

The two contact interface substrates 76 have a separating structure corresponding to the rear row of contacts, so that the rear row of contacts 54 cannot touch the metal housing 60 when being vertically elastically moved. The separating structure is the elastic movement space 762. The front row of contacts 44 is connected to a fixing portion 42 extending to and being positioned at the contact interface substrate 76. The fixing portions 52 of the terminals 50 of the rear row of contacts 54 extend to and are positioned at the insulating base 30.

Each of the pins 41, 51 of the terminals 40, 50 of the two contact interfaces forms one row of horizontal pins to constitute two rows of horizontal pins arranged vertically.

Referring to FIGS. 34 to 44, the third embodiment of the invention provides a bidirectional MICRO USB electrical connection plug and a bidirectional MICRO USB electrical connection socket.

Figure 37:
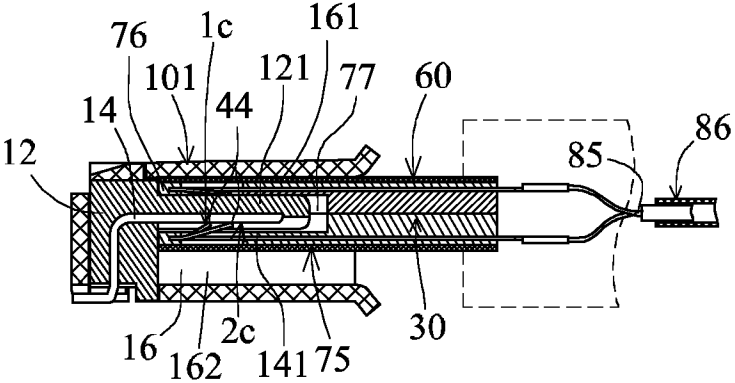
FIG. 37 is a side cross-sectional view showing a used state of the duplex plug according to the third embodiment of the invention.

Referring to FIGS. 34 to 37, a bidirectional duplex MICRO USB electrical connection plug 102 of this embodiment can be bidirectionally correspondingly connected to a standard MICRO USB electrical connection socket 101, as shown in FIG. 37. The standard MICRO USB electrical connection socket 101 has an insulating base 12 and a metal housing 13. The upper portion of the front end of the insulating base 12 has a horizontally frontwardly projecting tongue 121. The metal housing 13 covers the insulating base 12 and forms a connection slot 16 covering the tongue 121. The connection slot 16 respectively has the small space 161 and the large space 162 on the top and bottom sides of the tongue 121. The insulating base 12 has one row of five first terminals 14. The first terminal 14 has a vertically elastically non-movable contact 141 slightly depressed into the bottom side of the tongue 121. The contacts 141 of the one row of first terminals 14 form a MICRO USB contact interface 2*c*.

The tongue of the standard MICRO USB (2.0 or 3.0) electrical connection socket specified by USB Association has the height of 0.6 mm, wherein the small space has the height of 0.28 mm, the large space has the height of 0.97 mm, the connection slot has the total height of 1.85 mm, and the contact 141 depressed into the bottom side of the tongue 121 has the height of 0.12 mm. The MICRO USB 2.0 has five elastically non-movable contacts disposed on one tongue. The MICRO USB 3.0 has five elastically non-movable contacts disposed on each of two tongues.

Figure 34:
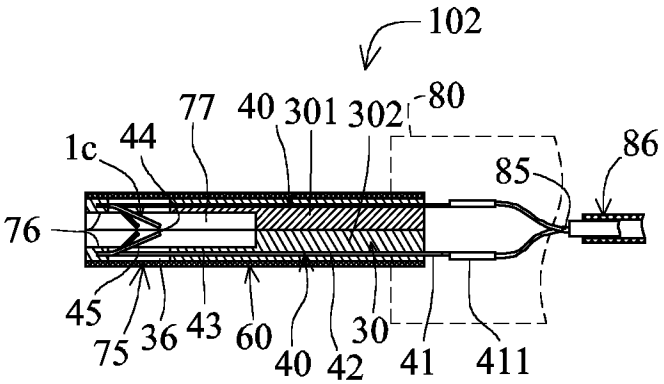
FIG. 34 is a side cross-sectional view showing a duplex plug according to the third embodiment of the invention.
Figure 36:
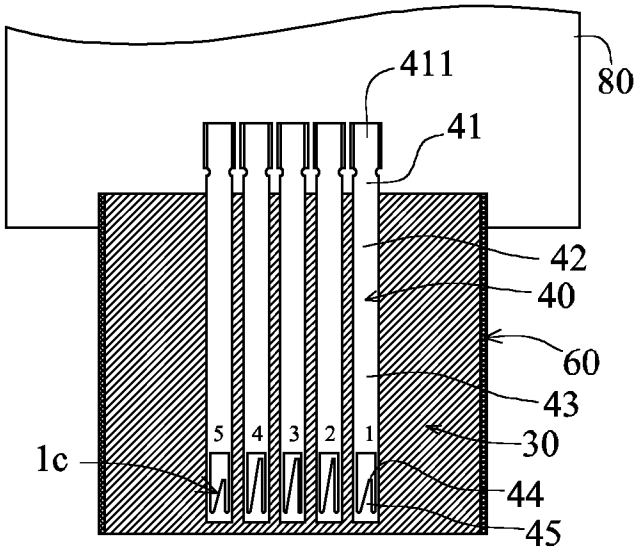
FIG. 36 is a top cross-sectional view showing the duplex plug according to the third embodiment of the invention.
Figure 35:
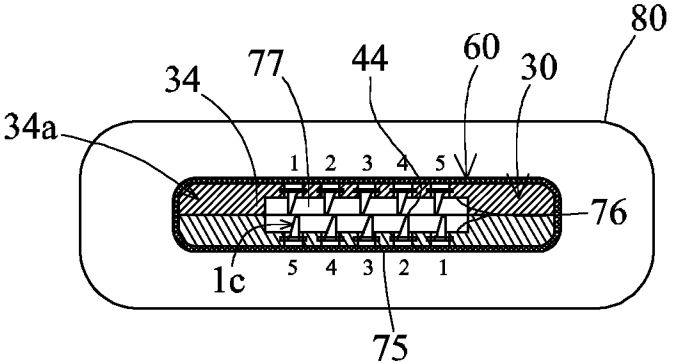
FIG. 35 is a front cross-sectional view showing the duplex plug according to the third embodiment of the invention.

The connection portion of the standard MICRO USB (2.0 or 3.0) electrical connection plug specified by USB Association has the height of 1.8 mm, wherein the fitting slot has the height of 0.65 mm, the metal housing has the thickness of 0.25 mm, and the contact interface substrate has the height of 0.9 mm. Referring to FIGS. 34 to 36, the bidirectional duplex MICRO USB electrical connection plug 102 of this embodiment comprises an insulating base 30, two rows of first terminals 40, a metal housing 60, a positioning structure 34*a* and a fitting portion 75.

The insulating base 30 is plastically injection molded and formed by combining the upper base 301 and the lower base 302 together. The front segment of the insulating base 30 has a fitting space 77. The insulating base 30 forms the top, bottom, left and right sides of the fitting space 77, wherein the insertion port 77*a* of the fitting space 77 faces frontwards.

The metal housing 60 covers the insulating base 30, wherein the front-view shape of the metal housing 60 is rectangular, top-bottom symmetrical and left-right symmetrical.

The fitting portion 75 disposed at the front end of the insulating base 30 has two opposite contact interface substrates 76 and a fitting space 77, the interval of the two contact interface substrates 76 is the fitting space 77, the inside layers of the two contact interface substrates 76 are integrally formed jointly with the insulating base 30, and the outside layers of the two contact interface substrates 76 pertain to the metal housing 60. The fitting space 77 is also the fitting space 77 of the insulating base 30. Each of the two contact interface substrates 76 has a MICRO USB contact interface 1*c*. The two MICRO USB contact interfaces 1*c* are formed by the two rows of first terminals 40. The two MICRO USB contact interfaces 1*c* are electrically connected to the insulating base 30. The two MICRO USB contact interfaces 1*c* have the same contact interface and the connection points with the circuit serial numbers arranged reversely. The external shape of the fitting portion 75 is rectangular, top-bottom symmetrical and left-right symmetrical. The fitting portion 75 can be bidirectionally inserted into the connection slot of the standard MICRO USB electrical connection socket 101, and the two contact interface substrates 76 can be fit into the small space.

The positioning structure 34*a* is integrally formed jointly with the front segments of two sidewalls 34 of the insulating base 30. The two sidewalls 34 are integrally connected to the two sides of the insulating layers of the two contact interface substrates 76 to position the insulating layers of the two contact interface substrates 76. The insulating layers of the inside layers of the two contact interface substrates 76 are the top and bottom sides of the fitting space 77. The two sidewalls 34 are the left and right sides of the fitting space 77.

Each row of the two rows of first terminals 40 have five terminals. The two rows of first terminals 40 are embedded, injected and fixed to the upper base 301 and the lower base 302, respectively. The first terminal 40 sequentially has, from one end to the other end, a pin 41, a fixing portion 42 and an extension 43. The fixing portion 42 is fixed to the first terminal slot 31. The extension 43 connected to the front end of the fixing portion 42 extends to the contact interface substrate 76. The plate surface of the front segment of the extension 43 is pressed to form the reverse extending sheet 45 projecting toward the fitting space 77. The reverse extending sheet 45 is vertically elastically movable and has the cut section of the distal end formed with a contact 44. The contact 44 projects beyond the inner surface of the contact interface substrate 76. The pin 41 connected to the other end of the fixing portion 42 projects beyond the rear end of the insulating base 30 and has a distal segment formed with the wiring portion 411. The contacts 44 of the two rows of first terminals 40 respectively form the MICRO USB contact interfaces 1*c* of the two contact interface substrates 76. The two MICRO USB contact interfaces 1*c* have the same contact interface and have the connection points with the circuit serial numbers arranged reversely, as shown in FIG. 35, wherein the upper MICRO USB contact interface 1*c* has the connection points with the circuit serial numbers of 1, 2, 3, 4, 5 arranged from left to right, and the lower MICRO USB contact interface 1*c* has the connection points with the circuit serial numbers of 5, 4, 3, 2, 1 arranged from left to right.

The biased MICRO USB electrical connection socket 101, into which the plug of this embodiment is inserted and connected, has only one tongue, and thus pertains to the MICRO USB 2.0. So, similar to the USB 2.0 contact interface 1*a*, the MICRO USB contact interfaces 1*c* of the two contact interface substrates 76 also have one pair of USB 2.0 signal contacts D+, D−.

According to the MICRO USB 2.0 contact interface specified by the USB Association, the connection point with the circuit serial number 1 is the power contact, the connection points with the circuit serial numbers 3, 2 are one pair of signal contacts respectively labeled as D+, D−, the connection point with the circuit serial number 4 is the control contact, and the connection point with the circuit serial number 5 is the ground contact.

In addition, as shown in FIG. 36, the contacts 44 of the one row of first terminals 40 have the connection points with the circuit serial numbers 1 and 5 closer to the front end, and the connection points with the circuit serial numbers 2, 3, 4 closer to the rear end. In addition, as shown in FIG. 35, the contacts 44 of the two rows of first terminals 40 are staggered in the left-to-right direction so that they cannot touch each other.

This embodiment serves as a connector of a connection cable, wherein a housing 80 is formed by way of glue pouring or the housing 80 is formed by assembling and injection molding upper and lower housings together. The wiring portions 411 of the pins of the two rows of first terminals 40 are the connection points with the same circuit serial number connected to the same wire 85. Thus, the connection cable 86 has one set of nine wires 85.

Referring to FIG. 37, with the above-mentioned structure, the heights of the two contact interface substrates 76 of the fitting portion 75 can be fit into the small space 161 of the connection slot 16 of the standard MICRO USB electrical connection socket 101. So, the fitting portion 75 can be bidirectionally inserted into the connection slot 16 of the standard MICRO USB electrical connection socket 10, and the MICRO USB contact interface 1*c* (contacts 44) of one of the two contact interface substrates 76 is electrically connected to the MICRO USB contact interface 2*c* (contacts 141) below the tongue 121 of the standard MICRO USB electrical connection socket 101.

The two contact interface substrates 76 of the fitting portion 75 of this embodiment have the same height ranging between about 0.3 mm and 0.36 mm, wherein the fitting space 77 is about 0.65 mm, so the height of the fitting portion 75 ranges between about 1.2 mm and 1.35 mm, is significantly lower than the height (1.8 mm) of the connection portion of the standard MICRO USB electrical connection plug, and is higher than the height (0.97 mm) of the large space 162 of the connection slot 16 of the standard MICRO USB electrical connection socket 101. So, the fitting portion 75 cannot be incorrectly inserted into the large space 162 upon use. However, the height of the contact interface substrate 76 may be designed to range between 0.23 mm and 0.4 mm, and the height of the fitting portion 75 may be designed to range between 1.1 mm and 1.45 mm.

In order to facilitate the manufacturing, if the height of the contact interface substrate 76 is designed to be greater than the height (0.28 mm) of the small space 161, it still can be used because the tight insertion can be performed by the plastic resilience of the tongue 921.

Figure 38:
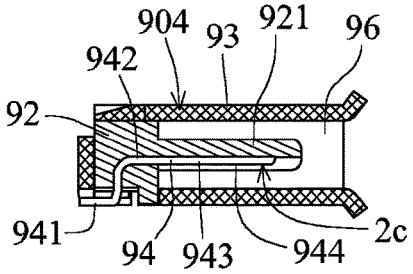
FIG. 38 is a side cross-sectional view showing a simplex socket according to the third embodiment of the invention.
Figure 39:
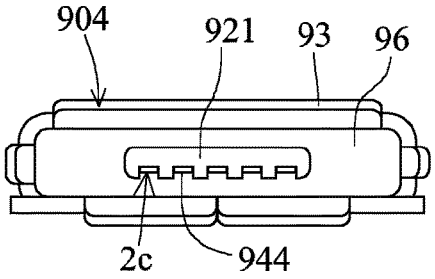
FIG. 39 is a front view showing the simplex socket according to the third embodiment of the invention.

Referring to FIGS. 38 and 39, a bidirectional simplex MICRO USB electrical connection socket 904 of this embodiment comprises an insulating base 92, a metal housing 93 and one row of first terminals 94.

The insulating base 92 is plastically injection molded and has a middle of a front end projectingly formed with a horizontally extending tongue 921. The bottom side of the tongue 921 has a MICRO USB contact interface 2*c*. The MICRO USB contact interface 2*c* is formed by the one row of first terminals 94. The MICRO USB contact interface 2*c* is electrically connected to the rear end of the insulating base 30.

The metal housing 93 covers the insulating base 92 and the tongue 921 to form a connection slot 96 at the front end of the insulating base 92. The tongue 921 is disposed at a middle height of the connection slot 96. Symmetrical spaces are formed on the top and bottom sides of the tongue 921. The external shape of the connection slot 96 is rectangular, top-bottom symmetrical and left-right symmetrical.

The one row of first terminals 94 is assembled with the insulating base. Each terminal has a pin 941, a fixing portion 942 and an extension 943. The fixing portion 942 is fixed to the insulating base 92. The extension 943 connected to the front end of the fixing portion 942 extends to the tongue 921 and has a contact 944. The contact 944 slightly depressed into the bottom side of the tongue 921 is not vertically elastically movable. The pin 941 connected to the rear end of the fixing portion 942 projects beyond the insulating base 92. The contacts 944 of the one row of first terminals 94 form the MICRO USB contact interface 2*c*.

This embodiment is characterized in that the heights of the spaces of the connection slot 96 on the upper and lower connection surfaces of the tongue 921 are about 0.3 mm to 0.5 mm, and are smaller than the large space 162 of the standard MICRO USB electrical connection socket 101, while the height of the tongue 921 is kept unchanged. The height of the connection slot 96 is about 1.2 mm to 1.6 mm A fitting portion of an electrical connection plug can be bidirectionally inserted into the connection slot 96.

This embodiment may be designed such that the spaces of the connection slot 96 on the upper and lower connection surfaces of the tongue 921 may have the same height or different heights, wherein the height may range between 0.23 mm and 0.8 mm, and the height of the connection slot 96 may be designed to range between 1.06 mm and 2.2 mm. Thus, the height of the contact interface substrate matching with the inserted and connected bidirectional MICRO USB electrical connection plug ranges between 0.23 mm and 0.7 mm, and the height of the fitting portion ranges between 1.1 mm and 2.05 mm.

Figure 40:
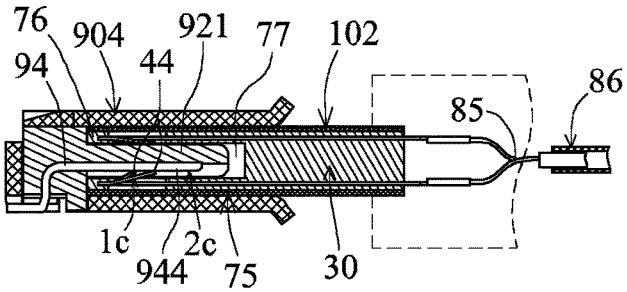
FIG. 40 is a side cross-sectional view showing a combination of the simplex socket and the duplex plug according to the third embodiment of the invention.

Referring to FIG. 40, with the above-mentioned structure, the heights of the two contact interface substrates 76 of the fitting portion 75 of the bidirectional duplex MICRO USB electrical connection plug 102 can be fit into the spaces on the upper and lower connection surfaces of the tongue 921 of the connection slot 96. So, the fitting portion 75 can be bidirectionally inserted into the connection slot 96 of the bidirectional simplex MICRO USB electrical connection socket 904, and the MICRO USB contact interface 1*c* (contacts 44) of one of the two contact interface substrates 76 is electrically connected to the MICRO USB contact interface 2*c* (contacts 944) of the bottom side of the tongue 921 of the bidirectional simplex MICRO USB electrical connection socket 904. In addition, the fitting portion 75 of a bidirectional duplex MICRO USB electrical connection plug 108 and the connection slot 96 of the bidirectional simplex MICRO USB electrical connection socket 904 can achieve the better fitting. So, this is different from FIG. 37, in which a too large space is still left when the contact interface substrate 76 is in the large space 162.

Figure 41:
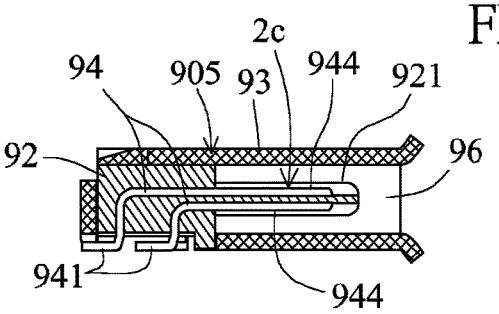
FIG. 41 is a side cross-sectional view showing a duplex socket according to the third embodiment of the invention.
Figure 42:
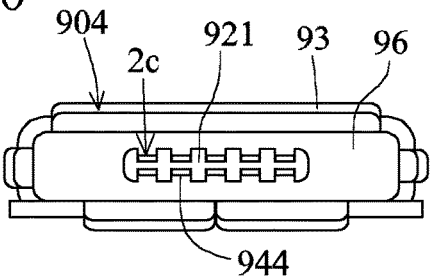
FIG. 42 is a front view showing the duplex socket according to the third embodiment of the invention.

Referring to FIGS. 41 and 42, a MICRO USB bidirectional duplex electrical connection socket 905 of this embodiment is almost the same as the bidirectional simplex MICRO USB electrical connection socket 904 except for the differences that the socket 905 further additionally has one row of first terminals 94, and that the top side of the tongue 921 is also formed with a MICRO USB contact interface 2*c*. The MICRO USB contact interfaces 2*c* of the top and bottom sides of the tongue 921 have the same contact interface and the connection points with the circuit serial numbers arranged reversely. The pins 941 of the two rows of first terminals 94 are arranged in a front row and a rear row, and the two rows of pins 941 have horizontal distal ends.

Figure 43:
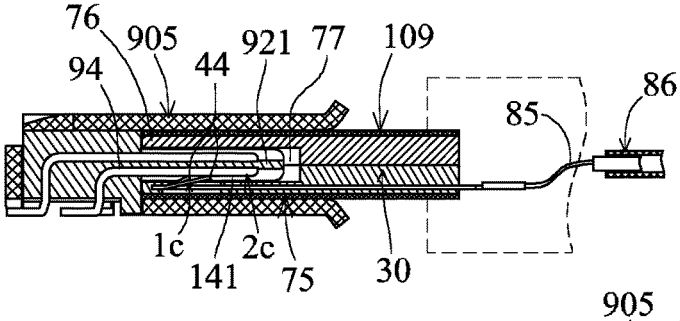
FIG. 43 is a side cross-sectional view showing a combination of the duplex socket and the simplex plug according to the third embodiment of the invention.

Referring to FIG. 43, a bidirectional simplex MICRO USB electrical connection plug 109 is inserted and connected to the MICRO USB bidirectional duplex electrical connection socket 905, wherein the bidirectional simplex MICRO USB electrical connection plug 109 is almost the same as the bidirectional duplex MICRO USB electrical connection plug 102 except for the difference that only one of the two contact interface substrates 76 of the fitting portion 75 has the MICRO USB contact interface 1*c*. So, the fitting portion 75 can be bidirectionally inserted into the connection slot 96 of the bidirectional duplex MICRO USB electrical connection socket 905, and the MICRO USB contact interface 1*c* (contacts 44) of the contact interface substrate 76 is inevitably electrically connected to the MICRO USB contact interface 2*c* (contacts 944) of one of the top and bottom sides of the tongue 921 of the bidirectional duplex MICRO USB electrical connection socket 905.

Five contacts 44 having the connection points with the circuit serial numbers arranged in order of only one of the two contact interface substrates 76 of the bidirectional simplex MICRO USB electrical connection plug 109 have only one pair of USB 2.0 signal contacts D+, D−.

Figure 44:
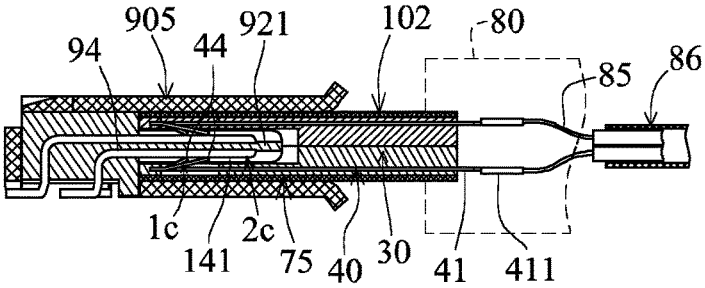
FIG. 44 is a side cross-sectional view showing a combination of the duplex socket and the duplex plug according to the third embodiment of the invention.

Referring to FIG. 44, the bidirectional duplex MICRO USB electrical connection plug 102 is inserted and connected to the MICRO USB bidirectional duplex electrical connection socket 905, wherein each of the wiring portions 411 of the pins 41 of the two rows of first terminals 40 is connected to a wire 85, so that the connection cable 86 has two sets of five wires 85 (10 wires in total) thereinside. Thus, the two MICRO USB contact interfaces 1*c* and 2*c* of the plug and the socket can be bidirectionally connected together to achieve the effects of the convenient use and the doubled transmission speed.

MICRO USB has the minimum height specification currently specified by USB Association. The fitting slot of the connection portion of the standard MICRO USB electrical connection plug specified by USB Association has the height of 0.65 mm, wherein the contact interface substrate has the height of 0.9 mm; and the large space of the standard MICRO USB electrical connection socket is 0.97 mm, and the tongue thickness is 0.6 mm.

In the design according to the technical characteristics of the invention, the heights of the two contact interface substrates are smaller than 0.9 mm and the fitting space is 0.65 mm. So, the total height of the fitting portion of the plug of the invention may be smaller than 0.9 mm×2+0.65 mm=2.45 mm. The total height of the connection slot of the socket of the invention may be smaller than 0.97 mm×2+0.6 mm=2.54 mm.

Figure 45:
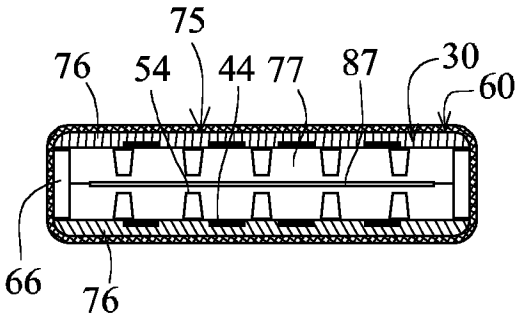
FIG. 45 shows a front cross-sectional view according to a fourth embodiment of the invention.

Referring to FIG. 45, a bidirectional duplex USB 3.0 electrical connection plug according to the fourth embodiment of the invention is almost the same as the second embodiment except for the difference that the insulating base 30 only forms the top and bottom sides of the fitting space 77 and does not integrally form the left and right sides. Each of the left and right sides of the metal housing 60 has at least one inwardly projecting projection 66 to form the left and right sides of the fitting space 77, wherein the at least two projections 66 function as a positioning structure resting and positioning the insulating layers of the two contact interface substrates 76 without approaching each other.

Figure 46:
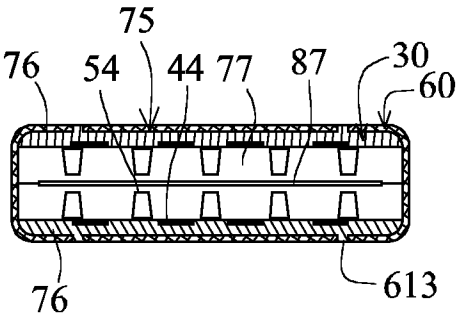
FIG. 46 shows a front cross-sectional view according to a fifth embodiment of the invention.

Referring to FIG. 46, the fifth embodiment of the invention is almost the same as the fourth embodiment except for the differences that the positioning structure has openings 613 on the top and bottom sides of the front segment of the metal housing 60, and that the front segment of the insulating base 30 is hot-molten and combined with the openings 613, so that the insulating layer of the inside layer and the metal housing of the outside layer of the two contact interface substrates 76 are combined and fixed together.

Figure 47:
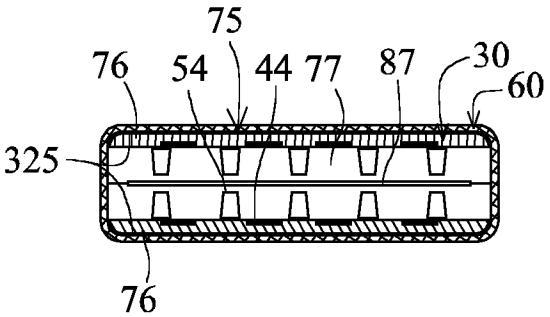
FIG. 47 shows a front cross-sectional view according to a sixth embodiment of the invention.

Referring to FIG. 47, the sixth embodiment of the invention is almost the same as the fifth embodiment except for the difference that the positioning structure has an adhesive 325 between the insulating layer of the inside layer and the metal housing of the outside layer of the two contact interface substrates 76 to combine and fix them together.

The tongue of the standard MINI USB electrical connection socket specified by USB Association has the height of 1.6 mm, wherein the small space has the height of 0.45 mm, the large space 162 has the height of 1.05 mm, and the connection slot 16 has the height of 3.1 mm. The contact interface substrate 25 of the standard MINI USB electrical connection plug 201 specified by USB Association has the height of 0.9 mm, wherein the fitting slot 24 has the height of 1.8 mm, the metal housing 21 has the thickness of 0.3 mm, and the total height is 3 mm.

The invention may also be applied to a bidirectional duplex MINI USB electrical connection plug, which may be bidirectionally correspondingly connected to a standard MINI USB electrical connection socket, wherein each of the two contact interface substrates has a MINI USB contact interface, the MINI USB contact interface comprises elastically non-movable contacts of one row of five terminals, the heights of the two contact interface substrates of the fitting portion are the same and equal to about 0.4 mm, and the fitting space is about 1.8 mm. So, the height of the fitting portion is about 2.6 mm, which is significantly lower than the height (3 mm) of the connection portion of the standard MINI USB electrical connection plug. However, the height of the contact interface substrate 76 may be designed to range between 0.35 mm and 0.5 mm, and the height of the fitting portion 75 may range between 2.5 mm and 2.8 mm.

In addition, in order to facilitate the manufacturing, the height of the contact interface substrate of the bidirectional duplex MINI USB electrical connection plug may range between 0.35 mm and 0.9 mm, the height of the fitting portion may range between 2.5 mm and 3.6 mm, and the connection slot of the matched MINI USB electrical connection socket forms symmetrical spaces on two opposite sides of the tongue. The height of the symmetrical space may range between 0.4 mm and 0.95 mm, and the connection slot has the height ranging between 2.45 mm and 3.65 mm.

At present, the standard electrical connection sockets with the biased tongues specified by USB Association comprise the above-mentioned A-type, MICRO and MINI. The design of the invention can be bidirectionally inserted into and connected to the three standard electrical connection sockets.

Figure 48:
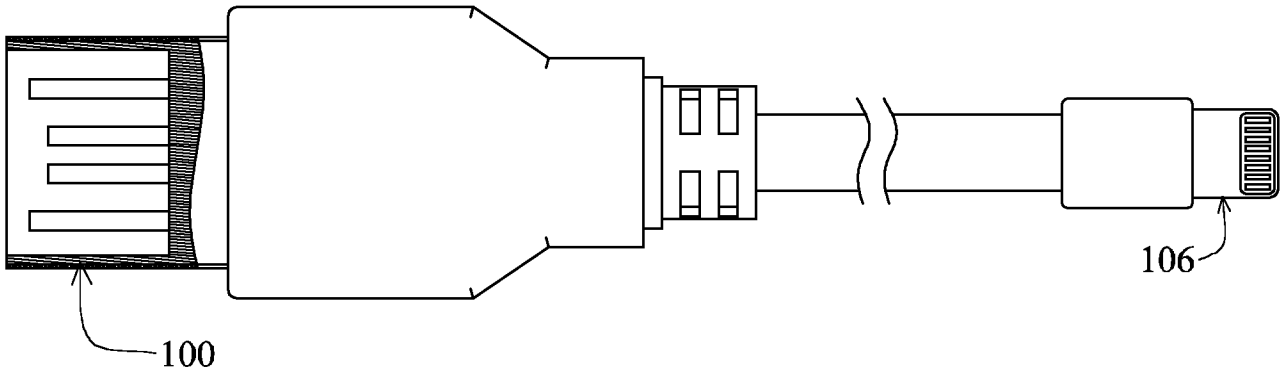
FIG. 48 shows a top view according to a seventh embodiment of the invention.
Figure 48A:
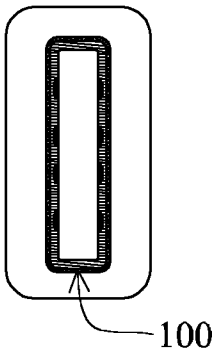
FIG. 48A shows a cross-sectional view according to the seventh embodiment of the invention.

Referring to FIGS. 48 and 48A, the seventh embodiment of the invention is an adapter cable, which has one end connected to a bidirectional duplex USB 2.0 electrical connection plug 100, and the other end connected to an APPLE bidirectional duplex electrical connection plug 106. The bidirectional duplex USB 2.0 electrical connection plug 100 is the same as the first embodiment. The APPLE bidirectional duplex electrical connection plug 106 is a plate-sheet like connector, wherein each of two sides of the plate sheet thereof has a contact interface having one row of eight elastically non-movable connection points.

Figure 49:
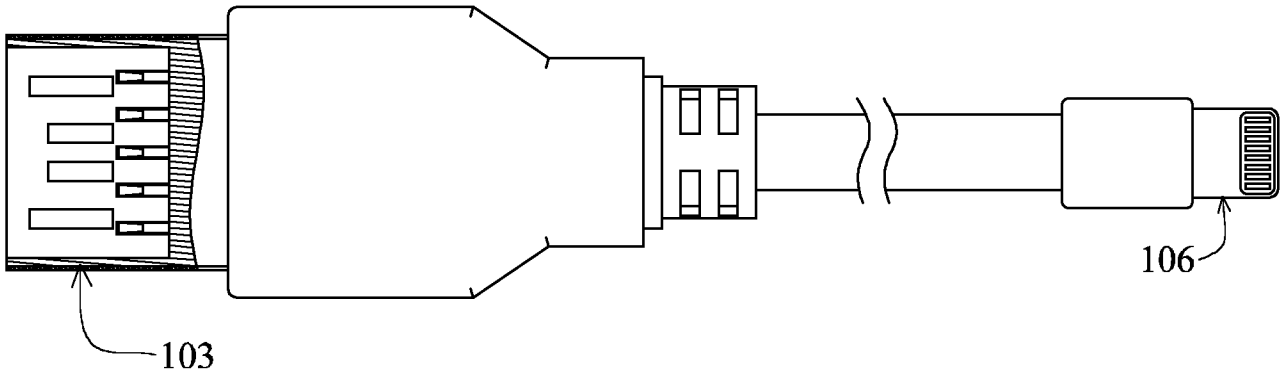
FIG. 49 shows a top view according to an eighth embodiment of the invention.
Figure 49A:
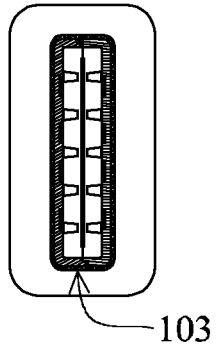
FIG. 49A shows a cross-sectional view according to the eighth embodiment of the invention.

Referring to FIGS. 49 and 49A, the eighth embodiment of the invention is an adapter cable, which has one end connected to a bidirectional duplex USB 3.0 electrical connection plug 103, and the other end connected to an APPLE bidirectional duplex electrical connection plug 106, wherein the bidirectional duplex USB 2.0 electrical connection plug 103 is the same as the second embodiment.

Figure 50:
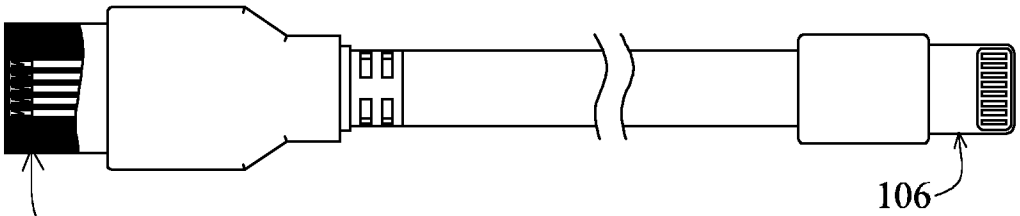
FIG. 50 shows a top view according to a ninth embodiment of the invention.
Figure 50A:
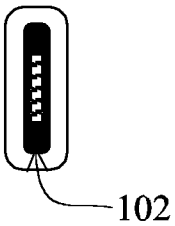
FIG. 50A shows a cross-sectional view according to the ninth embodiment of the invention.

Referring to FIGS. 50 and 50A, the ninth embodiment of the invention is an adapter cable, which has one end connected to a bidirectional duplex MICRO USB electrical connection plug 102, and the other end connected to an APPLE bidirectional duplex electrical connection plug 106, wherein the bidirectional duplex USB 2.0 electrical connection plug 102 is the same as the third embodiment.

Figure 51:
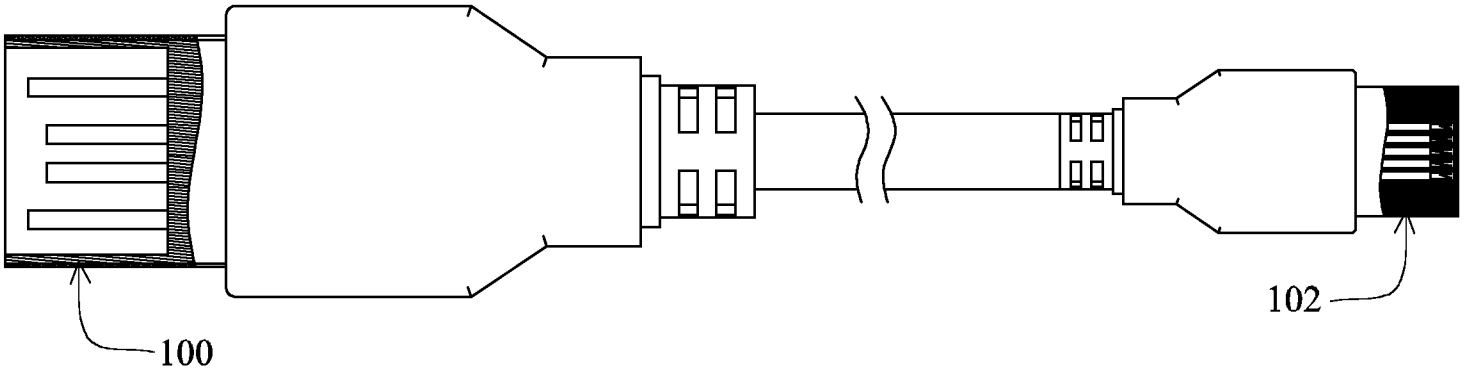
FIG. 51 shows a top view according to a tenth embodiment of the invention.
Figure 51A:
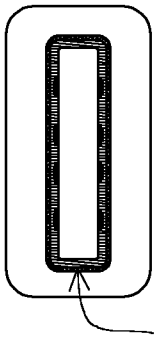
FIG. 51A shows a cross-sectional view according to the tenth embodiment of the invention.

Referring to FIGS. 51 and 51A, the tenth embodiment of the invention is an adapter cable, which has one end connected to a bidirectional duplex USB 2.0 electrical connection plug 100, and the other end connected to a bidirectional duplex MICRO USB 2.0 electrical connection plug 102.

Referring to FIGS. 52 to 57, the eleventh embodiment of the invention provides a bidirectional MICRO USB electrical connection plug and a bidirectional MICRO USB electrical connection socket.

Figure 52:
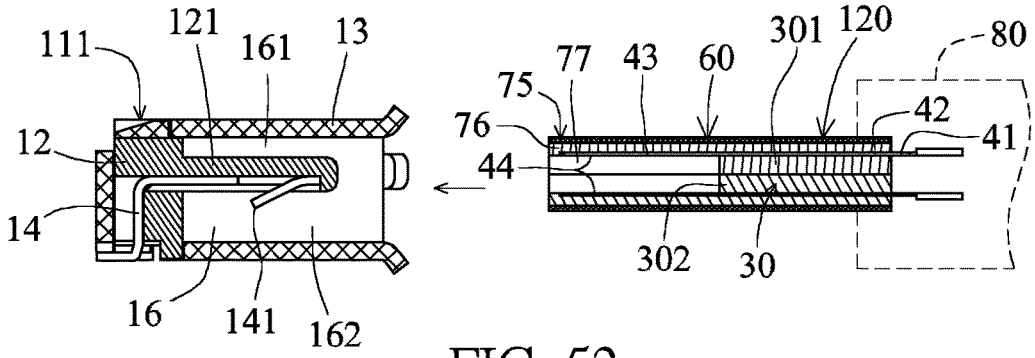
FIG. 52 shows a side cross-sectional exploded view according to an eleventh embodiment of the invention.
Figure 53:
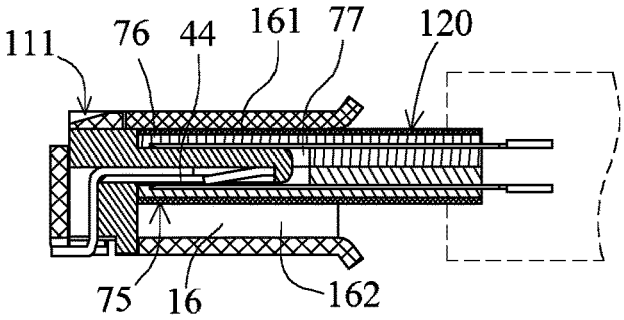
FIG. 53 shows a side cross-sectional combination view according to the eleventh embodiment of the invention.
Figure 54:
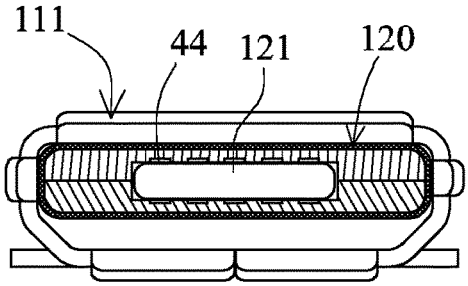
FIG. 54 shows a front cross-sectional combination view according to the eleventh embodiment of the invention.

Referring to FIGS. 52 to 54, a bidirectional duplex MICRO USB electrical connection plug 120 and a correspondingly connected standard MICRO USB electrical connection socket 111 of this embodiment are almost the same as the third embodiment except for the differences that the contact 44 of the bidirectional duplex MICRO USB electrical connection plug 120 is elastically non-movable, and that the contact 141 of the standard MICRO USB electrical connection socket 111 is vertically elastically movable.

Figure 55:
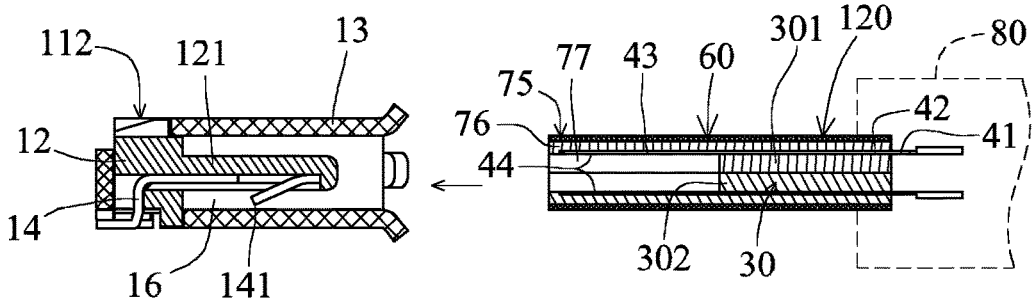
FIG. 55 shows a side cross-sectional exploded view according to the eleventh embodiment of the invention.
Figure 56:
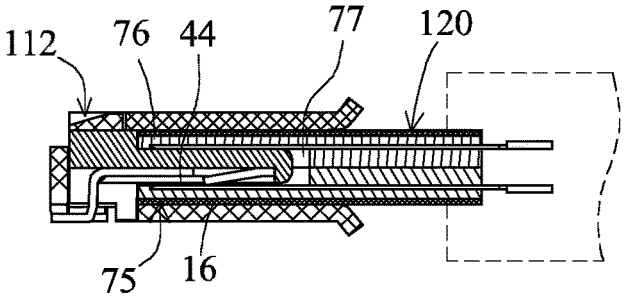
FIG. 56 shows a side cross-sectional combination view according to the eleventh embodiment of the invention.
Figure 57:
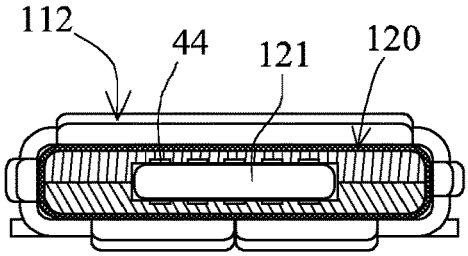
FIG. 57 shows a front cross-sectional combination view according to the eleventh embodiment of the invention.

Referring to FIGS. 55 to 57, the bidirectional duplex MICRO USB electrical connection plug 120 and a bidirectional simplex MICRO USB electrical connection socket 112 are provided, wherein the tongue 121 of the bidirectional simplex MICRO USB electrical connection socket 112 is disposed at the middle height of the connection slot 16, and symmetrical spaces are formed on the top and bottom sides of the tongue 121.

Referring to FIGS. 58 to 63, the twelfth embodiment of the invention provides a bidirectional low-height electrical connection plug and a bidirectional low-height electrical connection socket.

Figure 58:
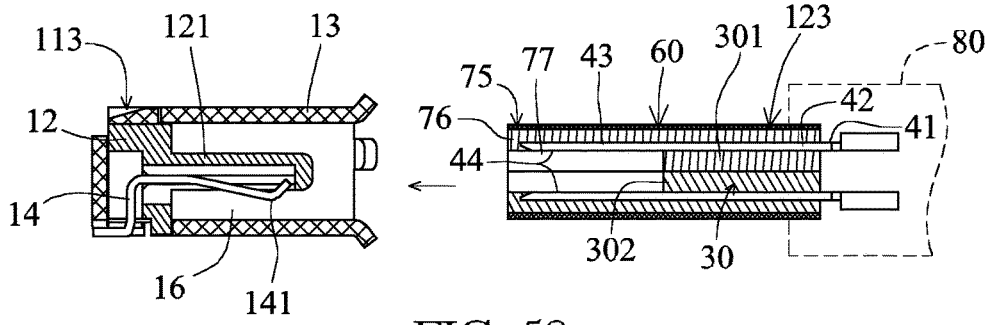
FIG. 58 shows a side cross-sectional exploded view according to a twelfth embodiment of the invention.
Figure 59:
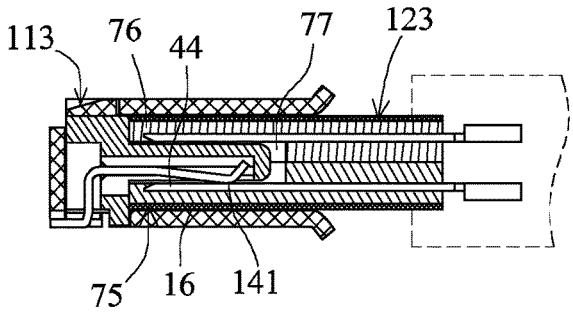
FIG. 59 shows a side cross-sectional combination view according to the twelfth embodiment of the invention.
Figure 60:
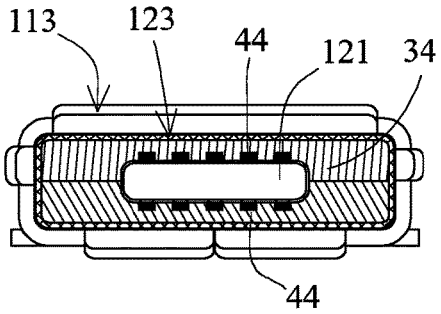
FIG. 60 shows a front cross-sectional combination view according to the twelfth embodiment of the invention.

Referring to FIGS. 58 to 60, a bidirectional duplex low-height electrical connection plug 123 and a bidirectional simplex low-height electrical connection socket 113 are provided and almost the same as the eleventh embodiment except for the difference that this embodiment has the middle size design. That is, the height of the contact interface substrate 76 of the bidirectional duplex low-height electrical connection plug 123 ranges between 0.3 mm and 0.9 mm, wherein the fitting space 77 ranges between about 0.7 mm and 0.8 mm, and the total height ranges between about 1.3 mm and 2.5 mm. The height of the tongue 121 of the bidirectional simplex low-height electrical connection socket 112 ranges between about 0.65 mm and 0.75 mm. The heights of the two symmetrical spaces on the top and bottom sides of the tongue 121 range between 0.35 mm and 0.95 mm, and the height of the connection slot 16 ranges between 1.35 mm and 2.65 mm, so that the connector can be easily manufactured and become slim and light.

The height of the contact interface substrate 76 of the bidirectional duplex low-height electrical connection plug 123 of this embodiment is about 0.55 mm, the fitting space 77 is about 0.7 mm, the total height is about 1.8 mm, and the height of the tongue 121 of the bidirectional simplex low-height electrical connection socket 113 is about 0.65 mm. The heights of the two symmetrical spaces on the top and bottom sides of the tongue 121 are about 0.6 mm, and the height of the connection slot 16 is about 1.85 mm.

Figure 61:
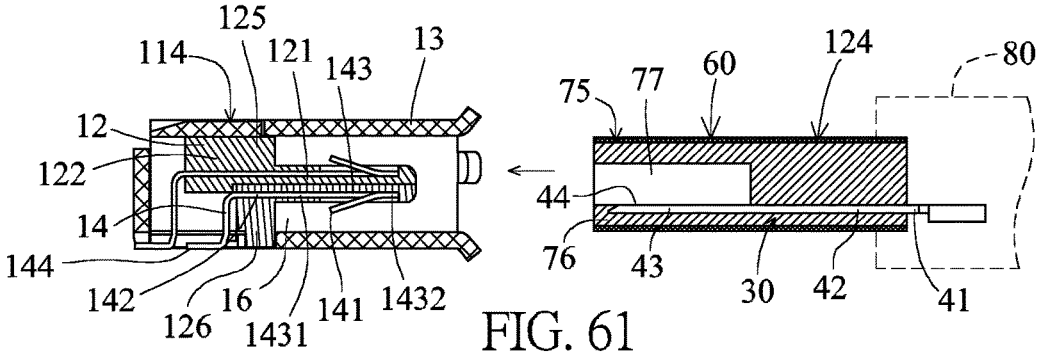
FIG. 61 shows a side cross-sectional exploded view according to the twelfth embodiment of the invention.
Figure 62:
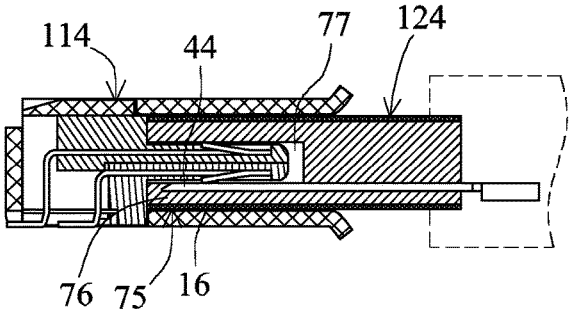
FIG. 62 shows a side cross-sectional combination view according to the twelfth embodiment of the invention.

Referring to FIGS. 61 and 62, a bidirectional simplex low-height electrical connection plug 124 and a bidirectional duplex low-height electrical connection socket (also referred to as an adapted connector) 114 are provided, wherein the bidirectional simplex low-height electrical connection plug 124 only has one row of first terminals 40. So, only one contact interface substrate 76 has one row of contacts 44, and the bidirectional duplex low-height electrical connection socket 114 has two rows of first terminals 14. The insulating base 12 has a base 122 and a tongue 121. The front end of the base 122 is projectingly formed with the tongue 121. The thickness of the base 122 is larger than that of the tongue 121. Each of the top and bottom sides of the tongue 121 is provided with one row of contacts 141 of terminals, and the insulating base 12 is formed by stacking the upper base 125 and the lower base 126. The upper and lower bases 125 and 126 are embedded and injection molded with the one row of first terminals 14.

Each first terminal is integrally provided with a pin 144, a fixing portion 142 and an extension 143. The fixing portion 142 is fixed to the insulating base 12. The extension 143 is connected to the front end of the fixing portion 142, extends to the tongue 121 and has a contact 141. The contact 141 projects beyond the bottom surface of the tongue 121 and is vertically elastically movable. The pin 144 connected to the rear end of the fixing portion 142 and extends out of the insulating base. The contacts 141 of the one row of first terminals 14 form the MICRO USB 2.0 contact interface.

The extension of each first terminal has an inner section 1431, which is embedded into, injection molded with and fixed to the inner section of the tongue 121, and an outer section 1432, which is embedded into, injection molded with and fixed to the outer section of the tongue 121 and exposes the outer sections of the two connection surfaces. The plate surface of the outer section 1432 of the extension is prodded to form the projecting contact 141.

Figure 63:
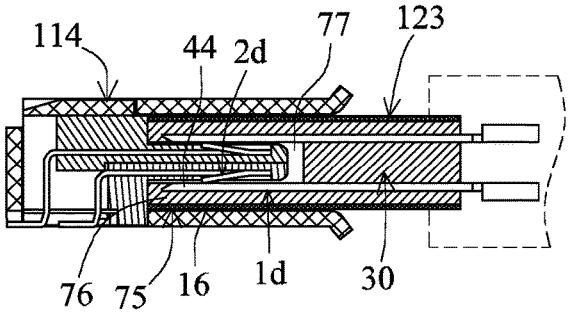
FIG. 63 shows a side cross-sectional combination view according to the twelfth embodiment of the invention.
Figure 64:
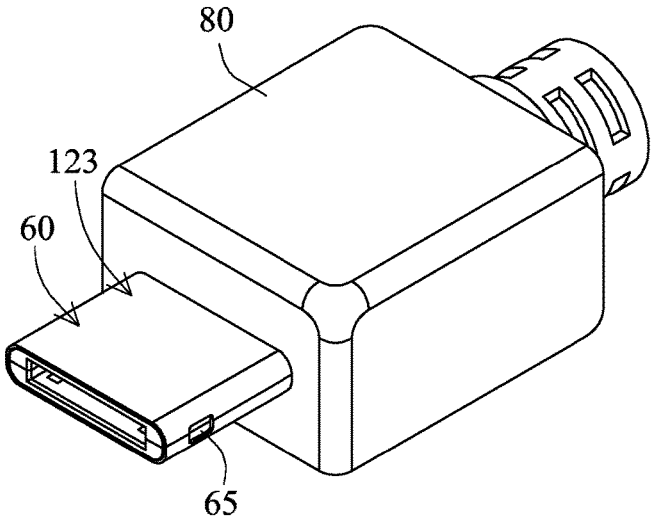
FIG. 64 is a pictorial view showing a plug according to a thirteenth embodiment of the invention.
Figure 65:
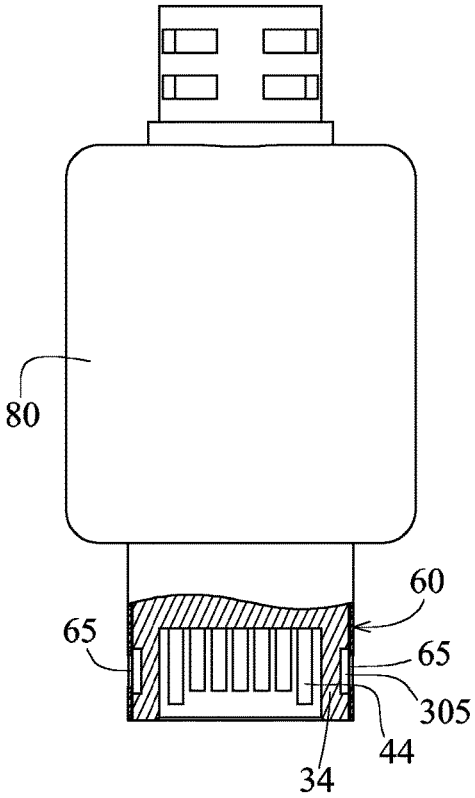
FIG. 65 is a top cross-sectional view showing the plug according to the thirteenth embodiment of the invention.
Figure 66:
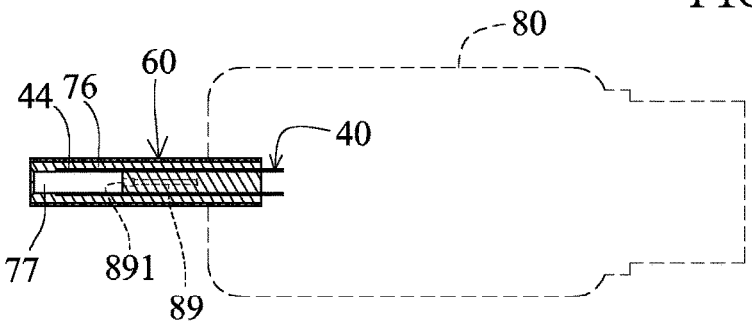
FIG. 66 is a side cross-sectional view showing the plug according to the thirteenth embodiment of the invention.
Figure 67:
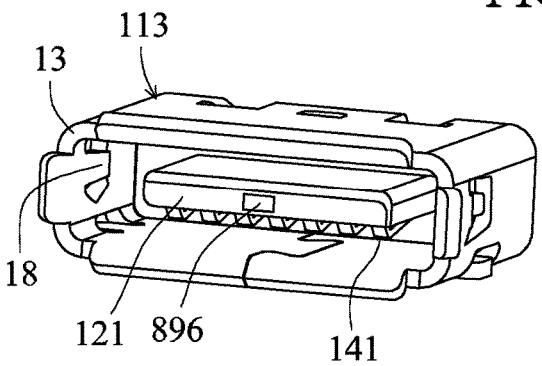
FIG. 67 is a pictorial view showing a socket according to the thirteenth embodiment of the invention.
Figure 68:
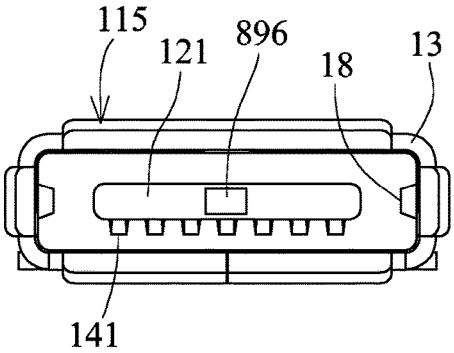
FIG. 68 is a front view showing the socket according to the thirteenth embodiment of the invention.

Referring to FIG. 63, the bidirectional duplex low-height electrical connection plug 123 and a bidirectional duplex low-height electrical connection socket 114 are correspondingly connected together. The insulating base 12 of the bidirectional duplex low-height electrical connection plug 123 is integrally embedded and injection molded with two rows of first terminals, so that the doubled transmission speed can be achieved. The two contact interfaces 1*d* and 2*d* of the plug and socket have the same contact interface, and the two contact interfaces have the connection points with the circuit serial numbers arranged reversely.

In addition, the contact interface of the low-height electrical connection plug may also be designed to have the vertically elastically movable contacts, and the contact interface of the low-height electrical connection socket is designed to have elastically non-movable contacts.

Referring to FIGS. 64 to 68, the thirteenth embodiment of the invention provides a bidirectional duplex low-height electrical connection plug 123 and a bidirectional simplex low-height electrical connection socket 113, and is almost the same as the twelfth embodiment except for the differences that the contact interface of the bidirectional duplex low-height electrical connection plug 123 of this embodiment has seven elastically non-movable contacts 44, and at least one optical fiber cable 89. The optical fiber cable 89 has a connection point 891 at the inner end of the fitting space 77. The top and bottom surfaces of the two contact interface substrates 76 perpendicularly corresponding to the metal case 60 are hole-free structures, each of left and right sides of the fitting space 77 is provided with a metallic engaging structure. That is, each of the left and right sides of the metal housing 60 has an engaging portion 65. The engaging portion 65 is an engagement hole, and each of the two sidewalls 34 of the insulating base also correspondingly has a slot 305 to provide the larger engaging depth. The contact interface of the low-height electrical connection socket has seven vertically elastically movable contacts 141, and at least one optical fiber cable. The optical fiber cable has a connection point 896 at the front end of the tongue 121 to match with the connection point 891 of the electrical connection plug. Each of the left and right sides of the metal housing 13 has an inwardly projecting engaging portion 18. The engaging portion 18 is a resilient fastener. The engaging portion 18 can engage with the engaging portion 65 of the plug to prevent the plug from detaching in a direction opposite to the docking direction. Because the engaging portion 18 engages with the engaging portion 65 by the larger depth, the engaging snap or hand feeling is provided when the plug is inserted into the socket.

Multiple portions of the metal housing 13 perpendicularly corresponding to two connection surfaces of the tongue 121 of the socket are respectively hole-free structures (structures without holes or openings). In the above-mentioned socket, each of two connection surfaces of the tongue 121 may also be provided with a contact interface to form a bidirectional duplex electrical connection socket.

Figure 69:
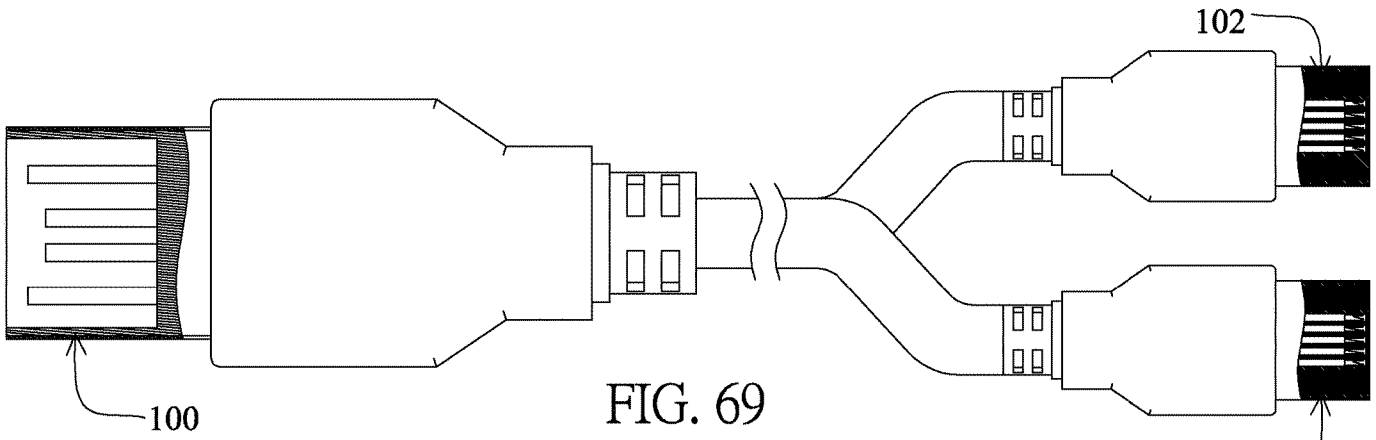
FIG. 69 shows a top cross-sectional view according to a $14^{th}$ embodiment of the invention.
Figure 69A:
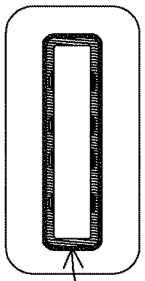
FIG. 69A is a front cross-sectional view showing the plug at one end according to the $14^{th}$ embodiment of the invention.
Figure 72:
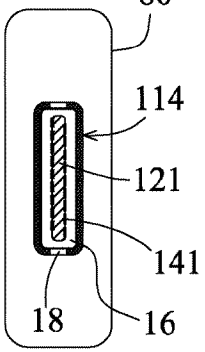
FIG. 72 is a front cross-sectional view showing the socket at the other end according to the $15^{th}$ embodiment of the invention.
Figure 70:
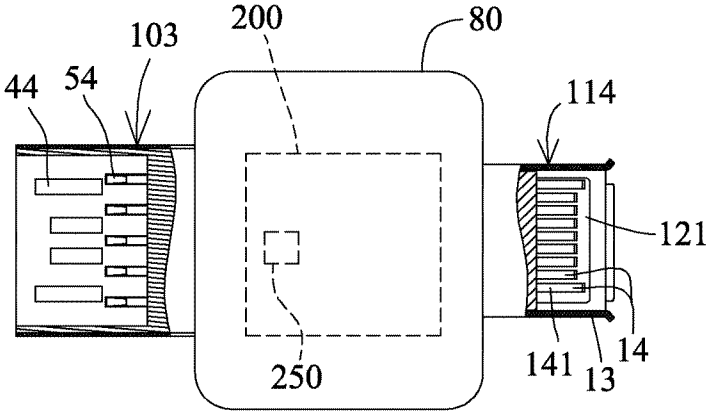
FIG. 70 shows a top cross-sectional view according to a $15^{th}$ embodiment of the invention.
Figure 71:
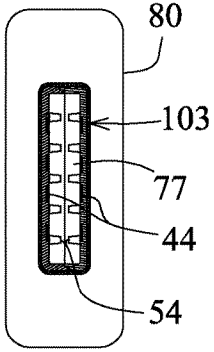
FIG. 71 is a front cross-sectional view showing the plug at one end according to the $15^{th}$ embodiment of the invention.
Figure 73:
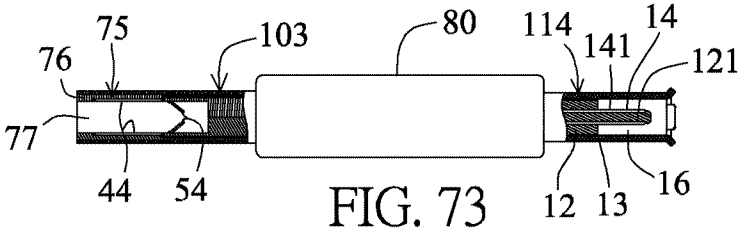
FIG. 73 shows a side cross-sectional view according to the $15^{th}$ embodiment of the invention.

Referring to FIGS. 69 and 69A, the electronic device according to the $14^{th}$ embodiment of the invention is an adapter cable, which has one end connected to a bidirectional duplex USB 2.0 electrical connection plug 100, and the other end is adapted into two bidirectional duplex MICRO USB electrical connection plugs 102.

Referring to FIGS. 70 to 73, the electronic device according to the $15^{th}$ embodiment of the invention is an adapter having a circuit board 200 as a transmission medium. The adapter has a housing 80. The circuit board 200 is disposed inside the housing 80. At least one connection point switching device 250 is disposed on the circuit board 200. The adapter has one end having a bidirectional duplex USB 3.0 electrical connection plug 103, and the other end having a middle-size bidirectional duplex low-height electrical connection socket 114. The structures of two rows of terminals 14, the metal housing 13 and the insulating base 12 thereof are substantially the same as those of the two rows of terminals 94, the metal housing 93 and the insulating base 92 of the socket of FIG. 41. The two rows of terminals 14 are also provided with two rows of pins, which are the same as the two rows of pins 941 of the tow rows of terminals 94 of the socket of FIG. 41. Each of the top and bottom sides of the tongue 121 has nine elastically non-movable contacts 141 in flat surface contact with the tongue, and the nine elastically non-movable contacts 141 correspond to nine circuit connection points of the bidirectional duplex USB 3.0 electrical connection plug 103, wherein two long ones and seven short ones are arranged into two rows of elastically non-movable contacts 141. In addition, two longer contacts 141 are respectively arranged on two outer sides of the connection surface of the tongue 121. The structures of the two rows of terminals 14, the metal housing 13 and the insulating base 12 are substantially the same as those of the socket of FIG. 41. So, the upper and lower surfaces of the tongue 121 have nine contacts 141, which similarly comprise the three pairs of USB 3.0 signal contacts, represented as D+, D−; RX+, RX−; TX+, TX−, respectively. In addition, each of left and right sides of the metal housing 13 has an engaging portion 18, which is an engagement hole (see FIG. 72). The two contact interfaces of the bidirectional duplex USB 3.0 electrical connection plug 103 and the two contact interfaces of the bidirectional duplex low-height electrical connection socket 114 are electrically connected to the circuit board 200, and perform the connection point integration and switching the corresponding circuit connection point transmission when the two contact interfaces are bidirectionally electrically connected together through the connection point switching device 250.

In addition, the adapter cable of each of the ninth, tenth and fourteenth embodiments also has the connection point switching integrated device to perform the connection point integration and switching the corresponding circuit connection point transmission between different contact interfaces when the two contact interfaces are bidirectionally electrically connected together.

In addition, either the adapter cable or the adapter, the bidirectional electrical connectors on two ends thereof may be sockets or plugs, may have a single contact interface or a dual contact interface, wherein both the contact interfaces have some elastically non-movable contacts or all elastically non-movable contacts.

The above-mentioned various embodiments are almost applied to the insertion and connection plugs of the connection cable or the adapter cable. However, the invention still can be applied to many other electronic devices, such as the insertion and connection plugs of a mobile disk, a wireless transceiver, an electrical adapter connector, an IC controller, an electric home apparatus and the like.

In addition, because the bidirectional duplex plug or socket of the invention has two contact interfaces, it may also be used in conjunction with a Schottky diode to provide the circuit safety protection of anti-sort-circuit or anti-backflow. However, the circuit safety protection effect may also be achieved by many ways, such as the provision of the anti-backflow electrical element, the anti-short-circuit electrical element, the circuit safety protection element, or the safety circuit configuration means. Such anti-short-circuit, anti-backflow circuit protection or safety circuit configurations are provided in Chinese Patent Invention Application Serial Numbers 201120320657.8 and 201020547846.4, and detailed descriptions thereof will be omitted.

Figure 75:
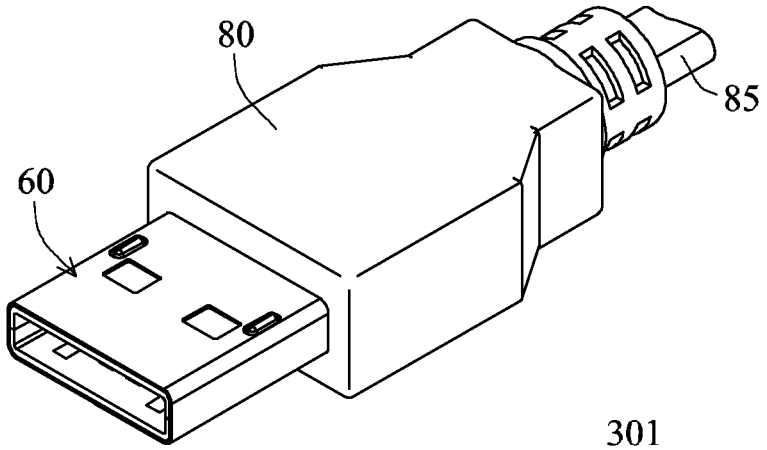
FIG. 75 shows a pictorially assembled view according to the $16^{th}$ embodiment of the invention.
Figure 74:
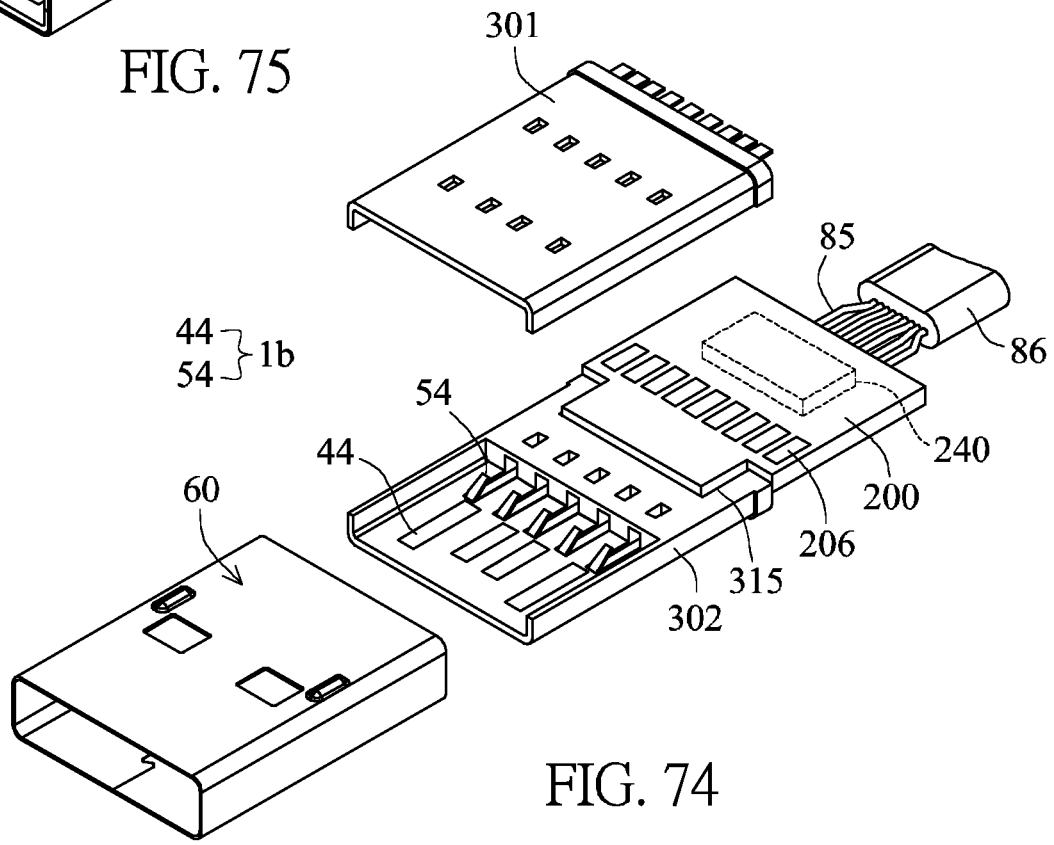
FIG. 74 shows a pictorially exploded view according to a $16^{th}$ embodiment of the invention.
Figure 76:
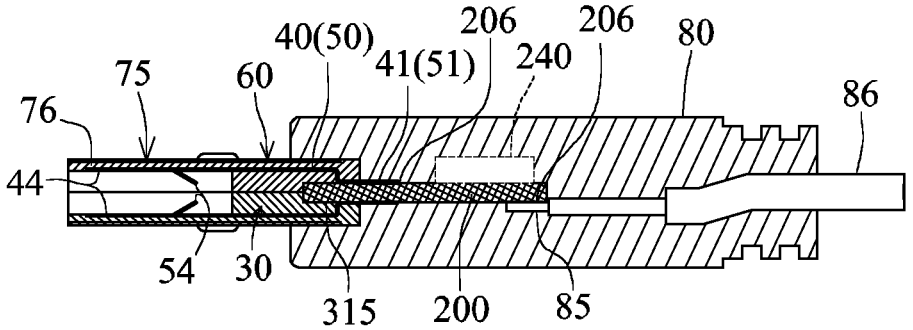
FIG. 76 shows a side cross-sectional view according to the $16^{th}$ embodiment of the invention.
Figure 77:
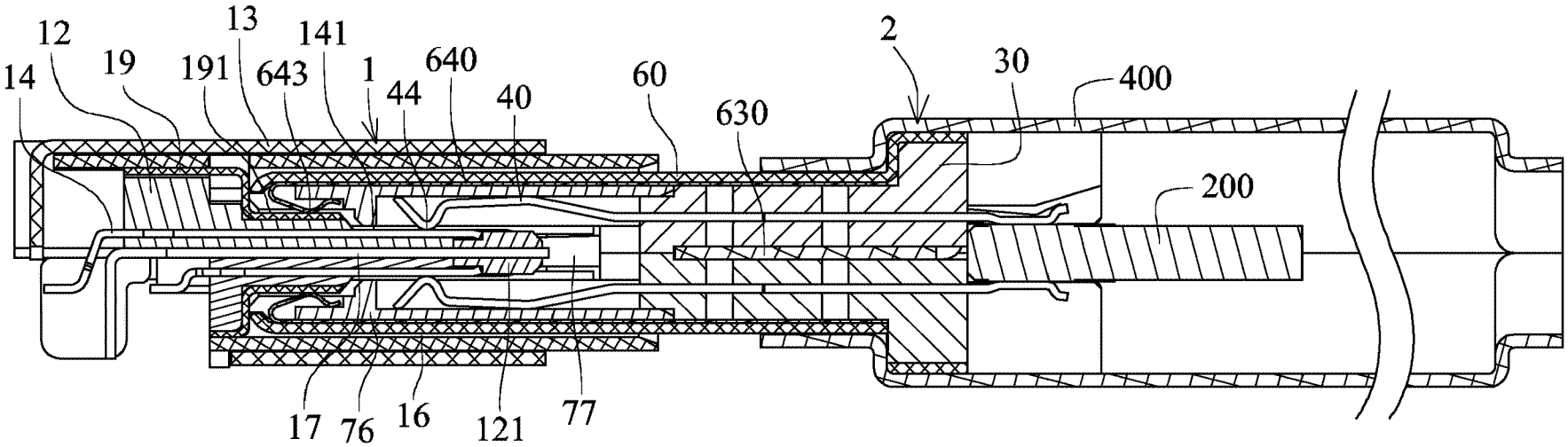
FIG. 77 is a side cross-sectional combination view showing the socket and the plug according to a $17^{th}$ embodiment of the invention.
Figure 78:
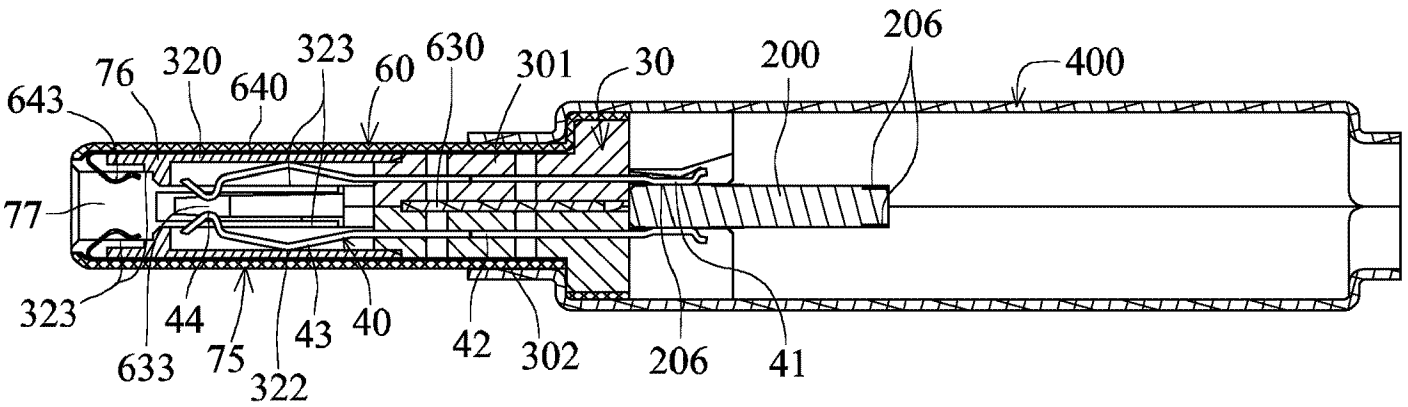
FIG. 78 is a side cross-sectional view showing the plug according to the $17^{th}$ embodiment of the invention.
Figure 80:
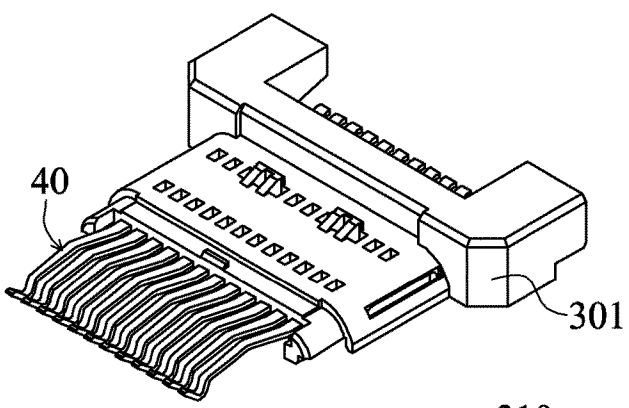
FIG. 80 is a pictorially exploded view showing the plug according to the $17^{th}$ embodiment of the invention.
Figure 80:
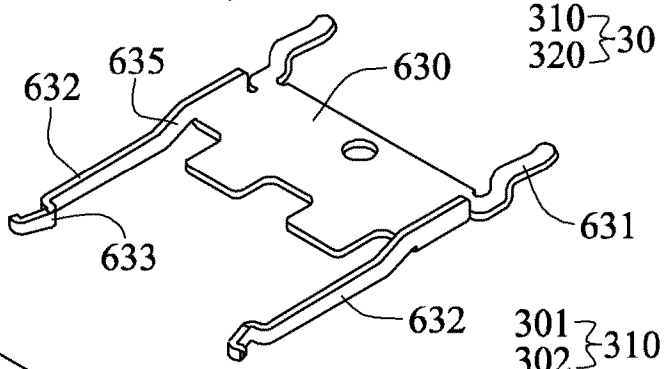
Figure 80:
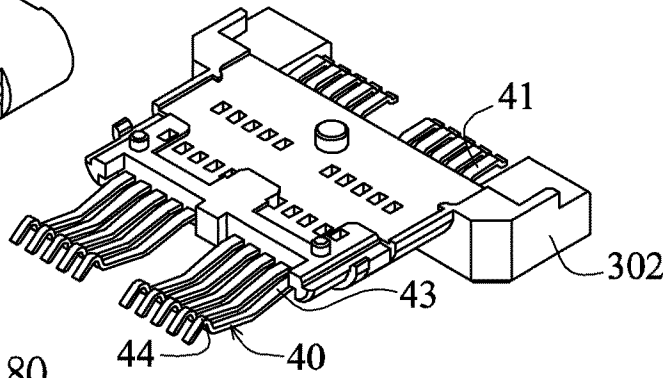

Referring to FIGS. 74 to 76, the 16$^{th}$ embodiment of the invention is a bidirectional duplex USB 3.0 electrical connection plug, which is almost the same as the second embodiment except for the differences that the rear segment of the insulating base 30 has a fitting slot 315 for engaging with a circuit board 200. Each of two sides of the front segment of the circuit board 200 has one row of connection points 206. One surface of the rear segment has one row of connection points 207. The two USB 3.0 contact interfaces 1*b* have the same contact interface and the connection points, which have the circuit serial numbers arranged reversely and are electrically connected to the one row of connection points 206, respectively. The connection points with the same circuit serial number of the two USB 3.0 contact interfaces 1*b* are electrically connected to the same circuit to form one set of circuits to the one row of connection points 207. One set of nine wires 85 inside a connection cable 86 (serving as the transmission medium) are electrically connected to the one row of connection points 207. In addition, a circuit safety protection device 240 is disposed on the circuit board 200. The circuit safety protection device 240 may have the circuit safety protection means such as the electronic anti-backflow or anti-short-circuit, such as a signal circuit processing control element, an anti-backflow electrical element, an anti-short-circuit electrical element, a Schottky diode, a circuit safety protection element or a safety circuit configuration means. The circuit safety protection device 240 can ensure that the circuit safety protection is possessed, and that the backflow, short-circuit or other poor conditions cannot occur when the two USB 3.0 contact interfaces are cascaded into one set of circuits.

The above-mentioned circuit safety protection device may be similarly applied to the bidirectional electrical connection socket of this invention.

Referring to FIGS. 77 to 85, the 17$^{th}$ embodiment of the invention provides a bidirectional duplex USB TYPE-C electrical connection socket 1 and a bidirectional duplex USB TYPE-C electrical connection plug 2 correspondingly connected together, and is almost the same as the third embodiment.

Referring to FIGS. 78 to 82, the bidirectional duplex USB TYPE-C electrical connection plug 2 has an insulating base 30, two terminal sets, a metal housing 60, a metal partition plate 630, a ground shielding member 640, a circuit board 200 and a rear shielding casing 400.

The insulating base 30 has a base 310 and a fitting member 320. The base 310 has an upper base 301 and a lower base 302 vertically stacked together. The fitting member 320 is fit with the front end of the base. The fitting member 320 has two vertically opposite insulating layers 761 at the same height, and has two side plates 34 connected to the two insulating layers 761 to form an insulating fitting frame body, so that the front end of the fitting member 320 is an insertion port, and the rear end thereof is a fitting port. The opposite surfaces of the two insulating layers 761 are in the form of two connection surfaces 323 with opposite directions. A fitting space 77 is formed between the two connection surfaces 323. Each of the rear segments of the inner surfaces of two insulating layers 761 has one row of separated separation columns to form one row of slots 322. The two connection surfaces 323 have the front segments and the rear segments higher than the front segments, so that the height of the front segment of the fitting space 77 is higher than the height of the rear segment of the fitting space 77. Each of the front ends of the two insulating layers 761 has three openings 328, and each of the side plates thereof has an opening 329.

Figure 79:
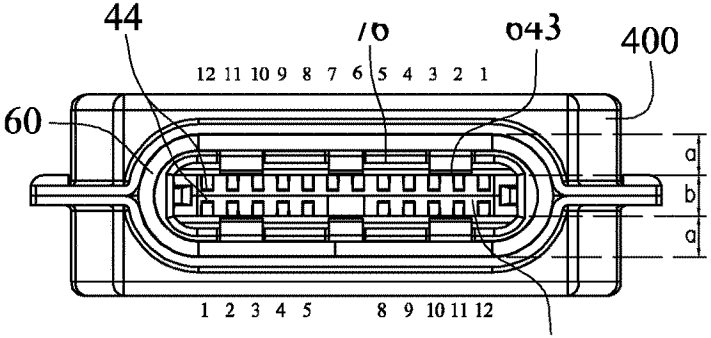
FIG. 79 is a front view showing the plug according to the $17^{th}$ embodiment of the invention.
Figure 81:
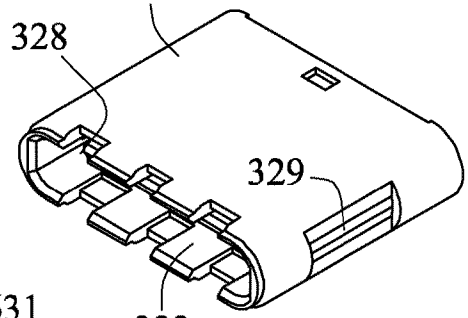
FIG. 81 is a pictorial view showing a fitting member of the plug according to the $17^{th}$ embodiment of the invention.
Figure 81:
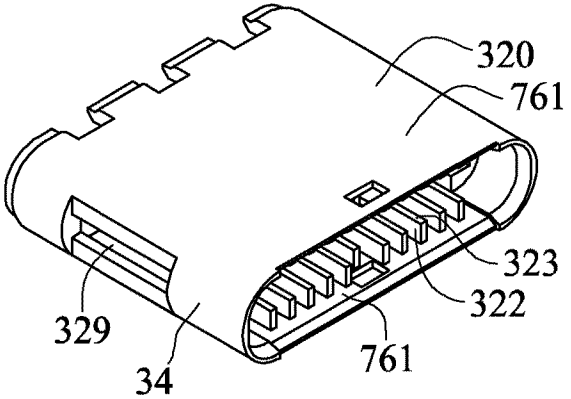
Figure 82:
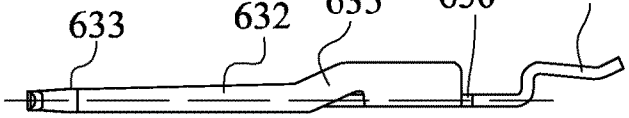
FIG. 82 is a side view showing a metal partition plate of the plug according to the $17^{th}$ embodiment of the invention.

The two terminal sets are embedded, injected and fixed to the upper and lower bases of the insulating base 30, respectively. The two terminal sets are one row of 12 first terminals 40 and one row of 10 first terminals 40, respectively. Each first terminal 40 sequentially has, from one end to the other end, a pin 41, a fixing portion 42 and an extension 43. The fixing portion 42 is fixed to the base 31. The extension 43 connected to the front end of the fixing portion 42 extends to a position in front of the base 31, is covered by the fitting member 320, and is vertically elastically movable in the slot 322. The portion near the front end of the extension 43 is curved and projectingly formed with a contact 44. The contact 44 projects beyond the rear segment of the connection surface 323 to the fitting space 77. The pin 41 connected to the rear end of the fixing portion 42 projects beyond the rear end of the base. The contacts of the two rows of first terminals 40 having the same circuit serial number are arranged reversely, as shown in FIG. 79, wherein the contacts 44 of the lower terminal set have the connection points with the circuit serial numbers of 1, 2, 3, . . . , 11, 12 arranged from left to right. The contacts 44 of the upper terminal set have the connection points with the circuit serial numbers of 12, 11, . . . , 3, 2, 1 arranged from left to right. The lower terminal set has 10 terminals, and does not have the terminals having the contacts having the connection points with the circuit serial numbers of 6 and 7.

The metal partition plate 630 is assembled between the upper and lower bases 301 and 302 of the insulating base 30 to separate the two terminal sets from each other. Each of the left and right sides of the metal partition plate 630 integrally extends backwards to form a pin 631, and integrally extends frontwards to form a resilient fastener 632. A portion near the front end of the resilient fastener has an engaging projection 633 disposed on the left and right sides of the fitting space 77. The height of the engaging projection 633 is greater than the material thickness of the metal partition plate 630 and the engaging projection 633 is substantially disposed at the middle height of the fitting space 77. When the two resilient fasteners 632 elastically move in the left-to-right direction, the openings 329 of the two sides of the fitting member 320 can provide spaces for the two resilient fasteners 632. The rear end of the resilient fastener 632 has the plate surface vertically connected to the metal partition plate 630, and the rear segment formed with a bent portion 635 so that the front segment and the rear end form a vertical step, and the middle height of the engaging projection 633 is substantially disposed at the thickness center of the metal partition plate 630.

The ground shielding member 640 has a four-side closed case and is in a form of a second metal case. The upper and lower plate sheets of the four-side closed case are the two grounding shielding sheets. Each of the front ends of the two grounding shielding sheets is bent inwardly and inversely to form three elastic sheets. Each of the three elastic sheets is bent projectingly to form a contact 643. The ground shielding member 640 fits with and rests against the outside of the insulating base 30. The contacts 643 of the two grounding shielding sheets project beyond the front segments of the two connection surfaces 323, respectively. The contacts 44 of the two terminal sets are exposed from the rear segments of the two connection surfaces 323 and are closer to the middle height of the fitting space 77 than the contacts 643 of the two grounding shielding sheets.

The metal housing 60 covers the insulating base 30 and the ground shielding member 640. The front segment of the metal housing 60 is in the form of a four-side closed main case 61 covering and shielding the fitting member 320 to form a fitting portion 75. The shape of the fitting portion 75 can be bidirectionally positioned at a correspondingly connected connector in a duplex manner. The fitting portion 75 comprises two contact interface substrates 76 and the fitting space 77. The outside layer of the contact interface substrate 76 is the metal housing, and the inside layer thereof is the insulating layer 761.

The circuit board 200 is a printed circuit board having front and rear ends of top and bottom sides each having one row of connection points 206 with independent circuit connections. The circuit board 200 engages with the rear end of the insulating base 30. The pins 41 of the two terminal sets are welded to one row of connection points 206 of the front ends of the top and bottom sides, respectively, and the two pins 631 of the metal partition plate 630 are welded to the two connection points 206 of the front end of the top side.

The bidirectional duplex USB TYPE-C electrical connection plug 2 also has the low-height connector design, as shown in FIG. 79, wherein the height "a" of the two contact interface substrates 76 is about 0.8 mm, the height "b" of the fitting space 77 is about 0.8 mm, and the total height of the fitting portion 75 is about 2.4 mm.

Figures 83, 84, 85:
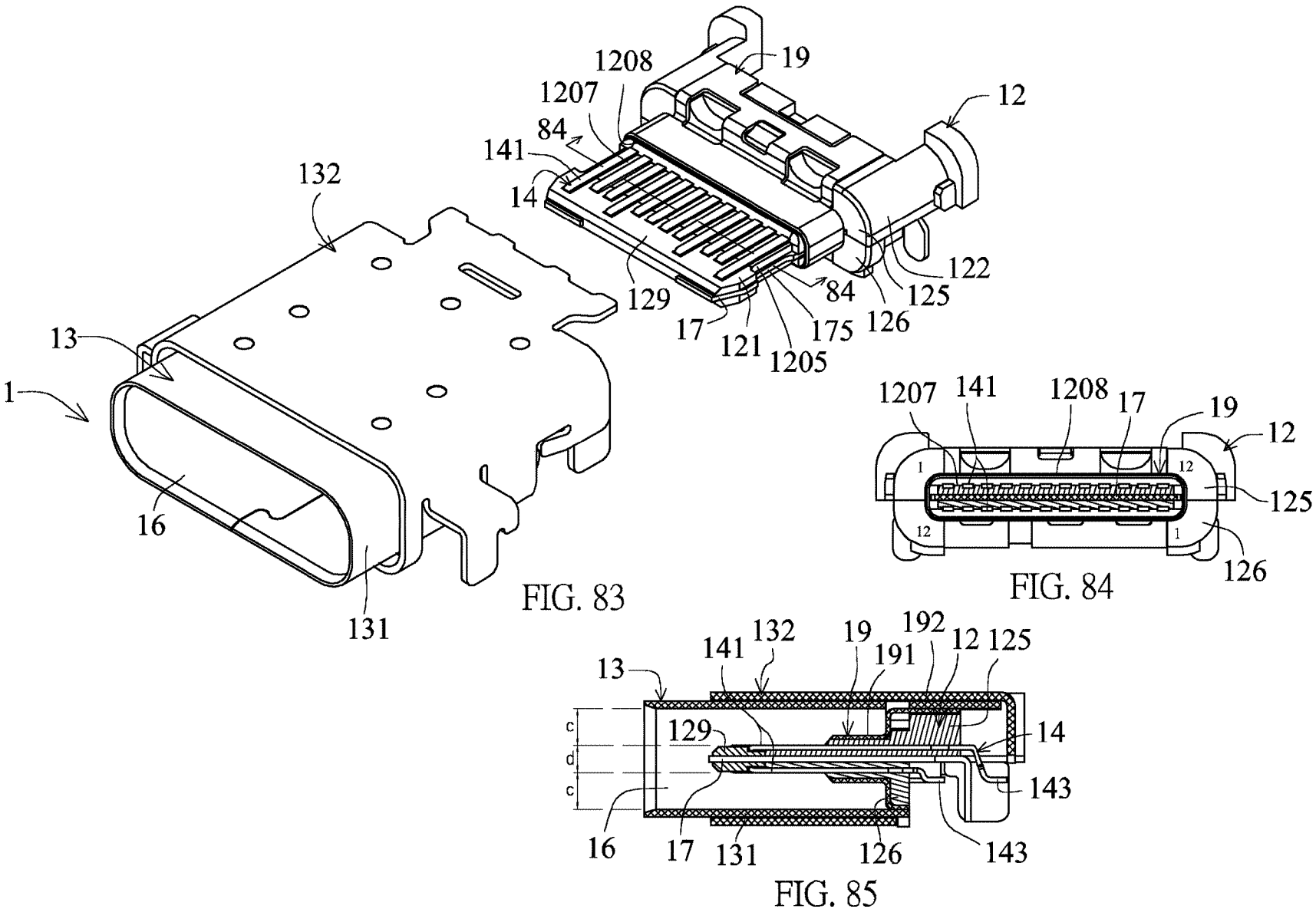
FIG. 83 is a side cross-sectional combination view showing the socket according to the $17^{th}$ embodiment of the invention.
FIG. 84 is a front view showing an insulating base of the socket according to the $17^{th}$ embodiment of the invention.
FIG. 85 is a side cross-sectional combination view showing the socket according to the $17^{th}$ embodiment of the invention.

Referring to FIGS. 83 to 85, a plate-depressed bidirectional duplex USB TYPE-C electrical connection socket 1 of this embodiment has an insulating base 12, two terminal sets, a ground shielding member 19, a metal partition plate 17, a metal housing 13 and a second metal case 132.

The insulating base 12 is a plastic material, and has a base 122 and a tongue 121. The front end of the base 122 is projectingly formed with the tongue 121. The top and bottom sides of the tongue 121 are two connection surfaces having larger plate surfaces. The inner segment of the tongue 121 is thicker than the outer segment and is inverse T shaped, so that the inner segments 1208 of the two connection surfaces project much more than the outer segments 1207 of the two connection surfaces. The insulating base 12 has a first base 125, a second base 126 and an outer tongue seat 129. The first and second bases 125 and 126 are vertically stacked, and the outer tongue seat 129 is connected to the outer ends of the first and second bases 125 and 126.

Each of the two terminal sets includes one row of twelve first terminals 14. The two terminal sets are embedded and injection molded to the first and second bases 125 and 126, respectively. Each of the first terminals 14 has one end extending to form a contact 141 and the other end extending to form a pin 143 projecting beyond the rear end of the base 122. The contacts 141 of the two terminal sets have first sides exposed from the outer segments 1207 of the two connection surfaces of the tongue 121, respectively, and second sides embedded into the tongue and fixed in a flat surface contact manner. So, the contacts 141 of the two terminal sets are not elastically movable, the contacts 141 of the two terminal sets have the same contact interface and are aligned in the vertical direction, and the two contact interfaces have the connection points with the circuit serial numbers arranged reversely, as shown in FIG. 84, wherein the upper row of contacts 141 have the connection points with the circuit serial numbers of 1 to 12 arranged from left to right, and the lower row of contacts 141 have the connection points with the circuit serial numbers of 1 to 12 arranged from right to left. In addition, the contacts 141 of the two terminal sets have two rows of different lengths (i.e., four long ones and eight short ones).

The metal housing 13 covers the insulating base 12, and rests against and engages with the base 122. The metal housing 13 has a four-side closed main case 131, and forms a connection slot 16 in conjunction with the front end of the base 122. The tongue 121 floats horizontally and is disposed at the middle height of the connection slot 16. Symmetrical spaces are formed on the two connection surfaces of the tongue 121. The shape of the connection slot 16 is top-bottom symmetrical and left-right symmetrical.

The second metal case 132 is tightly fit with the outside of the first housing 13.

The metal partition plate 17 is fixedly disposed between the first and second bases 125 and 126. Each of the two sides of the metal partition plate 17 has a depressed slot 175. Each of the two sides of the tongue 121 has a concave portion 1205 corresponding to the slot 175.

The ground shielding member 19 is formed by bending a metal plate sheet, and is integrally formed with two grounding shielding sheets. Each of the two grounding shielding sheets has a first plate sheet 191 and a second plate sheet 192 forming a step. The two first plate sheets 191 cover the inner segments 1208 of the two connection surfaces of the tongue 121, and the two second plate sheets 192 cover the top and bottom sides of the base 122 and are electrically connected to the metal housing 13.

The bidirectional duplex USB TYPE-C electrical connection socket 1 also has the low-height connector design, as shown in FIG. 79, wherein the total height of the connection slot 16 is about 2.56 mm, the height c of each of the symmetrical spaces on the two connection surfaces of the tongue 121 is about 0.93 mm, and the height d of the front segment (contact interface) of the tongue is about 0.7 mm.

Referring again to FIG. 78, the electrical connection socket 1 and the electrical connection plug 2 of this embodiment can be bidirectionally electrically connected together in a duplex manner to achieve the effects of the doubled transmission and the convenient insertion and connection. That is, the contacts 44 of the two terminal sets of the electrical connection plug 2 are electrically connected to the contacts 141 of the two terminal sets of the electrical connection socket 1. The tongue 121 of the electrical connection socket 1 is connected to the fitting space 77 of the electrical connection plug 2. The two contact interface substrates 76 of the electrical connection plug 2 are fit with the symmetrical spaces of the two connection surfaces of the tongue 121 of the electrical connection socket 1, the contact 643 of the ground shielding member 640 of the plug is electrically connected to the first plate sheet 191 of the ground shielding member 19 of the socket. In addition, the engaging projection 633 of the resilient fastener 632 of the plug engages with the slot 175 of the metal partition plate 17 of the socket, so that the plug and the socket form the mutual engagement thereinside.

According to the above-mentioned descriptions, this embodiment has the following advantages:

1. The plug and the socket can be bidirectionally electrically connected together in a duplex manner to achieve the effects of the doubled transmission and the convenient insertion and connection, and also have the low-height design to achieve the slim and light effects.

2. The insulating bases of the plug and the socket are configured as the vertically stacked upper and lower bases, wherein the upper and lower bases are embedded, injected and fixed to a terminal set, respectively, so that the convenience in manufacturing can be achieved.

3. The height of the engaging projection 633 of the resilient fastener 632 of the plug is greater than the material thickness of the metal partition plate 630, and the resilient fastener 632 has a bent portion 635 to make the front segment and the rear end have a vertical step 635, so that the middle height of the engaging projection 633 is substantially disposed at the thickness center of the metal partition plate 630.

Referring to FIGS. 86 to 91, a bidirectional simplex USB TYPE-C electrical connection socket 3 and a bidirectional duplex USB TYPE-C electrical connection plug 2 bidirectional correspondingly connected together according to the $18^{th}$ embodiment of the invention are almost the same as the $17^{th}$ embodiment. This embodiment provides chargeable male and female connectors, so the number of terminals of each contact interface is fewer (only five).

Figures 86, 87, 88, 89:
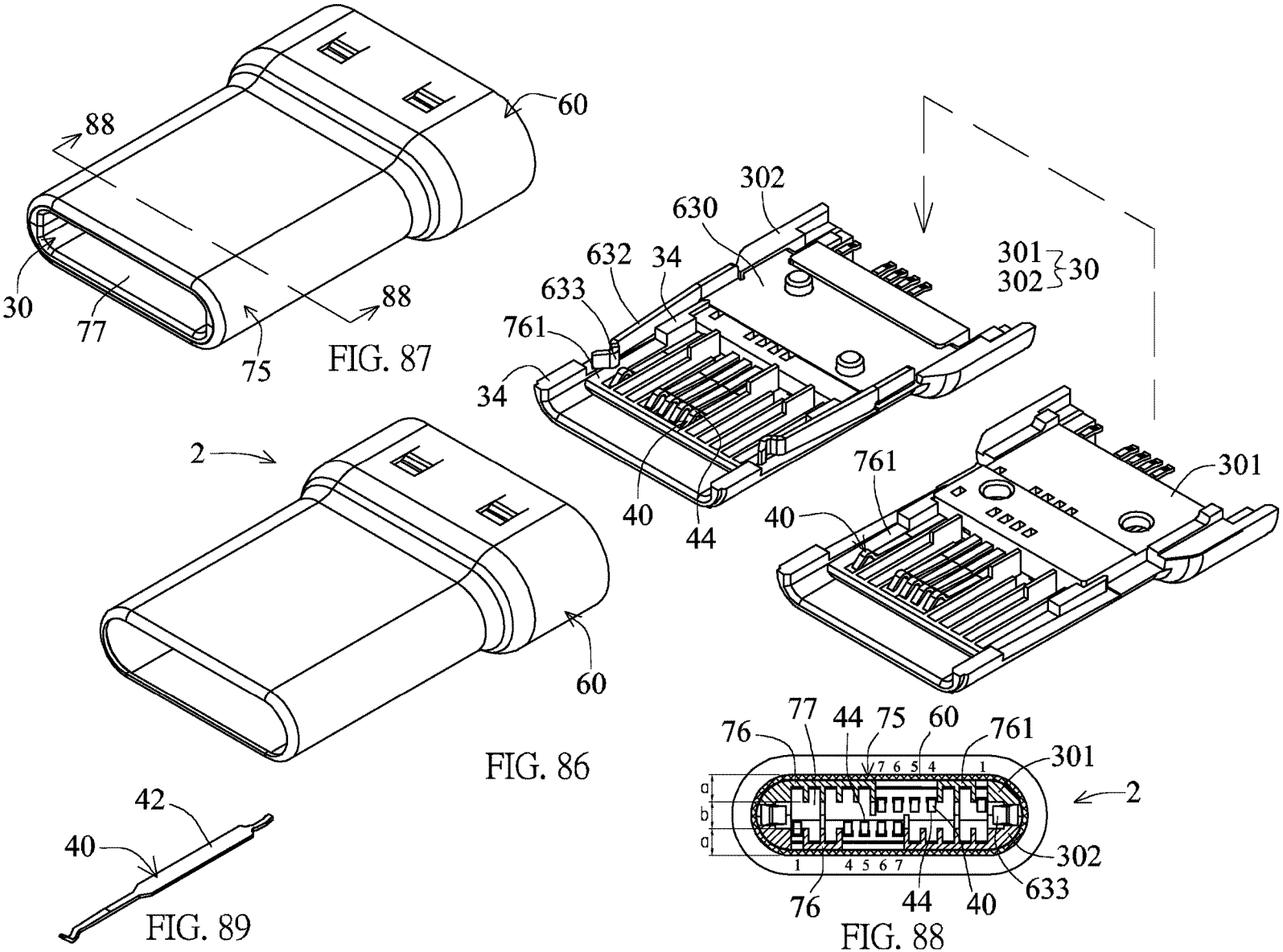
FIG. 86 is a pictorially exploded view showing a plug according to an $18^{th}$ embodiment of the invention.
FIG. 87 is a pictorial view showing the plug according to the $18^{th}$ embodiment of the invention.
FIG. 88 is a front cross-sectional view showing the plug according to the $18^{th}$ embodiment of the invention.
FIG. 89 is a pictorial view showing a terminal of the plug according to the $18^{th}$ embodiment of the invention.

Referring to FIGS. 86 to 89, the different between the bidirectional duplex USB TYPE-C electrical connection plug 2 and the $17^{th}$ embodiment resides in that each of the front segments of the upper base 301 and the lower base 302 of the insulating base 30 is integrally formed with the insulating layer 761 of the contact interface substrate 76. The two sides of the two insulating layers 761 have two side plates 34 resting against each other. The two side plates 34 function as the positioning structure for positioning the interval of the two insulating layers 761 to form the fitting space 77. Each of the two terminal sets has one row of five first terminals 40 respectively embedded, injected and fixed to the upper base 301 and the lower base 302. The contacts 44 of the two rows of first terminals 40 having the same circuit serial number are arranged reversely, as shown in FIG. 88, wherein the contacts 44 of the lower terminal set have the connection points with the circuit serial numbers of 1, 4, 5, 6, 7 arranged from left to right. The contacts 44 of the upper terminal set have the connection points with the circuit serial numbers of 7, 6, 5, 4, 1 arranged from left to right.

Because the connection points with the circuit serial numbers 1 and 4 are the ground and power terminals, respectively, the structure may be designed to have the wider plate surface, as shown in FIG. 89. For example, the fixing portion 42 may be broadened to speed up the current conduction.

The two contact interface substrates 76 of the bidirectional duplex USB TYPE-C electrical connection plug 2 have the height "a" of about 0.8 mm, the height "b" of the fitting space 77 is about 0.8 mm, and the total height of the fitting portion 75 is about 2.4 mm.

Similar to the $17^{th}$ embodiment, the bidirectional duplex USB TYPE-C electrical connection plug 2 has a circuit board and a rear shielding casing, wherein the circuit board electrically connects the connection points with the same circuit serial number of the two contact interfaces to the same circuit to form one set of circuits for output. Thus, it can work in conjunction with a bidirectional simplex electrical connection socket which can be bidirectionally correspondingly connected thereto.

Figure 90:
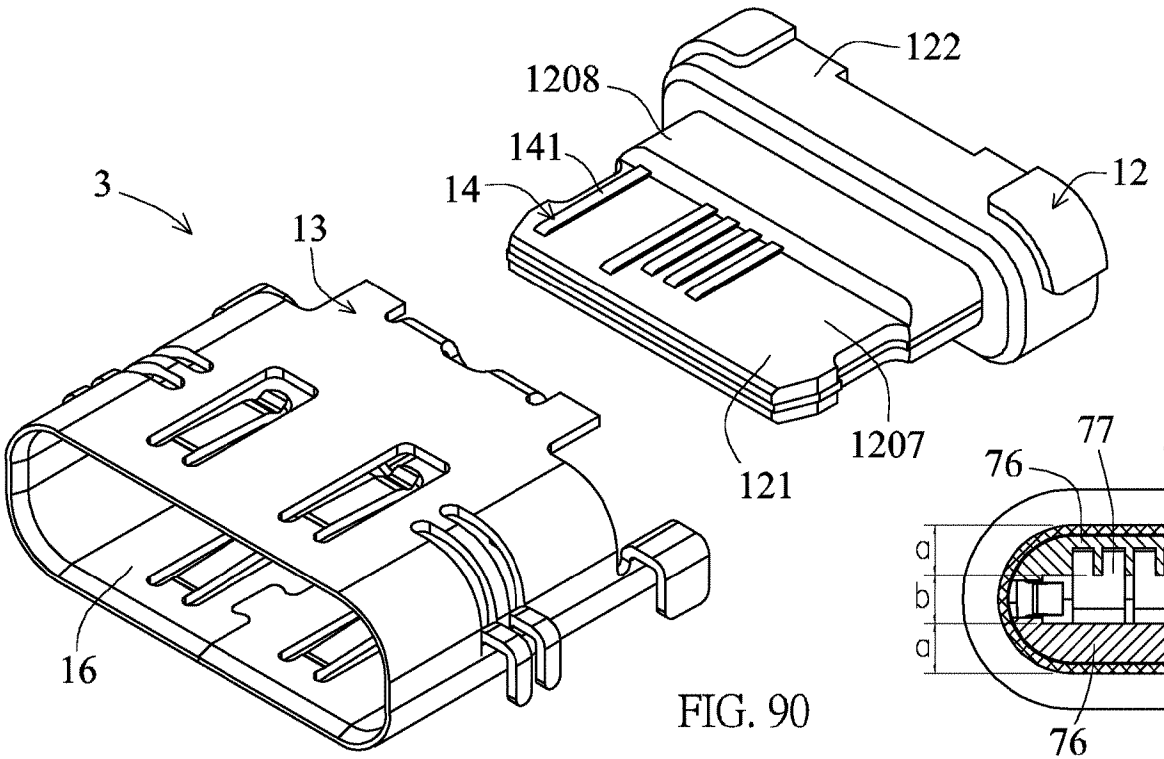
FIG. 90 is a pictorially exploded view showing a socket according to the $18^{th}$ embodiment of the invention.
Figure 91:
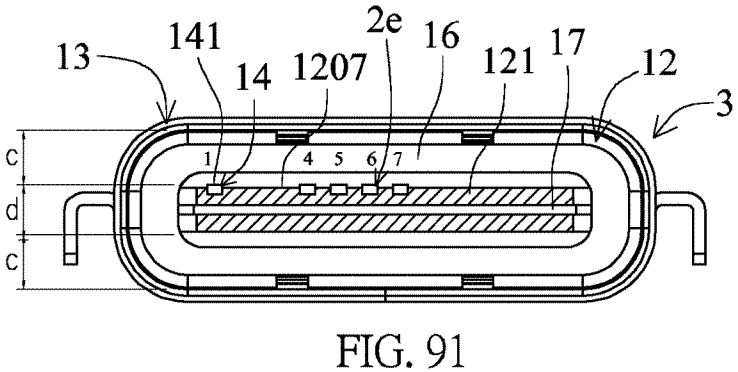
FIG. 91 is a front view showing the socket according to the $18^{th}$ embodiment of the invention.

Referring to FIGS. 90 and 91, the difference between the bidirectional simplex USB TYPE-C electrical connection socket 3 and the $17^{th}$ embodiment resides in that the insulating base 12 is only embedded and injected to form a terminal set. The terminal set has one row of five first terminals 14. The contact 141 of the one row of five first terminals 14 is in flat surface contact with the tongue 121 and exposed from an outer segment 1207 of the connection surface to form a contact interface 2*e*.

The bidirectional simplex USB TYPE-C electrical connection socket 3 is also the low-height connector design, the total height of the connection slot 16 is about 2.56 mm, the height c of each of the symmetrical spaces on the two connection surfaces of the tongue 121 is about 0.93 mm, and the height d of the front segment (contact interface) of the tongue is about 0.7 mm.

The male and female docking of this embodiment is the bidirectionally insertion connection, but is only the simplex electrical connection. So, in the combination of the plug and the socket, one has two contact interfaces, and the other has only one single contact interface.

Figure 92:
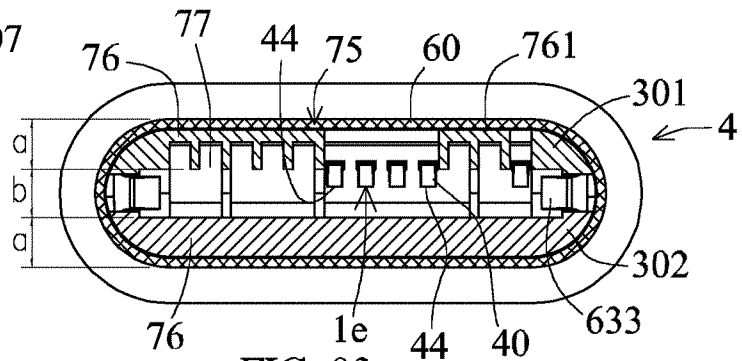
FIG. 92 is a front cross-sectional view showing a plug according to a $19^{th}$ embodiment of the invention.
Figure 93:
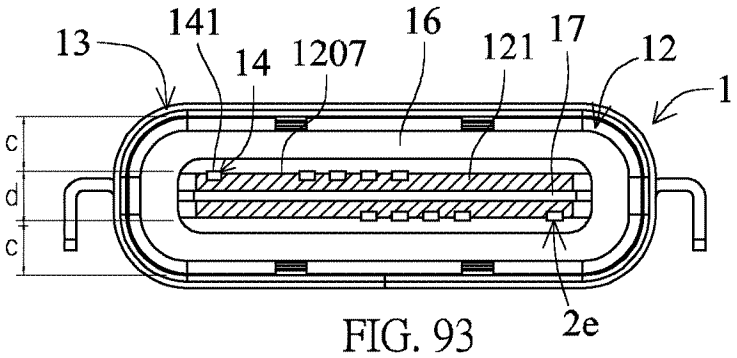
FIG. 93 is a front view showing a socket according to the $19^{th}$ embodiment of the invention.

Referring to FIGS. 92 and 93, the $19^{th}$ embodiment of the invention provides a bidirectional duplex USB TYPE-C electrical connection socket 1 and a bidirectional simplex USB TYPE-C electrical connection plug 4 bidirectionally correspondingly connected together, and is almost the same as the $18^{th}$ embodiment except for the difference that, as shown in FIG. 92, the bidirectional simplex USB TYPE-C electrical connection plug 4 is only embedded and injected at the upper base 301 to form one row of first terminals 40. So, the upper contact interface substrate 76 has a contact interface 1*e*. As shown in FIG. 93, the insulating base 12 of the bidirectional duplex USB TYPE-C electrical connection socket 1 is embedded and injected to form two terminal sets. So, each of the outer segments 1207 of the two connection surfaces of the tongue 121 is formed with one row of contacts 141 of one contact interface 2*e*.

The socket of this embodiment has two contact interfaces, so the socket is electrically connected to a circuit board. The circuit board may have cascaded circuits to electrically connect the connection points of the two contact interfaces of the socket with the same circuit serial number to the same circuit to form one set of circuits. Thus, it can work in conjunction with a bidirectional simplex electrical connection plug to perform the bidirectional corresponding connection.

While the present invention has been described by way of examples and in terms of preferred embodiments, it is to be understood that the present invention is not limited thereto. To the contrary, it is intended to cover various modifications. Therefore, the scope of the appended claims should be accorded the broadest interpretation so as to encompass all such modifications.

What is claimed is:

1. A low-height connector combination, comprising:

a duplex electrical connection socket, which is electrically connected to a circuit board and comprises: an insulation base having one end projectingly provided with a tongue, wherein the tongue is provided with upper and lower connection surfaces, each of the two connection surfaces is provided with a contact interface, each of the two contact interfaces is provided with multiple contacts arranged in a front-low manner and a rear-high manner, the multiple contacts comprises non-movable one row of contacts, which are arranged in the front-low manner and in flat surface contact with the tongue, the two rows of contacts of the two contact interfaces arranged in the front-low manner are formed on two rows of terminals, each of the terminals is provided with a pin, a fixing portion and an extension, the fixing portion is fixed to the insulation base, the extension is connected to one end of the fixing portion, extends to the tongue and is provided with the contact, the pin is connected to the other end of the fixing portion and electrically connected to the circuit board, at least one pair of the contacts of the two contact interfaces with the same circuit are arranged reversely, and at least one pair of the contacts of the two contact interfaces with the same circuit are electrically connected together; and a metal housing, which covers the tongue and is formed with a connection slot, wherein the tongue is disposed at a middle height of the connection slot, the two connection surfaces of the tongue form symmetrical two spaces, and heights of the two spaces of the two connection surfaces are smaller than a large space of a connection slot of a standard electrical connection socket having a minimum height specification specified by USB Association and greater than a small space of the connection slot of the standard electrical connection socket; and a duplex electrical connection plug comprising: a circuit board; an insulation base; a metal housing covering the insulation base; and a fitting portion provided on one end of the insulation base, wherein the fitting portion is provided with two contact interface substrates, which have the same height and face each other, and a fitting space, each of the two contact interface substrates is provided with an insulating layer, an interval between the two contact interface substrates is the fitting space, the two contact interface substrates have two inside layers being the insulating layers and two outside layers pertaining to the metal housing, each of the two contact interface substrates is provided with a contact interface, each of the two contact interfaces is provided with two rows of contacts arranged in a front-low and rear-high manner, the two rows of contacts project beyond the contact interface substrate and are elastically movable up and down, the two rear rows of contacts are formed on two rows of terminals, each of the terminals is provided with a pin, a fixing portion and an extension, the fixing portion is fixed to the insulation base, the extension is connected to one end of the fixing portion, extend to the contact interface substrate and is provided with the contact, the pin is connected to the other end of the fixing portion and electrically connected to the circuit board of the duplex electrical connection plug, at least one pair of the contacts of the two contact interfaces with the same circuit are arranged reversely, and at least one pair of the contacts of the two contact interfaces with the same circuit are electrically connected together; wherein the insulation base is provided with vertically stacked upper and lower bases, the upper and lower bases are respectively embedded with, injection molded with and fixed to the two rows of terminals, a middle between the upper and lower bases is provided with a transversally extending metal partition plate, the metal partition plate separates the two rows of terminals from each other, the two contact interface substrates have the same height, which is smaller than a contact interface substrate of a standard electrical connection plug having a minimum height specification specified by USB Association and greater than the small space;

wherein the fitting portion can be bidirectionally inserted into the connection slot of the duplex electrical connection socket, the heights of the two contact interface substrates of the duplex electrical connection plug can be fit with the two spaces of the two connection surfaces of the tongue, each of two first fitting gaps respectively between the two contact interface substrates and an upper surface and a lower surface of the connection slot is smaller than 0.15 mm to form tight fitting, the fitting space is fit with the tongue, and the two contact interfaces of the duplex electrical connection plug are respectively electrically connected to the two contact interfaces of the duplex electrical connection socket.

2. The low-height connector combination according to claim 1, wherein the circuit board of the duplex electrical connection socket and/or the circuit board of the duplex electrical connection plug is provided with a circuit safety protection device, the circuit safety protection device is provided with at least one of a signal circuit processing control element, and an anti-backflow or anti-short-circuit or circuit safety protection element, the circuit safety protection device is electrically connected to the two contact interfaces, and the circuit safety protection device ensures appropriate circuit safety protection when the duplex electrical connection socket and the duplex electrical connection plug are bidirectionally electrically connected together.

3. The low-height connector combination according to claim 1, wherein in each of the two contact interfaces of the duplex electrical connection socket and/or the duplex electrical connection plug:

one pair of ground contacts of the same circuit are electrically connected together and one pair of power contacts of the same circuit are electrically connected together; or each of multiple pairs of contacts of all the same circuits are electrically connected together.

4. The low-height connector combination according to claim 1, wherein: the standard electrical connection socket is a standard MICRO USB electrical connection socket, and a height of the large space is 0.97 mm and a height of the small space is 0.28 mm, so the heights of the two spaces of the two connection surfaces of the duplex electrical connection socket are greater than 0.28 mm and smaller than 0.97 mm; and the standard electrical connection plug is a standard MICRO USB electrical connection plug, and the height of the contact interface substrate of the standard electrical connection plug is 0.9 mm, so the heights of the two contact interface substrates of the duplex electrical connection plug are greater than 0.28 mm and smaller than 0.9 mm.

5. The low-height connector combination according to claim 4, wherein the heights of the two contact interface substrates of the duplex electrical connection plug are greater than a small space of a connection slot of a standard electrical connection socket having a maximum height specification specified by USB Association, the standard electrical connection socket of the maximum height specification is an A-type standard electrical connection socket, and a height of the small space of the A-type standard electrical connection socket is 0.72 mm, so the heights of the two contact interface substrates of the duplex electrical connection plug are greater than 0.72 mm and smaller than 0.9 mm.

6. The low-height connector combination according to claim 1, wherein the circuit board of the duplex electrical connection socket and/or the circuit board of the duplex electrical connection plug is provided with a connection point switching device, the connection point switching device is electrically connected to the two contact interfaces, and the connection point switching device can switch corresponding circuit connection point transmission when the two contact interfaces are bidirectionally electrically connected together.

7. The low-height connector combination according to claim 1 being one of (a) to (k) or a combination of more than one of (a) to (k):

(a) wherein each of the two rows of contacts of the duplex electrical connection socket are provided with two pairs of signal contacts RX+, RX− and TX+, TX−, and the four pairs of signal contacts are individually electrically connected to individually signal transmission circuits; and each of the two rear rows of contacts of the duplex electrical connection plug are provided with two pairs of signal contacts RX+, RX− and TX+, TX−, and the four pairs of signal contacts are individually electrically connected to individually signal transmission circuits;

(b) wherein top and bottom surfaces of the metal housing perpendicularly corresponding to the two connection surfaces of the duplex electrical connection socket are hole-free structures, and the top and bottom surfaces of the metal housing perpendicularly corresponding to the two contact interface substrates of the duplex electrical connection plug are hole-free structures;

(c) wherein each of left and right sides of the connection slot of the duplex electrical connection socket is provided with a metallic engaging structure, each of left and right sides of the fitting space of the duplex electrical connection plug is provided with a metallic engaging structure, and the engaging structure of the duplex electrical connection plug engages with the engaging structure of the duplex electrical connection socket to prevent the duplex electrical connection plug and the duplex electrical connection socket from separating from each other in a direction opposite to a docking direction;

(d) wherein each of the two contact interfaces of the duplex electrical connection socket comprise one pair of D+, D− signal contacts, the two D+ signal contacts of the two contact interfaces are electrically connected together and the two D− signal contacts are electrically connected together; and at least one of the two contact interfaces of the duplex electrical connection plug comprises one pair of D+, D− signal contacts;

(e) wherein each of the two contact interfaces of the duplex electrical connection socket comprise one pair of D+, D− signal contacts, the two D+ signal contacts of the two contact interfaces are electrically connected together and the two D− signal contacts are electrically connected together; and each of the two contact interfaces of the duplex electrical connection plug comprises one pair of D+, D− signal contacts, the two D+ signal contacts of the two contact interfaces are electrically connected together and the two D− signal contacts are electrically connected together;

(f) wherein the insulation base of the duplex electrical connection socket are vertically stacked upper and lower bases, and the upper and lower bases are respectively embedded with, injection molded with and fixed to the two rows of terminals;

(g) wherein the insulation base of the duplex electrical connection socket are vertically stacked upper and lower bases, the upper base is integrally provided with an upper segment of the tongue, the lower base is integrally provided with a lower segment of the tongue, and the upper and lower segments of the tongue are respectively embedded with, injection molded with and fixed to the two rows of terminals;

(h) wherein the insulation base of the duplex electrical connection socket are vertically stacked upper and lower bases, the upper base is integrally provided with an upper segment of the tongue, the lower base is integrally provided with a lower segment of the tongue, the upper and lower segments of the tongue are respectively embedded with, injection molded with and fixed to the two rows of terminals, an inner section of the extension of the terminal is embedded with, injection molded with and fixed to an inner section of the tongue, an outer section of the extension is embedded with, injection molded with and fixed to the outer section of the tongue to expose outer sections of the two connection surfaces, and the outer section of the extension is provided with the contact;

(i) wherein the upper and lower bases of the insulation base of the duplex electrical connection plug are respectively integrally connected to the two contact interface substrates, and the two contact interface substrates are respectively embedded with, injection molded with and fixed to the two rows of terminals;

(j) the front and rear rows of contacts of the duplex electrical connection plug are only connected to the one row of pins; and (k) each of two second fitting gaps left after the two spaces are respectively fit with the contact interface substrates is smaller than 0.15 mm.

8. The low-height connector combination according to claim 1, being one of (a) to (d) or a combination of more than one of (a) to (d):

(a) wherein each of the insulating layers of the two contact interface substrates of the duplex electrical connection plug is provided with a transversal front-rear isolating region to separate the front and rear rows of contacts;

(b) wherein each of the front and rear rows of contacts of the duplex electrical connection plug is provided with at least one ground contact, the front row of contacts are connected to at least one fixing portion, the at least one fixing portion extends to and is positioned at the contact interface substrate, and the fixing portions of one row of terminals provided with the rear row of contacts extend to and are positioned at the insulation base;

(c) wherein the contact interface substrate of the duplex electrical connection plug and the insulation base are integrally formed, and the two contact interface substrates are provided with a separating structure corresponding to the rear row of contacts, so that the rear row of contacts do not touch the metal housing when being elastically moved up and down; and (d) wherein each of the two contact interface substrates of the duplex electrical connection plug is provided with a depressed elastic movement space, one row of terminals forming the rear row of contacts are elastically movable up and down in the elastic movement space, and the insulating layer is provided with a bottom surface, separated from the metal housing, in the elastic movement space.

9. A low-height connector combination, comprising:

a duplex electrical connection socket, which is electrically connected to a circuit board and comprises: an insulation base having one end projectingly provided with a tongue, wherein the tongue is provided with upper and lower connection surfaces, each of the two connection surfaces is provided with a contact interface, each of the two contact interfaces comprises non-movable one row of contacts in flat surface contact with the tongue, the two rows of contacts are formed on two rows of terminals, each of the terminals is provided with a pin, a fixing portion and an extension, the fixing portion is fixed to the insulation base, the extension is connected to one end of the fixing portion, extends to the tongue and is provided with the contact, the pin is connected to the other end of the fixing portion and electrically connected to the circuit board, at least one pair of the contacts of the two contact interfaces with the same circuit are arranged reversely, each of the two rows of contacts are provided with two pairs of signal contacts RX+, RX− and TX+, TX−, and the four pairs of signal contacts are individually electrically connected to individually signal transmission circuits; and a metal housing, which covers the tongue and is formed with a connection slot, wherein the tongue is disposed at a middle height of the connection slot, the two connection surfaces of the tongue form symmetrical two spaces, and heights of the two spaces of the two connection surfaces are smaller than a large space of a connection slot of a standard electrical connection socket having a minimum height specification specified by USB Association and greater than a small space of the connection slot of the standard electrical connection socket; and a duplex electrical connection plug comprising: a circuit board; an insulation base; a metal housing covering the insulation base; and a fitting portion provided on one end of the insulation base, wherein the fitting portion is provided with two contact interface substrates, which have the same height and face each other, and a fitting space, each of the two contact interface substrates is provided with an insulating layer, an interval between the two contact interface substrates is the fitting space, the two contact interface substrates have two inside layers being the insulating layers and two outside layers pertaining to the metal housing, each of the two contact interface substrates is provided with a contact interface, each of the two contact interfaces comprises one row of elastically movable contacts, the two rows of elastically movable contacts are formed on two rows of terminals, each of the terminals is provided with a pin, a fixing portion and an extension, the fixing portion is fixed to the insulation base, the extension is connected to one end of the fixing portion, extend to the contact interface substrate and is provided with the contact, the pin is connected to the other end of the fixing portion and electrically connected to the circuit board of the duplex electrical connection plug, at least one pair of the contacts of the two contact interfaces with the same circuit are arranged reversely, each of the two rows of contacts are provided with two pairs of signal contacts RX+, RX− and TX+, TX−, and the four pairs of signal contacts are individually electrically connected to individually signal transmission circuits; wherein the insulation base is provided with vertically stacked upper and lower bases, the upper and lower bases are respectively embedded with, injection molded with and fixed to the two rows of terminals, a middle between the upper and lower bases is provided with a transversally extending metal partition plate, the metal partition plate separates the two rows of terminals from each other, and the two contact interface substrates have the same height, which is smaller than a contact interface substrate of a standard electrical connection plug having a minimum height specification specified by USB Association and greater than the small space;

wherein the fitting portion can be bidirectionally inserted into the connection slot of the duplex electrical connection socket, the heights of the two contact interface substrates of the duplex electrical connection plug can be fit with the two spaces of the two connection surfaces of the tongue, each of two first fitting gaps respectively between the two contact interface substrates and an upper surface and a lower surface of the connection slot is smaller than 0.15 mm to form tight fitting, the fitting space is fit with the tongue, and the two contact interfaces of the duplex electrical connection plug are respectively electrically connected to the two contact interfaces of the duplex electrical connection socket.

10. The low-height connector combination according to claim 9, wherein the circuit board of the duplex electrical connection socket and/or the circuit board of the duplex electrical connection plug is provided with a circuit safety protection device, the circuit safety protection device is provided with at least one of a signal circuit processing control element, and an anti-backflow or anti-short-circuit or circuit safety protection element, the circuit safety protection device is electrically connected to the two contact interfaces, and the circuit safety protection device ensures appropriate circuit safety protection when the duplex electrical connection socket and the duplex electrical connection plug are bidirectionally electrically connected together.

11. The low-height connector combination according to claim 9, wherein in each of the two contact interfaces of the duplex electrical connection socket and the duplex electrical connection plug:

one pair of ground contacts of the same circuit are electrically connected together and one pair of power contacts of the same circuit are electrically connected together; or each of multiple pairs of contacts of all the same circuits are electrically connected together.

12. The low-height connector combination according to claim 9, wherein: the standard electrical connection socket is a standard MICRO USB electrical connection socket, and a height of the large space is 0.97 mm and a height of the small space is 0.28 mm, so the heights of the two spaces of the two connection surfaces of the duplex electrical connection socket are greater than 0.28 mm and smaller than 0.97 mm; and the standard electrical connection plug is a standard MICRO USB electrical connection plug, and the height of the contact interface substrate of the standard electrical connection plug is 0.9 mm, so the heights of the two contact interface substrates of the duplex electrical connection plug are greater than 0.28 mm and smaller than 0.9 mm.

13. The low-height connector combination according to claim 12, wherein the heights of the two contact interface substrates of the duplex electrical connection plug are greater than a small space of a connection slot of a standard electrical connection socket having a maximum height specification specified by USB Association, the standard electrical connection socket of the maximum height specification is an A-type standard electrical connection socket, and a height of the small space of the A-type standard electrical connection socket is 0.72 mm, so the heights of the two contact interface substrates of the duplex electrical connection plug are greater than 0.72 mm and smaller than 0.9 mm.

14. The low-height connector combination according to claim 9, wherein the circuit board of the duplex electrical connection socket and/or the circuit board of the duplex electrical connection plug is provided with a connection point switching device, the connection point switching device is electrically connected to the two contact interfaces, and the connection point switching device can switch corresponding circuit connection point transmission when the two contact interfaces are bidirectionally electrically connected together.

15. The low-height connector combination according to claim 9 being one of (a) to (i) or a combination of more than one of (a) to (i):

(a) wherein top and bottom surfaces of the metal housing perpendicularly corresponding to the two connection surfaces of the duplex electrical connection socket are hole-free structures, and the top and bottom surfaces of the metal housing perpendicularly corresponding to the two contact interface substrates of the duplex electrical connection plug are hole-free structures;

(b) wherein each of left and right sides of the connection slot of the duplex electrical connection socket is provided with a metallic engaging structure, each of left and right sides of the fitting space of the duplex electrical connection plug is provided with a metallic engaging structure, and the engaging structure of the duplex electrical connection plug engages with the engaging structure of the duplex electrical connection socket to prevent the duplex electrical connection plug and the duplex electrical connection socket from separating from each other in a direction opposite to a docking direction;

(c) wherein each of the two contact interfaces of the duplex electrical connection socket comprise one pair of D+, D− signal contacts, the two D+ signal contacts of the two contact interfaces are electrically connected together and the two D− signal contacts are electrically connected together; and at least one of the two contact interfaces of the duplex electrical connection plug comprises one pair of D+, D− signal contacts;

(d) wherein each of the two contact interfaces of the duplex electrical connection socket comprise one pair of D+, D− signal contacts, the two D+ signal contacts of the two contact interfaces are electrically connected together and the two D− signal contacts are electrically connected together; and each of the two contact interfaces of the duplex electrical connection plug comprises one pair of D+, D− signal contacts, the two D+ signal contacts of the two contact interfaces are electrically connected together and the two D− signal contacts are electrically connected together;

(e) wherein the insulation base of the duplex electrical connection socket are vertically stacked upper and lower bases, and the upper and lower bases are respectively embedded with, injection molded with and fixed to the two rows of terminals;

(f) wherein the insulation base of the duplex electrical connection socket are vertically stacked upper and lower bases, the upper base is integrally provided with an upper segment of the tongue, the lower base is integrally provided with a lower segment of the tongue, and the upper and lower segments of the tongue are respectively embedded with, injection molded with and fixed to the two rows of terminals;

(g) wherein the insulation base of the duplex electrical connection socket are vertically stacked upper and lower bases, the upper base is integrally provided with an upper segment of the tongue, the lower base is integrally provided with a lower segment of the tongue, the upper and lower segments of the tongue are respectively embedded with, injection molded with and fixed to the two rows of terminals, an inner section of the extension of the terminal is embedded with, injection molded with and fixed to an inner section of the tongue, an outer section of the extension is embedded with, injection molded with and fixed to the outer section of the tongue to expose outer sections of the two connection surfaces, and the outer section of the extension is provided with the contact;

(h) wherein the upper and lower bases of the insulation base of the duplex electrical connection plug are respectively integrally connected to the two contact interface substrates, and the two contact interface substrates are respectively embedded with, injection molded with and fixed to the two rows of terminals; and (i) each of two second fitting gaps left after the two spaces are respectively fit with the contact interface substrates is smaller than 0.15 mm.

16. A low-height connector combination, comprising:

a duplex electrical connection socket, which is electrically connected to a circuit board and comprises: an insulation base having one end projectingly provided with a tongue, wherein the tongue is provided with upper and lower connection surfaces, each of the two connection surfaces is provided with a contact interface, each of the two contact interfaces comprises one row of contacts, the two rows of contacts are formed on two rows of terminals, each of the terminals is provided with a pin, a fixing portion and an extension, the fixing portion is fixed to the insulation base, the extension is connected to one end of the fixing portion, extends to the tongue and is provided with the contact, the pin is connected to the other end of the fixing portion and electrically connected to the circuit board, at least one pair of the contacts of the two contact interfaces with the same circuit are arranged reversely, and at least one pair of the contacts of the two contact interfaces with the same circuit are electrically connected together; and a metal housing, which covers the tongue and is formed with a connection slot, wherein the two connection surfaces perpendicularly corresponding to top and bottom surfaces of the metal housing are hole-free structures, each of left and right sides of the connection slot is provided with a metallic engaging structure, the tongue is disposed at a middle height of the connection slot, the two connection surfaces of the tongue form symmetrical two spaces, and heights of the two spaces of the two connection surfaces are smaller than a large space of a connection slot of a standard electrical connection socket having a minimum height specification specified by USB Association and greater than a small space of the connection slot of the standard electrical connection socket; and a duplex electrical connection plug comprising: a circuit board; an insulation base; a metal housing covering the insulation base; and a fitting portion provided on one end of the insulation base, wherein the fitting portion is provided with two contact interface substrates, which have the same height and face each other, and a fitting space, each of the two contact interface substrates is provided with an insulating layer, an interval between the two contact interface substrates is the fitting space, the two contact interface substrates have two inside layers being the insulating layers and two outside layers pertaining to the metal housing, each of the two contact interface substrates is provided with a contact interface, each of the two contact interfaces comprises one row of contacts, the two rows of contacts are formed on two rows of terminals, each of the terminals is provided with a pin, a fixing portion and an extension, the fixing portion is fixed to the insulation base, the extension is connected to one end of the fixing portion, extend to the contact interface substrate and is provided with the contact, the pin is connected to the other end of the fixing portion and electrically connected to the circuit board of the duplex electrical connection plug, at least one pair of the contacts of the two contact interfaces with the same circuit are arranged reversely, and at least one pair of the contacts of the two contact interfaces with the same circuit are electrically connected together; wherein the two contact interface substrates perpendicularly corresponding to top and bottom surfaces of the metal housing are hole-free structures, each of left and right sides of the fitting space is provided with a metallic engaging structure, and the two contact interface substrates have the same height, which is smaller than a contact interface substrate of a standard electrical connection plug having a minimum height specification specified by USB Association and greater than the small space;

wherein the fitting portion can be bidirectionally inserted into the connection slot of the duplex electrical connection socket, the heights of the two contact interface substrates of the duplex electrical connection plug can be fit with the two spaces of the two connection surfaces of the tongue, each of two first fitting gaps respectively between the two contact interface substrates and an upper surface and a lower surface of the connection slot is smaller than 0.15 mm to form tight fitting, the fitting space is fit with the tongue, the two contact interfaces of the duplex electrical connection plug are respectively electrically connected to the two contact interfaces of the duplex electrical connection socket, and the engaging structure of the duplex electrical connection plug engages with the engaging structure of the duplex electrical connection socket to prevent the duplex electrical connection plug and the duplex electrical connection socket from separating from each other in a direction opposite to a docking direction.

17. The low-height connector combination according to claim 16, wherein the circuit board of the duplex electrical connection socket and/or the circuit board of the duplex electrical connection plug is provided with a circuit safety protection device, the circuit safety protection device is provided with at least one of a signal circuit processing control element, and an anti-backflow or anti-short-circuit or circuit safety protection element, the circuit safety protection device is electrically connected to the two contact interfaces, and the circuit safety protection device ensures appropriate circuit safety protection when the duplex electrical connection socket and the duplex electrical connection plug are bidirectionally electrically connected together.

18. The low-height connector combination according to claim 16, wherein in each of the two contact interfaces of the duplex electrical connection socket and the duplex electrical connection plug:

one pair of ground contacts of the same circuit are electrically connected together and one pair of power contacts of the same circuit are electrically connected together; or each of multiple pairs of contacts of all the same circuits are electrically connected together.

19. The low-height connector combination according to claim 16, wherein: the standard electrical connection socket is a standard MICRO USB electrical connection socket, and a height of the large space is 0.97 mm and a height of the small space is 0.28 mm, so the heights of the two spaces of the two connection surfaces of the duplex electrical connection socket are greater than 0.28 mm and smaller than 0.97 mm; and the standard electrical connection plug is a standard MICRO USB electrical connection plug, and the height of the contact interface substrate of the standard electrical connection plug is 0.9 mm, so the heights of the two contact interface substrates of the duplex electrical connection plug are greater than 0.28 mm and smaller than 0.9 mm.

20. The low-height connector combination according to claim 19, wherein the heights of the two contact interface substrates of the duplex electrical connection plug are greater than a small space of a connection slot of a standard electrical connection socket having a maximum height specification specified by USB Association, the standard electrical connection socket of the maximum height specification is an A-type standard electrical connection socket, and a height of the small space of the A-type standard electrical connection socket is 0.72 mm, so the heights of the two contact interface substrates of the duplex electrical connection plug are greater than 0.72 mm and smaller than 0.9 mm.

21. The low-height connector combination according to claim 16, wherein the circuit board of the duplex electrical connection socket and/or the circuit board of the duplex electrical connection plug is provided with a connection point switching device, the connection point switching device is electrically connected to the two contact interfaces, and the connection point switching device can switch corresponding circuit connection point transmission when the two contact interfaces are bidirectionally electrically connected together.

22. The low-height connector combination according to claim 16 being one of (a) to (i) or a combination of more than one of (a) to (i):

(a) wherein each of the two rows of contacts of the duplex electrical connection socket are provided with two pairs of signal contacts RX+, RX− and TX+, TX−, the four pairs of signal contacts are individually electrically connected to individually signal transmission circuits, each of the two rows of contacts of the duplex electrical connection plug are provided with two pairs of signal contacts RX+, RX− and TX+, TX−, and the four pairs of signal contacts are individually electrically connected to individually signal transmission circuits;

(b) wherein each of the two contact interfaces of the duplex electrical connection socket comprise one pair of D+, D− signal contacts, the two D+ signal contacts of the two contact interfaces are electrically connected together and the two D− signal contacts are electrically connected together; and at least one of the two contact interfaces of the duplex electrical connection plug comprises one pair of D+, D− signal contacts;

(c) wherein each of the two contact interfaces of the duplex electrical connection socket comprise one pair of D+, D− signal contacts, the two D+ signal contacts of the two contact interfaces are electrically connected together and the two D− signal contacts are electrically connected together; and each of the two contact interfaces of the duplex electrical connection plug comprises one pair of D+, D− signal contacts, the two D+ signal contacts of the two contact interfaces are electrically connected together and the two D− signal contacts are electrically connected together;

(d) wherein the insulation base of the duplex electrical connection socket are vertically stacked upper and lower bases, and the upper and lower bases are respectively embedded with, injection molded with and fixed to the two rows of terminals;

(e) wherein the insulation base of the duplex electrical connection socket are vertically stacked upper and lower bases, the upper base is integrally provided with an upper segment of the tongue, the lower base is integrally provided with a lower segment of the tongue, and the upper and lower segments of the tongue are respectively embedded with, injection molded with and fixed to the two rows of terminals;

(f) wherein the insulation base of the duplex electrical connection socket are vertically stacked upper and lower bases, the upper base is integrally provided with an upper segment of the tongue, the lower base is integrally provided with a lower segment of the tongue, the upper and lower segments of the tongue are respectively embedded with, injection molded with and fixed to the two rows of terminals, an inner section of the extension of the terminal is embedded with, injection molded with and fixed to an inner section of the tongue, an outer section of the extension is embedded with, injection molded with and fixed to the outer section of the tongue to expose outer sections of the two connection surfaces, and the outer section of the extension is provided with the contact;

(g) wherein the insulation base of the duplex electrical connection plug is provided with vertically stacked upper and lower bases, the upper and lower bases are respectively embedded with, injection molded with and fixed to the two rows of terminals, a middle between the upper and lower bases is provided with a transversally extending metal partition plate, and the metal partition plate separates the two rows of terminals from each other;

(h) wherein the insulation base of the duplex electrical connection plug is provided with vertically stacked upper and lower bases, the upper and lower bases are respectively embedded with, injection molded with and fixed to the two rows of terminals, a middle between the upper and lower bases is provided with a transversally extending metal partition plate, the metal partition plate separates the two rows of terminals from each other, the upper and lower bases of the insulation base of the duplex electrical connection plug are respectively integrally connected to the two contact interface substrates, and the two contact interface substrates are respectively embedded with, injection molded with and fixed to the two rows of terminals; and (i) each of two second fitting gaps left after the two spaces are respectively fit with the contact interface substrates is smaller than 0.15 mm.

23. A low-height connector combination, comprising:

a duplex electrical connection socket, which is electrically connected to a circuit board and comprises: an insulation base having one end projectingly provided with a tongue, wherein the tongue is provided with upper and lower connection surfaces, each of the two connection surfaces is provided with a contact interface, each of the two contact interfaces comprises one row of at least seven contacts and is provided with only one pair of D+, D− signal contacts, the two rows of contacts are formed on two rows of terminals, each of the terminals is provided with a pin, a fixing portion and an extension, the fixing portion is fixed to the insulation base, the extension is connected to one end of the fixing portion, extends to the tongue and is provided with the contact, the pin is connected to the other end of the fixing portion and electrically connected to the circuit board, at least one pair of the contacts of the two contact interfaces with the same circuit are arranged reversely, wherein the two D+ signal contacts are electrically connected together, the two D− signal contacts are electrically connected together, and the circuit board is provided with a circuit safety protection device, wherein the circuit safety protection device is provided with at least one of a signal circuit processing control element, and an anti-backflow or anti-short-circuit or circuit safety protection element, the circuit safety protection device is electrically connected to the two contact interfaces, and the circuit safety protection device ensures appropriate circuit safety protection when the duplex electrical connection socket and the duplex electrical connection plug are bidirectionally electrically connected together; and a metal housing, which covers the tongue and is formed with a connection slot, wherein the tongue is disposed at a middle height of the connection slot, the two connection surfaces of the tongue form symmetrical two spaces, and heights of the two spaces of the two connection surfaces are smaller than a large space of a connection slot of a standard electrical connection socket having a minimum height specification specified by USB Association and greater than a small space of the connection slot of the standard electrical connection socket; and a duplex electrical connection plug comprising: a circuit board; an insulation base; a metal housing covering the insulation base; and a fitting portion provided on one end of the insulation base, wherein the fitting portion is provided with two contact interface substrates, which have the same height and face each other, and a fitting space, each of the two contact interface substrates is provided with an insulating layer, an interval between the two contact interface substrates is the fitting space, the two contact interface substrates have two inside layers being the insulating layers and two outside layers pertaining to the metal housing, each of the two contact interface substrates is provided with a contact interface, each of the two contact interfaces comprises one row of at least five contacts, the two rows of contacts respectively project beyond the two contact interface substrates, the two rows of contacts are formed on two rows of terminals, each of the terminals is provided with a pin, a fixing portion and an extension, the fixing portion is fixed to the insulation base, the extension is connected to one end of the fixing portion, extend to the contact interface substrate and is provided with the contact, the pin is connected to the other end of the fixing portion and electrically connected to the circuit board of the duplex electrical connection plug, at least one pair of the contacts of the two contact interfaces with the same circuit are arranged reversely, and at least one pair of the contacts of the two contact interfaces with the same circuit are electrically connected together; and the two contact interface substrates have the same height, which is smaller than a contact interface substrate of a standard electrical connection plug having a minimum height specification specified by USB Association and greater than the small space;

wherein the fitting portion can be bidirectionally inserted into the connection slot of the duplex electrical connection socket, the heights of the two contact interface substrates of the duplex electrical connection plug can be fit with the two spaces of the two connection surfaces of the tongue, each of two first fitting gaps respectively between the two contact interface substrates and an upper surface and a lower surface of the connection slot is smaller than 0.15 mm to form tight fitting, the fitting space is fit with the tongue, and the two contact interfaces of the duplex electrical connection plug are respectively electrically connected to the two contact interfaces of the duplex electrical connection socket.

24. The low-height connector combination according to claim 23, wherein the circuit board of the duplex electrical connection plug is provided with a circuit safety protection device, the circuit safety protection device is provided with at least one of a signal circuit processing control element, and an anti-backflow or anti-short-circuit or circuit safety protection element, the circuit safety protection device is electrically connected to the two contact interfaces, and the circuit safety protection device ensures appropriate circuit safety protection when the duplex electrical connection socket and the duplex electrical connection plug are bidirectionally electrically connected together.

25. The low-height connector combination according to claim 23, wherein in each of the two contact interfaces of the duplex electrical connection socket and the duplex electrical connection plug:

one pair of ground contacts of the same circuit are electrically connected together and one pair of power contacts of the same circuit are electrically connected together; or each of multiple pairs of contacts of all the same circuits are electrically connected together.

26. The low-height connector combination according to claim 23, wherein: the standard electrical connection socket is a standard MICRO USB electrical connection socket, and a height of the large space is 0.97 mm and a height of the small space is 0.28 mm, so the heights of the two spaces of the two connection surfaces of the duplex electrical connection socket are greater than 0.28 mm and smaller than 0.97 mm; and the standard electrical connection plug is a standard MICRO USB electrical connection plug, and the height of the contact interface substrate of the standard electrical connection plug is 0.9 mm, so the heights of the two contact interface substrates of the duplex electrical connection plug are greater than 0.28 mm and smaller than 0.9 mm.

27. The low-height connector combination according to claim 26, wherein the heights of the two contact interface substrates of the duplex electrical connection plug are greater than a small space of a connection slot of a standard electrical connection socket having a maximum height specification specified by USB Association, the standard electrical connection socket of the maximum height specification is an A-type standard electrical connection socket, and a height of the small space of the A-type standard electrical connection socket is 0.72 mm, so the heights of the two contact interface substrates of the duplex electrical connection plug are greater than 0.72 mm and smaller than 0.9 mm.

28. The low-height connector combination according to claim 23, wherein the circuit board of the duplex electrical connection socket and/or the circuit board of the duplex electrical connection plug is provided with a connection point switching device, the connection point switching device is electrically connected to the two contact interfaces, and the connection point switching device can switch corresponding circuit connection point transmission when the two contact interfaces are bidirectionally electrically connected together.

29. The low-height connector combination according to claim 23 being one of (a) to (j) or a combination of more than one of (a) to (j):

(a) wherein each of the two rows of contacts of the duplex electrical connection socket are provided with two pairs of signal contacts RX+, RX− and TX+, TX−, the four pairs of signal contacts are individually electrically connected to individually signal transmission circuits, each of the two rows of contacts of the duplex electrical connection plug are provided with two pairs of signal contacts RX+, RX− and TX+, TX−, and the four pairs of signal contacts are individually electrically connected to individually signal transmission circuits;

(b) wherein top and bottom surfaces of the metal housing perpendicularly corresponding to the two connection surfaces of the duplex electrical connection socket are hole-free structures, and the top and bottom surfaces of the metal housing perpendicularly corresponding to the two contact interface substrates of the duplex electrical connection plug are hole-free structures;

(c) wherein each of left and right sides of the connection slot of the duplex electrical connection socket is provided with a metallic engaging structure, each of left and right sides of the fitting space of the duplex electrical connection plug is provided with a metallic engaging structure, and the engaging structure of the duplex electrical connection plug engages with the engaging structure of the duplex electrical connection socket to prevent the duplex electrical connection plug and the duplex electrical connection socket from separating from each other in a direction opposite to a docking direction;

(d) wherein each of the two contact interfaces of the duplex electrical connection plug comprises one pair of D+, D− signal contacts, the two D+ signal contacts of the two contact interfaces are electrically connected together and the two D− signal contacts are electrically connected together;

(e) wherein the insulation base of the duplex electrical connection socket are vertically stacked upper and lower bases, and the upper and lower bases are respectively embedded with, injection molded with and fixed to the two rows of terminals;

(f) wherein the insulation base of the duplex electrical connection socket are vertically stacked upper and lower bases, the upper base is integrally provided with an upper segment of the tongue, the lower base is integrally provided with a lower segment of the tongue, and the upper and lower segments of the tongue are respectively embedded with, injection molded with and fixed to the two rows of terminals;

(g) wherein the insulation base of the duplex electrical connection socket are vertically stacked upper and lower bases, the upper base is integrally provided with an upper segment of the tongue, the lower base is integrally provided with a lower segment of the tongue, the upper and lower segments of the tongue are respectively embedded with, injection molded with and fixed to the two rows of terminals, an inner section of the extension of the terminal is embedded with, injection molded with and fixed to an inner section of the tongue, an outer section of the extension is embedded with, injection molded with and fixed to the outer section of the tongue to expose outer sections of the two connection surfaces, and the outer section of the extension is provided with the contact;

(h) wherein the insulation base of the duplex electrical connection plug is provided with vertically stacked upper and lower bases, the upper and lower bases are respectively embedded with, injection molded with and fixed to the two rows of terminals, a middle between the upper and lower bases is provided with a transversally extending metal partition plate, and the metal partition plate separates the two rows of terminals from each other;

(i) wherein the insulation base of the duplex electrical connection plug is provided with vertically stacked upper and lower bases, the upper and lower bases are respectively embedded with, injection molded with and fixed to the two rows of terminals, a middle between the upper and lower bases is provided with a transversally extending metal partition plate, the metal partition plate separates the two rows of terminals from each other, the upper and lower bases of the insulation base of the duplex electrical connection plug are respectively integrally connected to the two contact interface substrates, and the two contact interface substrates are respectively embedded with, injection molded with and fixed to the two rows of terminals; and (j) each of two second fitting gaps left after the two spaces are respectively fit with the contact interface substrates is smaller than 0.15 mm.

* * * * *